US009371623B2

(12) United States Patent
Coupland

(10) Patent No.: US 9,371,623 B2
(45) Date of Patent: Jun. 21, 2016

(54) DIAPHRAGM WALL APPARATUS AND METHODS

(75) Inventor: John William Coupland, Ross-shire (GB)

(73) Assignee: CCMJ SYSTEMS LTD, Ross-Shire (GB)

( * ) Notice: Subject to any disclaimer, the term of this patent is extended or adjusted under 35 U.S.C. 154(b) by 162 days.

(21) Appl. No.: 14/232,796

(22) PCT Filed: Jul. 10, 2012

(86) PCT No.: PCT/GB2012/000579

§ 371 (c)(1), (2), (4) Date: Apr. 4, 2014

(87) PCT Pub. No.: WO2013/007968

PCT Pub. Date: Jan. 17, 2013

(65) Prior Publication Data

US 2014/0219730 A1 Aug. 7, 2014

(30) Foreign Application Priority Data

Jul. 14, 2011 (GB) ..... 1112136.5
Jan. 16, 2012 (GB) ..... 1200655.7

(51) Int. Cl.
*E02D 5/18* (2006.01)
*E02D 17/13* (2006.01)
*E02D 29/16* (2006.01)

(52) U.S. Cl.
CPC *E02D 5/18* (2013.01); *E02D 17/13* (2013.01); *E02D 29/16* (2013.01)

(58) Field of Classification Search
USPC ..... 405/284, 286, 287
See application file for complete search history.

(56) References Cited

U.S. PATENT DOCUMENTS

RE25,102 E 12/1961 Buzzell et al.
3,422,627 A 1/1969 Courte
(Continued)

FOREIGN PATENT DOCUMENTS

CN 1143703 A 2/1997
CN 101560767 A 10/2009
(Continued)

OTHER PUBLICATIONS

Casagrande, FG: The joint forming mill was designed to be used in the construction of diaphragm walls, to replace the conventional stop-end tube for the formation of joints between adjacent panels. Casagrande, Innovat & Technol, Nov. 22, 1993: 9 pages.
(Continued)

*Primary Examiner* — Sean Andrish
(74) *Attorney, Agent, or Firm* — Moore & Van Allen PLLC; W. Kevin Ransom

(57) ABSTRACT

The invention relates to apparatus and methods and kits for constructing walls such as diaphragm walls comprising one or more panels and walls so constructed. In particular the invention relates to apparatus, methods and diaphragm walls having a guideway along a height of a first wall of a pane). More particularly, the invention relates to an apparatus for constructing a diaphragm wall comprising: a guideway tube along a height of a first wall of a first concrete panel; a sacrificial wall element in the guideway tube that extends along the tube and about a portion of a periphery of the tube; a cutting mechanism for cutting along the height of a first wall of the first concrete panel, the cutting mechanism being arranged to cut along the height of the wall of the first concrete panel and along the sacrificial wall element of the guideway tube so as to cut away at least part of the sacrificial wall element of the guideway tube along at least part of the height of the first wall. The invention further relates to a comprising: casting a guideway tube into a first concrete panel along a height of a first wall of the panel; cutting along the height of the first wall of the panel; cutting along at least part of the length of the sacrificial wall element of the guideway tube; pouring a second concrete panel, including pouring concrete into the cutaway guideway tube. The invention further provides a diaphragm wall comprising at least two or a series of concrete panels adjoining one another.

27 Claims, 35 Drawing Sheets

(56) References Cited

U.S. PATENT DOCUMENTS

| | | | | |
|---|---|---|---|---|
| 3,431,736 | A | 3/1969 | Ueda | |
| 3,464,665 | A | 9/1969 | Schoewert | |
| 3,759,044 | A | 9/1973 | Caron et al. | |
| 3,796,054 | A | 3/1974 | Piccagli | |
| 3,798,914 | A | 3/1974 | Irwin-Childs | |
| 4,367,057 | A | 1/1983 | Hughes et al. | |
| 4,582,453 | A | 4/1986 | Ressi di Cervia | |
| 4,838,980 | A * | 6/1989 | Glaser | E02D 5/18 156/497 |
| 4,930,940 | A | 6/1990 | Charlier et al. | |
| 4,990,210 | A | 2/1991 | Glaser | |
| 5,056,242 | A | 10/1991 | Miotti | |
| 5,056,959 | A | 10/1991 | Cannac et al. | |
| 5,263,798 | A * | 11/1993 | Dupeuble | E02D 17/13 405/284 |
| 5,548,937 | A | 8/1996 | Shimonohara | |
| 6,018,918 | A | 2/2000 | Long, Sr. | |
| 6,052,963 | A | 4/2000 | Lefort et al. | |
| 6,164,873 | A | 12/2000 | Miotti et al. | |
| 6,276,106 | B1 | 8/2001 | Shotton et al. | |
| 2002/0119013 | A1 | 8/2002 | Shotton | |
| 2013/0255180 | A1 | 10/2013 | Daubner et al. | |

FOREIGN PATENT DOCUMENTS

| | | | |
|---|---|---|---|
| CN | 101858090 | A | 10/2010 |
| DE | 3430789 | A1 | 3/1986 |
| DE | 3430790 | A1 | 3/1986 |
| DE | 3503542 | A1 | 10/1986 |
| DE | 3634906 | A1 | 4/1988 |
| DE | 4016388 | A1 | 11/1990 |
| DE | 9001679 | U1 | 6/1991 |
| DE | 4428513 | A1 | 2/1995 |
| DE | 69201743 | T2 | 7/1995 |
| DE | 19901556 | A1 | 8/2000 |
| DE | 202011051438 | U1 | 12/2011 |
| EP | 0101350 | A1 | 2/1984 |
| EP | 0290303 | A1 | 11/1988 |
| EP | 0333577 | A1 | 9/1989 |
| EP | 0402247 | A1 | 12/1990 |
| EP | 0411682 | A1 | 2/1991 |
| EP | 0509934 | A1 | 10/1992 |
| EP | 0580926 | A1 | 2/1994 |
| EP | 0649716 | A1 | 4/1995 |
| EP | 0981672 | B1 | 3/2000 |
| EP | 0833987 | B1 | 1/2001 |
| EP | 1788157 | A2 | 5/2007 |
| EP | 1803853 | A1 | 7/2007 |
| EP | 1847650 | A2 | 10/2007 |
| EP | 1983111 | A1 | 10/2008 |
| EP | 2647765 | A1 | 10/2013 |
| FR | 2594864 | A1 | 8/1987 |
| FR | 2708946 | A1 | 2/1995 |
| GB | 1137861 | A | 12/1968 |
| GB | 1481186 | A | 7/1977 |
| GB | 1590325 | | 5/1981 |
| GB | 2315803 | A | 2/1998 |
| GB | 2325262 | A | 11/1998 |
| IT | 1150926 | B | 12/1986 |
| IT | UD 920082 | B | 3/1996 |
| IT | UD 930212 | B | 6/1996 |
| JP | H10245843 | A | 9/1998 |
| JP | 2006070608 | A | 3/2006 |
| RU | 2288323 | A | 10/2006 |

OTHER PUBLICATIONS

Coupland, Channel Tunnel Rail Link-Contract 220 Graham Road Deep Vent Shaft. Proceed Internl Conf Case Histories Geotech Engineer. New York, NY. Apr. 13-17, 2004;paper 5.47:4 pages.

Nicolson, Diaphragm Walls. Downloaded from web Jun. 23, 2011 http://www.nicholsonconstruction.com/techResources/datasheets/PDF/DiaphragmWall_Tech_Web.pdf : 1 page.

Richards and Nicholson, Diaphragm Walls. 21st Central PA Geotechnical Conference—Mar. 23-25, 2005. Presented Mar. 23-25, 2006:18 pages.

* cited by examiner

FIG. 3Aii
FIG. 3Aiii
FIG. 3Aiv

FIG. 3Avi
FIG. 3Avii
FIG. 3Aviii
Stage 1
Stage 2
Stage 3
Stage 4
Stage 5
X
D
L
40
42
44
48
32
50
54
46
24
52
28
11
12
18
34
36
38

Stage 6

FIG. 3Bii

Stage 7

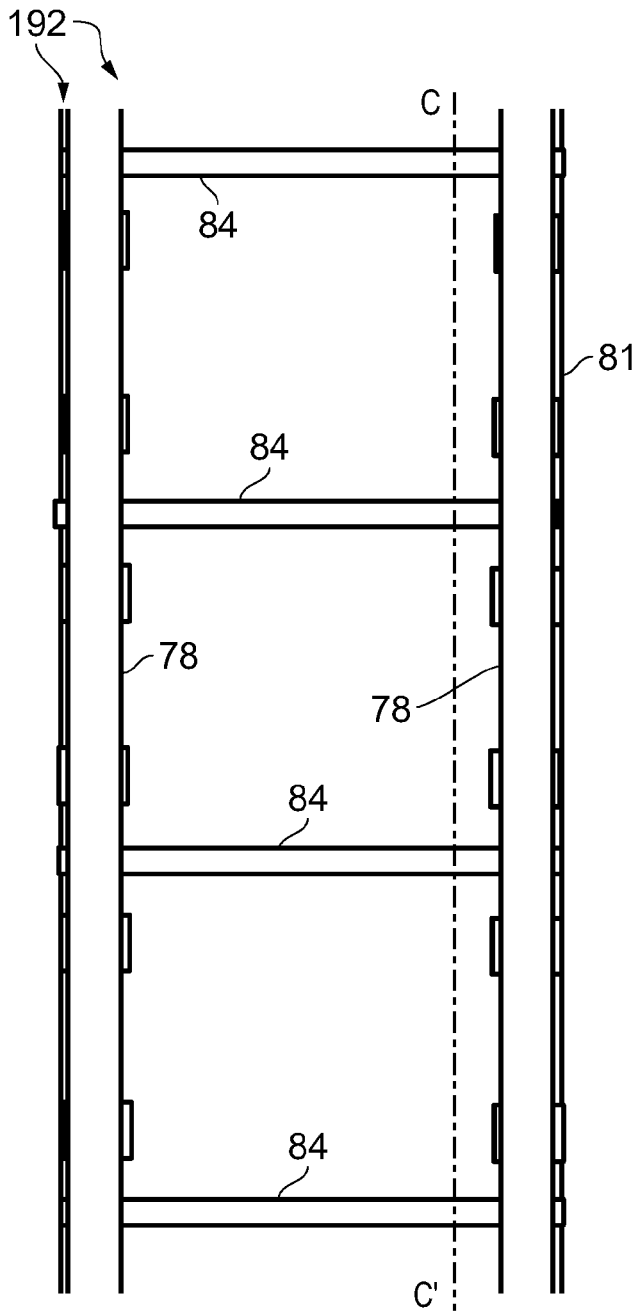
FIG. 10Di
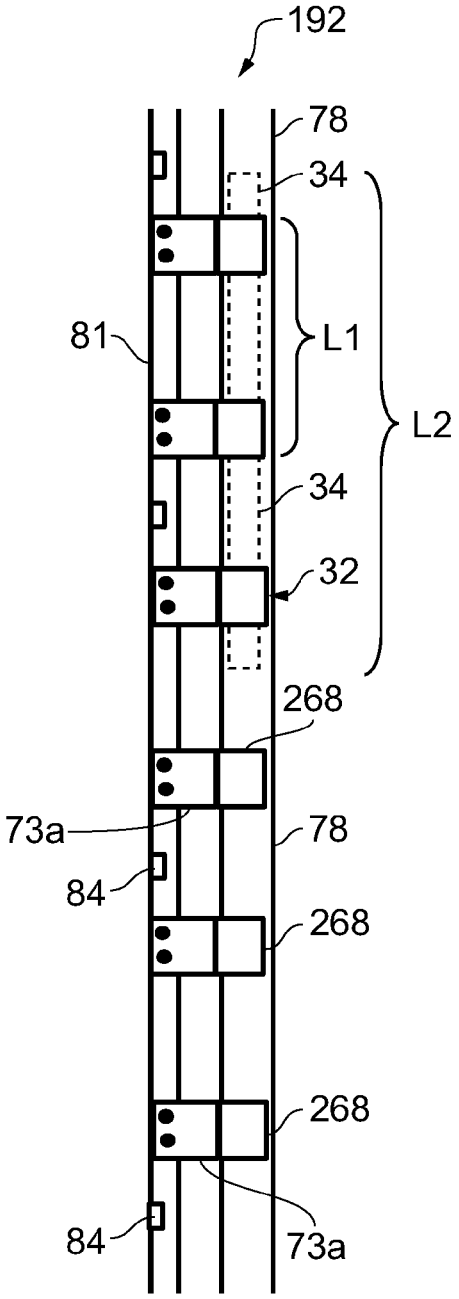
FIG. 10Dii

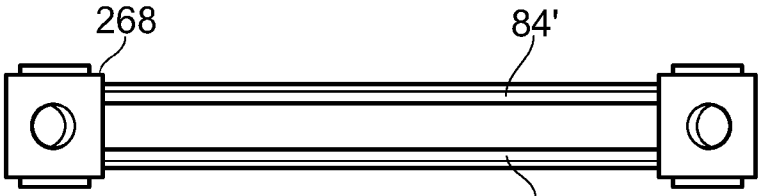
FIG. 10Ii
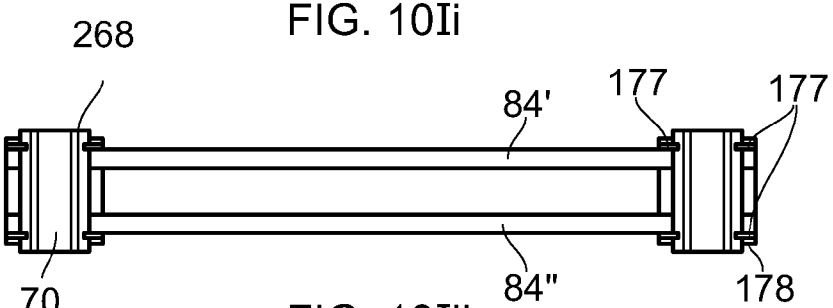
FIG. 10Iii
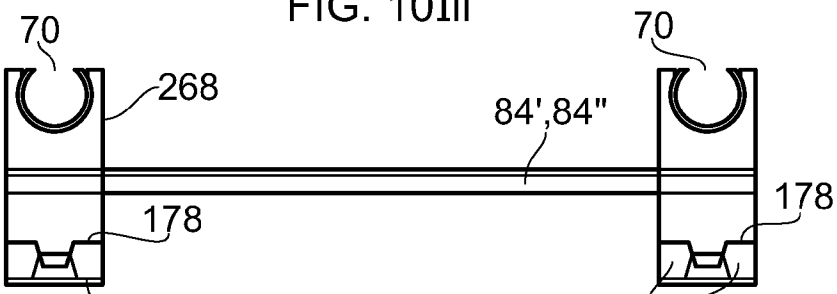
FIG. 10Iiii
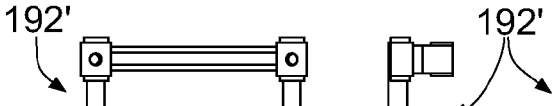
FIG. 10Hi
FIG. 10Hii
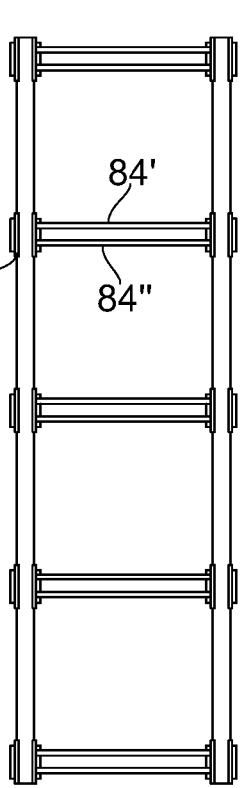
FIG. 10Hiii

SIDE ELEVATION

SECTION B-B

SECTION A-A

SECTION C-C

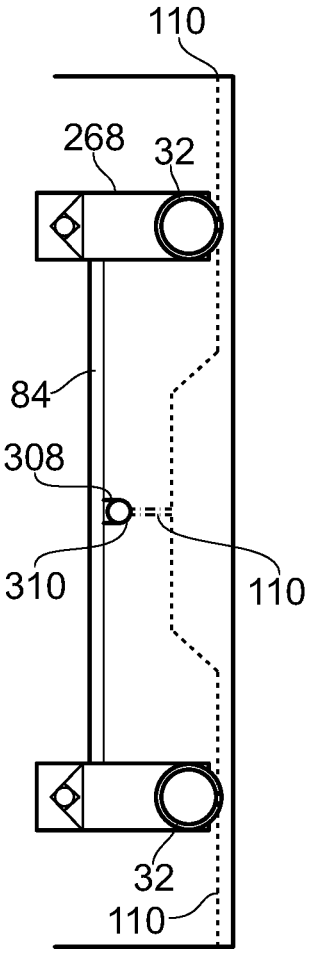
FIG. 16Ci
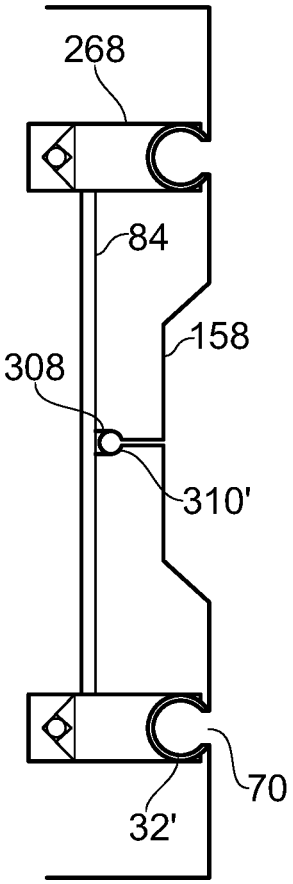
FIG. 16Cii
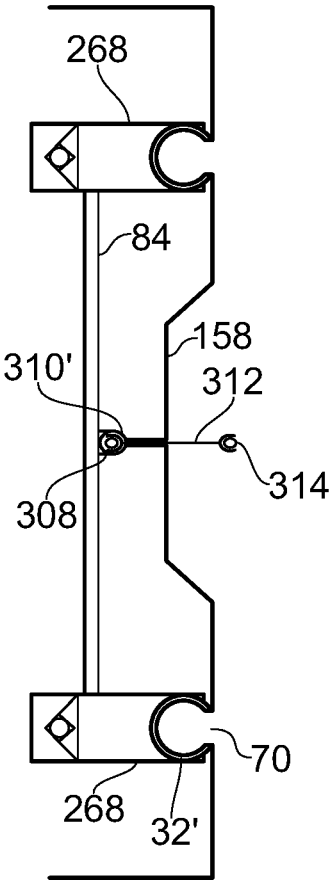
FIG. 16Ciii

FIG. 21iii

SECTION A - A

FIG. 27iii

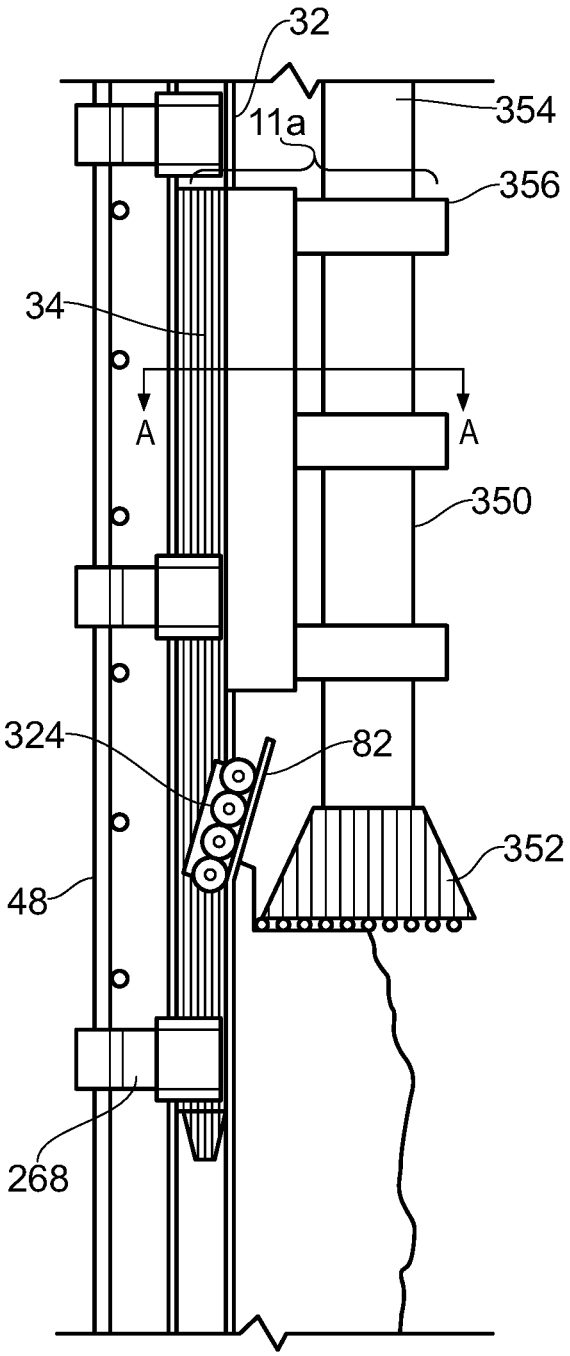
FIG. 29Ai
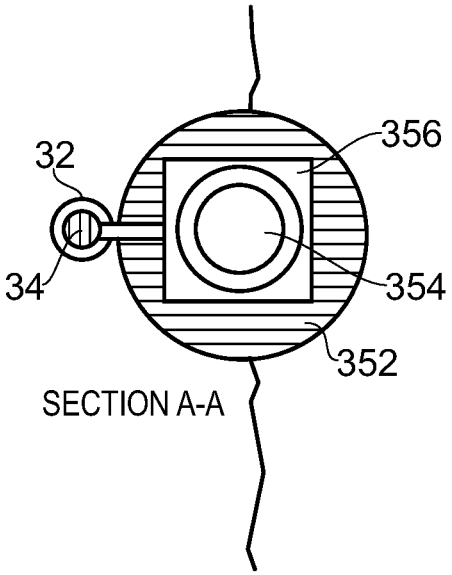
FIG. 29Aii

FIG. 29Biii

FIG. 29Bii

DIAPHRAGM WALL APPARATUS AND METHODS

FIELD OF THE INVENTION

The invention relates to apparatus and methods for constructing walls, in particular concrete embedded retaining walls such as diaphragm walls, comprising one or more panels, and walls so constructed. In particular the invention relates to apparatus, methods and walls, in particular concrete embedded retaining walls such as diaphragm walls, having a guideway. The invention also relates to apparatus and methods for constructing other walls such as contiguous pile walls and secant walls and the walls so constructed. Thus, the invention also relates to apparatus and methods for connecting panels in the form of bored piles; and for connecting panels in the form of bored piles to panels in the form of planar walls. The invention also relates to a wall, such as a diaphragm wall, having a tension connection between neighbouring panels and a kit for forming a tension connection between panels.

BACKGROUND

Concrete embedded retaining walls such as diaphragm walls, known as slurry walls in the USA, have been part of foundation construction for sixty years. Forming the joint between successive panels has always been one of the most difficult and time consuming elements of the process. Existing construction methods of forming joints involves using and then removing stop-ends. Pre cast stop-ends have been used occasionally.

In the early days of diaphragm wall construction the individual panels were dug with grabs with rounded clams so steel pipes, the same diameter as the thickness of the wall, were placed at the ends of the panels and extracted after concreting leaving a round hole filled with slurry. The hole helped guide the grab digging the adjacent panel and the system provided a semi-circular concrete construction joint between adjacent panels.

As diaphragm walls became thicker and deeper so the steel pipes became bigger, longer and heavier requiring jointing systems to connect individual sections and jacking equipment to extract the pipe from the ground. As the depth of diaphragm walls increased, so the timing of this extraction process became more critical. Too soon and the unset concrete collapsed into the void, too late and the pipe became stuck fast into the hardening concrete. Great skill and experience was required to manage the process and diaphragm wall projects routinely worked late into the night.

As the use of diaphragm walls became more widespread, alternative shapes of joint formers came into use. The round ended digging grabs gave way to the more efficient square ended variety. Companies started using a joint former which was shaped like a rectangle with an equilateral triangle on the concrete face. On occasion "Organ Pipe" joint formers were used. Both of these shapes were easier to extract than the earlier circular formers.

Towards the end of the 1980s and into the early 1990s two developments changed how diaphragm wall panel joints were formed. One of the developments was the "Hydrofraise" now more commonly known as a "hydro-mill" or cutter. The cutting/milling wheels on this machine can cut into concrete if there is equal resistance to the wheels on both sides of the machine during the progress of the excavation. If the machine is cutting equally into the concrete at their ends of two already constructed panels then a straight construction joint between the newly excavated panel and the already concreted panels on each side of it can be formed. The degree of panel to panel contact is determined by the excavation verticality that can be achieved. This joint system is now predominantly used in deep circular shafts where the walls are working in hoop stress so the joints are in compression making water leaks less likely and making shear keys unnecessary.

Two other examples of embedded concrete retaining walls are secant pile walls and contiguous pile walls. Secant pile walls have a row of bored piles, primary piles, installed with spaces between each pile. Another row of bored piles, secondary piles, is inserted into the spaces between the first row of piles however the spaces are smaller than the diameter of the secondary piles so a cut is made into the concrete of the piles on either side thus forming a continuous wall. A contiguous pile wall is a single row of piles with a small (usually less than 500 mm) space between them and is used as a retaining wall system where it is not necessary to hold back groundwater. These wall systems are generally used to depths of about 25 m because deviation from the vertical during installation can result in gaps between secant piles and unacceptable large spaces between contiguous piles. Secant pile walls are sometimes used to form circular shafts but as a minimum width concrete to concrete contact, between primary and secondary piles, is required to develop the hoop stress required by the design then any vertical deviation of individual piles is likely to become unacceptable at relatively shallow depths. For this reason secant pile shafts are usually no more than 10 m to 15 m deep. Secant pile walls, for example to form a shaft, typically have a row of bored piles installed with spaces between each pile. Another row of bored piles is inserted into the spaces between the first row of piles however the spaces are smaller than the diameter of the piles so a cut is made into the concrete of the piles on either side thus forming a continuous wall. A contiguous pile wall is just a row of piles with a small (usually less than 500 mm) space between them and is used as a retaining wall system where there is no problem with ground water. Accurate positioning of the piles in these systems can be time consuming and difficult to achieve.

Hydro-mills have great difficulty cutting into concrete at only one end of a trench. The differing resistance to excavation progress at one end of the trench, compared to the other end, is difficult to manage and leads to unacceptable deviations in the verticality of the excavation.

The other development was the system known as CWS or continuous water stop joints. In this system an end former, being steel plate with a steel trapezoid shape on one face, is supported from the guide wall with the flat side against the soil at the ends of the panel excavation. In the middle of the trapezoid a fabricated clamp arrangement holds a rubber water bar half of which is concealed in the end former. The protruding half of the water bar is then cast into the concrete. The joint former is later peeled away from the concrete during and after excavation of the adjacent panel leaving a shear key formed by the trapezoid shape with half the dumbbell water bar protruding out ready to be cast into the concrete of this next panel. This system had several major advantages over the earlier extraction systems:

- No late working and overtime to extract the joint
- Better water tightness because of the rubber water bar that can now be introduced into the joint.
- Complete panel to panel connection. Not always the case with the extraction systems where grab operator experience and competence was also a major factor.
- Simpler to use and less risk therefore requiring less experienced and less skilled personnel.

The system was initially tried on relatively shallow 20 m to 25 m deep diaphragm walls. By the mid 90's wall depths of 30 m to 40 m were using the system although now problems started to arise. Sometimes the former was difficult to peel off taking hours and in some cases days. A few formers broke with portions left behind in the joint. It became clear that if the former was slightly buckled or distorted in any way or if it was not correctly positioned and suspended or if the excavation was out of position/verticality then the wedges, grabs and/or chisels used to remove it would become less efficient (e.g. due to jamming in the excavated panel).

The problems worsened with the recent switch from rope grabs to hydraulic grabs that has occurred over the last twenty years. While there is no doubt that the modern steerable hydraulic grab digs faster and more accurately than the old rope grabs, the weight, lack of free fall capability, hydraulic connections etc. do not allow the equipment to be used as an effective chiselling tool which is really what is required to peel off a CWS former.

With special precautions the system has been used to depths in excess of 50 m but the skill and experience required to do this is not easily found and even if possessed cannot always be present. Delays in or failure to remove the former can have major cost and programme implications for a project.

For the reasons stated in the previous paragraph on projects where the diaphragm wall has been over 35 m deep, and the panels have either been excavated with grabs or with hydromills but without overcut joints, precast concrete "stop-ends" have been used. This does reduce risk but at some cost penalty partly from the manufacture and transport of the precast concrete sections and partly because their weight may require additional or larger cranes on site to lift and place the units. In one sense precast concrete "stop ends" are a retrograde step. This is because double the number of joints in any wall increases the risk of leakage and the nature of the stop end construction does not lend itself to effective incorporation of water bars further compromising water tightness. There is also greater potential for misaligned panel connections because of the difficulty of incorporating an effective grab guide in the relatively thin precast concrete section. Despite the obvious disadvantages of using precast concrete stop ends, companies have opted for their use on recent projects because of the risk associated with the use of the CWS system at depths over 35 m to 40 m.

Modern hydraulic diaphragm wall grabs are capable of digging to depths of over 60 m with a high degree of positional accuracy. Diaphragm wall panel jointing systems have not kept pace with the development of the grabs. As depths increase above 30 m so reluctance by contractors to use the CWS system increases. The alternative of using precast concrete stop ends is costly and technically inferior.

Prior art excavator grabs or mills are used to excavate the trench and will typically exert a digging or cutting force (and therefore encounter balancing resistance) on the digging teeth at both ends at once of the grab bucket halves, or on the cutting teeth on the surface of the two opposing cutting wheels of the hydro-mill (typically exerting equal cutting force on both sides of the grab bucket halves, or opposing cutting wheels). Thus, as the excavation proceeds, the excavating grab or mill does not veer off to or away from a cutting face due to less or more resistance being encountered on the other side of it. Unless the grab or mill is excavating the same material at each side, the excavating grab or mill will veer off away from the harder cutting side due to less resistance being encountered on the other.

FR2594864 ROCHMANN describes a method of casting a wall in the ground using a profile.

U.S. Pat. No. 4,582,453 RESSI describes in situ forming of underground panel walls with improved joint structure.U.S. Pat. No. 4,930,940 and EP0333577 SONDAGES describe a guiding system for constructing a wall cast in the ground. Wheels are used to clear concrete from the guide member.

EP0101350 SONDAGES describes a procedure and mechanism for withdrawal of a shuttering mechanism used to prepare an end face of concrete panel.

EP0649716A CASAGRANDE describes a cutter for forming diaphragm joints having a cutting assembly and a thrust and guide assembly.

U.S. Pat. No. 4,838,980, DE3430789, U.S. Pat. No. 4,990,210 GLASER describes a method and apparatus for introducing and joining diaphragms in slotted walls in which the interior of connecting pipes are rinsed free of support fluid. DE 3503542 GLASER describes a link for panels.

GB2325262 KVAERNER describes a hydrophilic waterbar for diaphragm wall joints.

EP0411682 VERSTRATEN describes a retention wall and procedure for making a liquid tight wall in the ground.

EP0580926 MIATELLO RODIO describes a sealing joint in a diaphragm formed by concrete panels. An inner core is extracted from a joint member following removal of a guide tube end stop.

U.S. Pat. No. 5,056,242 MIOTTI describes an underground wall construction method and apparatus.

U.S. Pat. No. 5,263,798 DUPEUBLE describes a process for guiding the excavation tool used for the construction of a wall cast in the ground and an excavation tool for implementing this process.

EPO402247 SOLETANCHE and U.S. Pat. No. 5,056,959 CANNAC describe a grab apparatus with a projection that engages with a joint.

U.S. Pat. No. 6,276,106 KVAERNER describes a hydrophilic waterbar for diaphragm wall joints.

U.S. Pat. No. 6,052,963 LEFORT describes formwork for a diaphragm wall having first and second locking elements.

U.S. Pat. No. 3,422,627 COURTE describes an early method of interconnecting cast panels in the ground.

US2002/0119013 SHOTTON describes a waterstop for foundation elements.

CN101560767 LIXIN TAN describes a method of connecting slotted sections.

GB1590325 COMAR REG TRUST describes a metal shuttering member in the form of a prism of generally rectangular section.

FR2708946 SPIE describes a watertight joint between two panels.

U.S. Pat. No. 4,367,057 HUGHES describes drilling a bore between adjacent-sections.

CN101858090 describes soft connection of diaphragm wall joints using rigid joint flexible filler.

The prior art above does not address many of the problems outlined above. The present invention seeks to alleviate one or more of the above problems

STATEMENTS OF THE INVENTION

In a first aspect of the invention there is provided an apparatus for constructing a concrete embedded retaining wall such as a diaphragm wall.

In a second aspect of the invention there is provided a method of constructing a concrete embedded retaining wall such as a diaphragm wall.

In a third aspect of the invention there is provided a concrete embedded retaining wall such as a diaphragm wall comprising at least two or a series of concrete panels adjoining one another.

In a fourth aspect a kit for forming a tension joint is provided.

Several embodiments of the invention are described and any one or more features of any one or more embodiments may be used in any one or more aspects of the invention as described above or elsewhere herein.

In a first aspect of the invention there is further provided an apparatus for constructing a concrete embedded retaining wall such as a diaphragm wall comprising: a guideway tube along a height of a first wall of a first concrete panel; the guideway tube comprising a sacrificial wall element that extends along the tube and about a portion of a periphery of the tube; at least one cutting mechanism for cutting along the height of a first wall of the first concrete panel, the cutting mechanism being arranged to cut along the height of the wall of the first concrete panel and along the sacrificial wall element of the guideway tube so as to cut away at least part of the sacrificial wall element of the guideway tube along at least part of the height of the first wall.

A cutaway portion of the sacrificial wall element may be completely removed or may be cut open so that the guideway tube is open. Typically, the guideway is a hollow watertight tube prior to being cut.

The cutting mechanism may be arranged to so as to cut away at least part of a first wall of a concrete panel across its width along at least part of the height of the first wall and so as to cut away at least part of the sacrificial wall element of the guideway tube across its width along at least part of the height of the first wall.

The sacrificial wall element may be continuous with at least part of the remaining wall of the guideway tube prior to being cut away. The sacrificial wall element may form part of the wall of the guideway tube prior to being cut. Indeed, the sacrificial wall element may be an integral part of the wall of the guideway tube prior to being cut.

The cutting mechanism may comprise a first cutting element for cutting the concrete along the height of the wall of the first concrete panel and a second cutting element for cutting the sacrificial wall element along the sacrificial wall element of the guideway tube so as to cut away at least part of the sacrificial wall element of the guideway tube along at least part of the height of the first wall.

The guideway tube may be continuous about part or all of its periphery prior to the sacrificial wall element being cut away. The guideway tube may be of a smoothly varying cross-section. The guideway tube may be of a substantially circular cross-section.

The apparatus may comprise a cutting mechanism which is driven. The cutting mechanism comprises a first cutting element which may be located external to the guideway tube at least prior to commencing cutting. The cutting mechanism may comprise a milling wheel and/or teeth, such as bullet teeth for example, and/or a saw blade having saw blade teeth and/or the cutting mechanism comprises a drill. The apparatus may comprise a cutting mechanism which is passive. The cutting mechanism may comprises a second cutting element which may be located internal to the guideway tube at least prior to commencing cutting. The cutting mechanism may comprises at least one rotatable cutting wheel. The apparatus may have a plurality of cutting wheels provided in a row. The row of cutting wheels may have each succeeding cutting wheel in the row at a greater distance from the first wall of the first concrete panel. The lowest wheel may be the closest to the first wall of the first concrete panel. The at least one rotatable cutting wheel may be circular (for example, it may have a smoothly varying cutting profile of circular cross-section).

The apparatus may comprise first and second cutting elements. The first and second cutting elements may be laterally spaced (in use). The first and second cutting elements may be vertically spaced (in use) and/or may comprise at least one driven cutting element and at least one passive cutting element. The or at least one cutting mechanism may comprise at least one of a saw tooth blade and/or at least one cutting wheel comprising bullet teeth and/or at least one freely rotatable cutting wheel. The apparatus may comprise both an internal cutting mechanism and an external cutting mechanism which cut respectively internal or external to the guideway.

The first wall may be an end wall or a side wall of a first concrete panel.

The guideway tube may comprise a first tube having an aperture along its length and sacrificial material closing the aperture to form the sacrificial wall element.

The first tube may comprise steel or other suitably robust material. The first tube may comprise a series of discrete first tube portions spaced along at least part of the height of the first wall.

The sacrificial material may seal the aperture so as to substantially prevent ingress of slurry and/or concrete into the guideway tube until the sacrificial material is cut.

A second tube of sacrificial material closing the aperture may be provided. The second tube may substantially surrounds, or may be surrounded by, the first tube.

The first and second tubes may be coincident along their respective central longitudinal axes.

A portion of, or substantially the whole, of the periphery of an innermost surface of the outermost tube may be contiguous with a portion of, or substantially the whole of, the periphery of an outermost surface of the innermost tube.

The contiguous portions of the innermost and outmost tubes may form a seal to substantially prevent ingress of concrete during pouring of concrete for the second panel.

The cutting mechanism may comprise at least one guide for engaging with the guideway tube so as to guide the cutting mechanism as it cuts along the first wall and along the sacrificial element.

The at least one guide may be anchored in the guideway tube so as to resist lateral movement of the cutting mechanism away from the wall during cutting. At least two guides may be provided and at least two of these guides may be laterally and/or horizontally spaced from one another (in use) and/or at least two guides may be provided and at least one guide may be fixedly connected to the cutting mechanism and at least one guide may be hingedly connected to the cutting mechanism.

The guideway tube may comprise one or preferably two opposing depending wall sections either side of the sacrificial wall element so as to resist lateral movement of the cutting mechanism away from the wall during cutting.

The angular extent of the sacrificial wall element about a portion of the periphery of the guideway tube may be selected so as to enable the remaining tube, after the sacrificial wall element is cut away, to anchor the cutting mechanism to the guideway tube and to resist lateral motion of the cutting mechanism away from the first side wall of the first panel.

The angular extent of the sacrificial wall element about a portion of the periphery of the guideway tube may be 90°, may be less than 90°, may be 60° or may be less than 60°.

The sacrificial wall element may be, for example, in the range of 40-150 mm wide, or may be 50 mm wide, or may be 100 mm wide. Example tolerances for this dimension may be ±10 mm.

The guide in the guideway tube may guide the cutting mechanism with respect to the first wall of the first panel so as to define a line of cut at a pre-determined position with respect to the guideway tube.

The guideway tube may be closed at its lower end.

A first panel and/or a second panel may be substantially rectangular in cross-section. At least one panel of substantially circular cross-section may be provided. A first panel and/or a third panel may be substantially rectangular in cross-section and a second intervening panel may be substantially circular in cross-section or a first and a third panel may be substantially circular in cross-section and a second intervening panel may be rectangular in cross section.

Two or more laterally separated guideway tubes may be provided along a height of a first wall of a first concrete panel.

Two or more laterally separated guideway tubes may be used to form a construction joint and/or a tension joint on filling of the guideway tube with the concrete of the second concrete panel.

The apparatus may comprise at least one protruding key element for interengaging with the guideway tube so as to connect the first and second panels together.

The apparatus may comprise a first reinforcement cage having the guideway tube attached to it and/or a second reinforcement cage having the at least one protruding key element attached to it.

The at least one protruding key element and the guideway tube may form a tension joint, the at least one protruding key element sized and/or shaped with respect to the guideway tube to form an anchor to resist lateral extraction from the guideway tube.

The at least one protruding key element may comprise a conical shaped protruding member or a truncated cone shaped protruding member, the conical surface of which is arranged to resist extraction from the guideway tube.

The at least one protruding key element may comprise a positioning member for locating the protruding key element centrally within or to the rear of the guideway tube relative to the sacrificial wall element.

The positioning member may comprise a frame having at least one leg sized and shaped to arrange for locating the protruding key element centrally within or to the rear of the guideway tube relative to the sacrificial wall element. The positioning member may comprise a frame having at least two, three or four legs sized and shaped to arrange for locating the protruding key element centrally within or to the rear of the guideway tube relative to the sacrificial wall element. The legs may be equally angularly spaced about a centre of the positioning element. The legs may be located along radii of a circle. The legs may have a curved outer portion for engaging with an innermost surface of an inner wall of the guideway tube. The positioning member may comprise a hoop element for passing a tensioning bar member of a reinforcement cage therethrough.

The water impeding element joint may comprise a cutaway supplementary tube of the same or different sacrificial material and a water impeding element is located in the cutaway supplementary tube and extends into a second trench for providing a water bar between the first and second panels.

In a second aspect a method may be provided comprising (a) casting a guideway tube into a first concrete panel along a height of a first wall of the panel; (b) cutting along the height of the first wall of the panel; (c) cutting along at least part of the length of the sacrificial wall element of the guideway tube; (d) pouring a second concrete panel, so that concrete enters into the cut guideway tube.

Steps (b) and (c) may occur substantially at the same time and/or steps (b) and (c) may occur through the same cutting mechanism and/or action.

The method may comprise excavating a second panel trench and filling it with slurry.

The method may comprise filling the second trench with slurry so that slurry enters into the cutaway guideway tube.

The method may comprise filling the cutaway guideway tube with with slurry and this step occurs as a result of cutting away the sacrificial element of the guideway tube, any intervening concrete and any remaining soil column between the first concrete panel and a second panel trench filled with slurry along at least part of the height of the first wall.

The method step of casting a guideway tube in a first concrete panel may comprise lowering a guideway tube into a first panel trench. The first panel trench may contain slurry during the step of lowering.

The guideway tube may be closed at its lower end and the method further may comprise filling the guideway tube with liquid as it is lowered.

The liquid may be slurry.

The method may comprise forming a construction joint between two adjacent concrete panels, the step of forming comprising steps (a), (b), (c), and (d).

The first and second panels may be at an angle to one another.

The first and second panels may be tangents to a curve and a line of cut for cutting steps (b) and (c) lies along a radius of the curve.

The method may comprise constructing a diaphragm shaft.

One or more or all or alternate panels in the shaft lie along tangents to a circle and one or more or all or alternate lines of cut for steps (b) and (c) lie along respective radii of the circle.

The method may comprise forming a tension joint by providing a protruding key element in a second panel for engaging with the guideway tube cast in the first panel.

The protruding key element may be lowered into the guideway tube as or after the guideway tube may be filled with slurry.

A guideway tube may be cast in the concrete of the second panel, or a further panel, along a height of a first wall of the second panel, or of a further panel, and the method may comprise steps (a) to (d) for the second or further panel.

The first wall and/or second wall may be end walls and/or side walls of a generally rectangular concrete panel.

The one or more of a first wall and/or second wall and/or further wall may be side walls of a generally circular concrete panel.

The method may comprise cutting a supplementary tube of sacrificial material and any concrete in front of the supplementary tube along at least part of a height of the first wall, and installing a water impeding element in the supplementary tube.

In a third aspect there is provided a concrete embedded retaining wall including but not limited to walls such as a diaphragm wall, a contiguous pile wall, a contiguous pile shaft, a secant pile wall, a secant pile shaft, comprising at least two or a series of concrete panels adjoining one another comprising: a guideway tube cast in concrete along a height of a first wall of a first concrete panel; a cutaway along the first wall of the first guideway tube forming an aperture into the guideway tube; a joint integral with a second concrete panel formed from concrete wholly or partially filling the guideway tube upon pouring of concrete to form the second concrete panel.

The wall may comprise at least two or a series of concrete panels adjoining one another comprising: a guideway tube comprising a sacrificial wall element, the guideway tube cast in concrete along a height of a first wall of a first concrete panel, a cut of the first concrete panel forming a cut end face along the height of the first concrete panel, and, a cutaway of at least part of the sacrificial wall element of the first guideway tube forming an aperture into the guideway tube along at least part of the height of the first wall of the first concrete panel, a joint integral with a second concrete panel formed from concrete wholly or partially filling the guideway tube upon pouring of concrete to form the second concrete panel.

The wall may comprise a cut end face of at least part of a first wall of a concrete panel across its width and along at least part its height and a cutaway of at least part of the sacrificial wall element of the guideway tube across its width along at least part of the height of the first wall.

A cut end face of at least part of a first wall of a concrete panel may be contiguous across its width with the cutaway across the width of a sacrificial wall element of the first guideway tube along at least part of the height of the first wall. The cut end face may be arranged so as to be formed over at least part of a first wall of a concrete panel across its width along at least part of the height of the first wall and the cutaway is arranged across at least part of a width and along part of the length of the sacrificial wall element of the guideway tube along at least part of the height of the first wall. For example, the cut end face may be continuous with the cutaway of the guideway tube lying on the same line of cut.

The wall may comprise at least one protruding key element for interengaging with the guideway tube so as to connect the first and second panels together.

The wall may comprise a first reinforcement cage having the guideway tube attached to it and/or a second reinforcement cage having the at least one protruding key element attached to it.

The at least one protruding key element and the guideway tube may form a tension joint.

The wall may comprise two or more panels or all panels of rectangular cross-section or may comprises at least one of panel of circular cross-section and at least one panel of rectangular cross-section or all panels of either rectangular or circular cross-section or may comprise all panels of circular cross-section.

A kit for a tension joint for a diaphragm wall may comprise at least one protruding key element. The kit may comprise a guideway tube, the at least one protruding key element capable of forming an anchor to resist extraction from the guideway tube so as to form a tension joint. The at least one protruding key element may have any of the features described herein. The at least one protruding key element may comprise a positioning member; the positioning member may have any of the features described herein. The kit may comprise at least one steel bracket for forming a second tube of a guideway tube. The kit may comprise a section having a threaded recess for welding to or welded to or for bolting to the steel bracket. The kit may comprise a first tube having a sacrificial wall element and/or comprising sacrificial wall material. The kit may comprise a water impeding element joint comprising a supplementary tube of the same or different sacrificial material.

In any aspect of the invention two or more laterally separated guideway tubes may be provided along a height of a first wall of a first concrete panel.

The two or more laterally separated guideway tubes may be used to form a construction joint and/or a tension joint on filling of the guideway tube with the concrete of the second concrete panel.

At least three laterally separated guideway tubes may be provided, at least two of which may be used to provide a construction joint and/or a tension joint with the second panel and at least one of which may be used to provide a water impeding element across the joint.

The water impeding element joint may be centrally located with respect to the at least two construction joints.

BRIEF DESCRIPTION OF THE INVENTION

The present invention will now be described, by way of example only, with reference to the following Figures. In the following description like reference numerals refer to like referenced features.

Figure 3A:
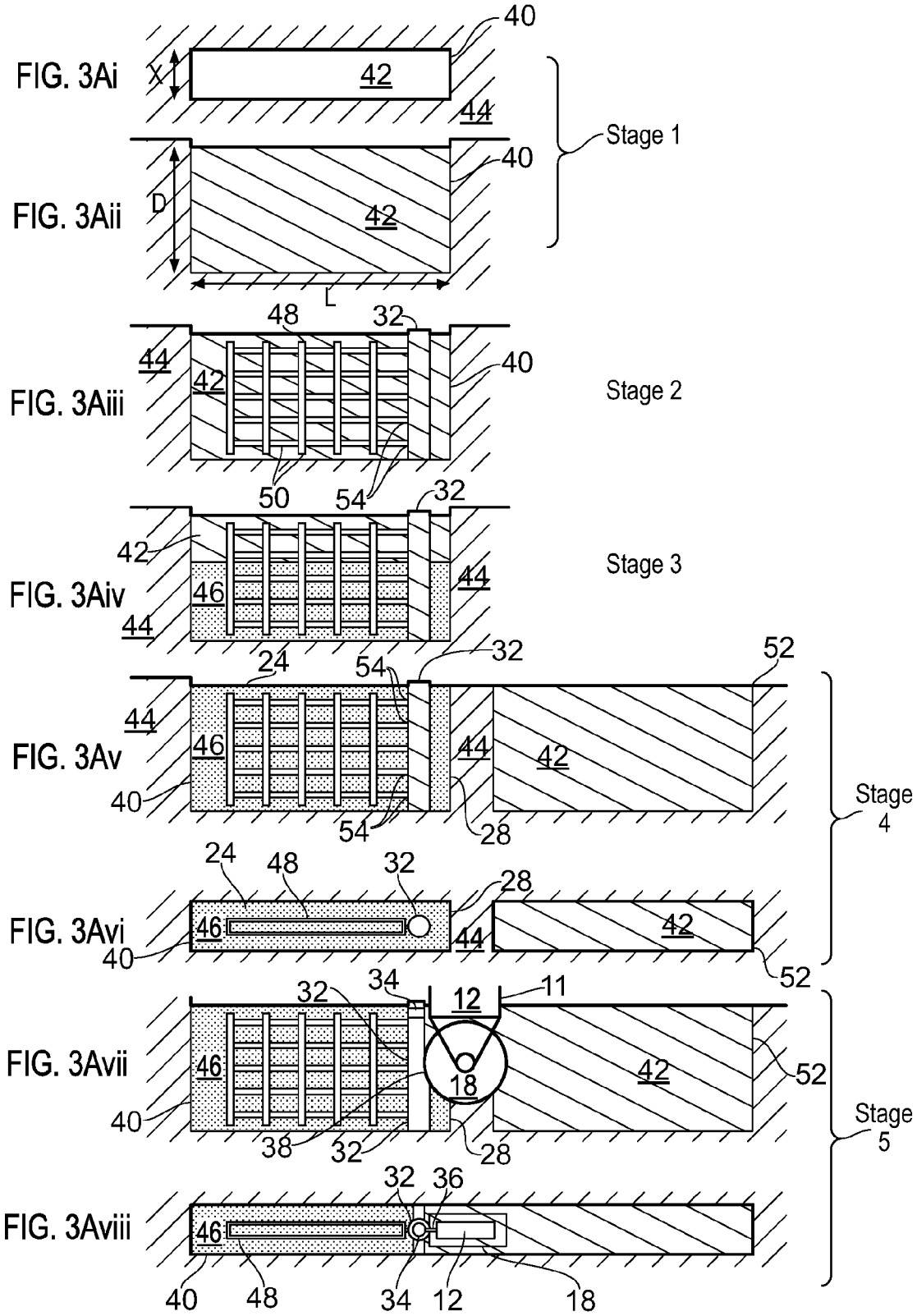

FIG. 3Ai is a plan view, FIG. 3Aii is a side view, FIG. 3Aiii is a side view, FIG. 3Aiv is a side view, FIG. 3Av is a side view, FIG. 3Avi is a plan view, FIG. 3Avii is a side view, FIG. 3Aviii is a plan view showing stages 1 to 5 of a method of installing a diaphragm wall according to a second embodiment of the invention.

Figure 3B:
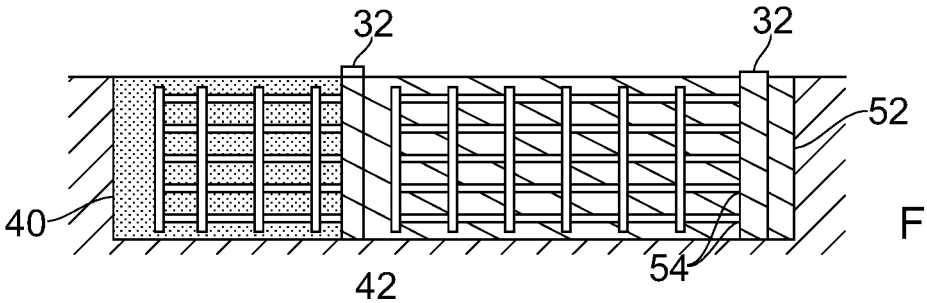

FIG. 3Bi is a side view and FIG. 3Bii is a side view showing optional stages 6 to 7 of a method of installing a diaphragm wall according to the second embodiment of the invention.

Figure 4:
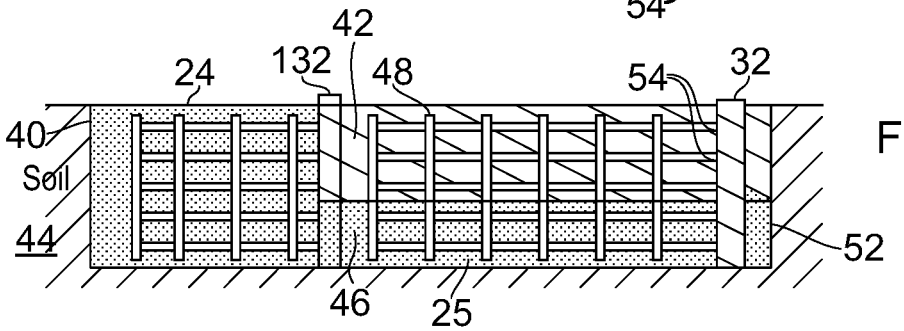
Figure 4:
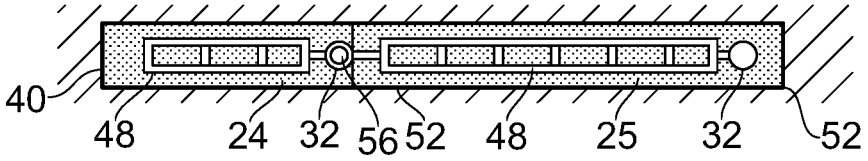

FIG. 4 shows a plan view of a diaphragm wall constructed according to the second embodiment of the invention.

Figure 5I:
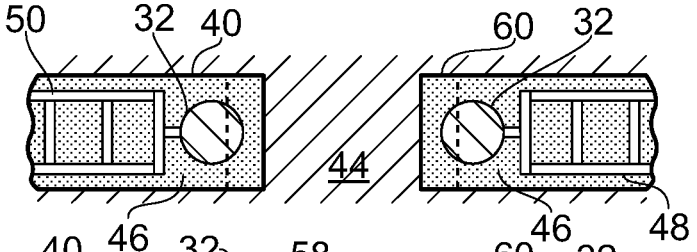
Figure 5I:
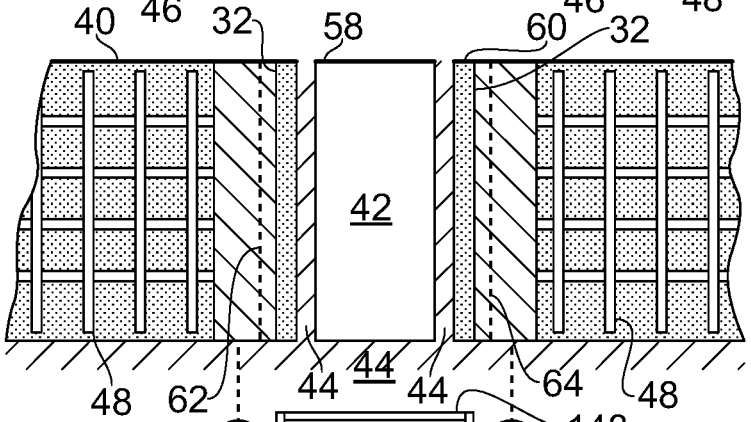

FIG. 5*i* is a plan view and FIG. 5*ii* is a side view of two adjacent panels illustrating a method of joining two such panels, such as first and final panels in a closed loop diaphragm wall according to a third embodiment of the invention.

Figure 6I:
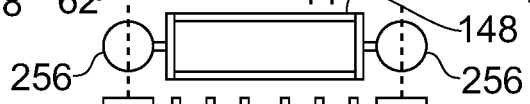
Figure 6I:
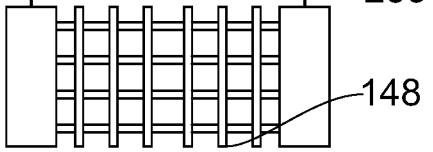

FIG. 6*i* is a plan view and FIG. 6*ii* is a side view of an example reinforcement cage having two keying elements one each at respective end thereof for use in the third embodiment of the invention according to a fourth embodiment of the invention.

Figure 7A:
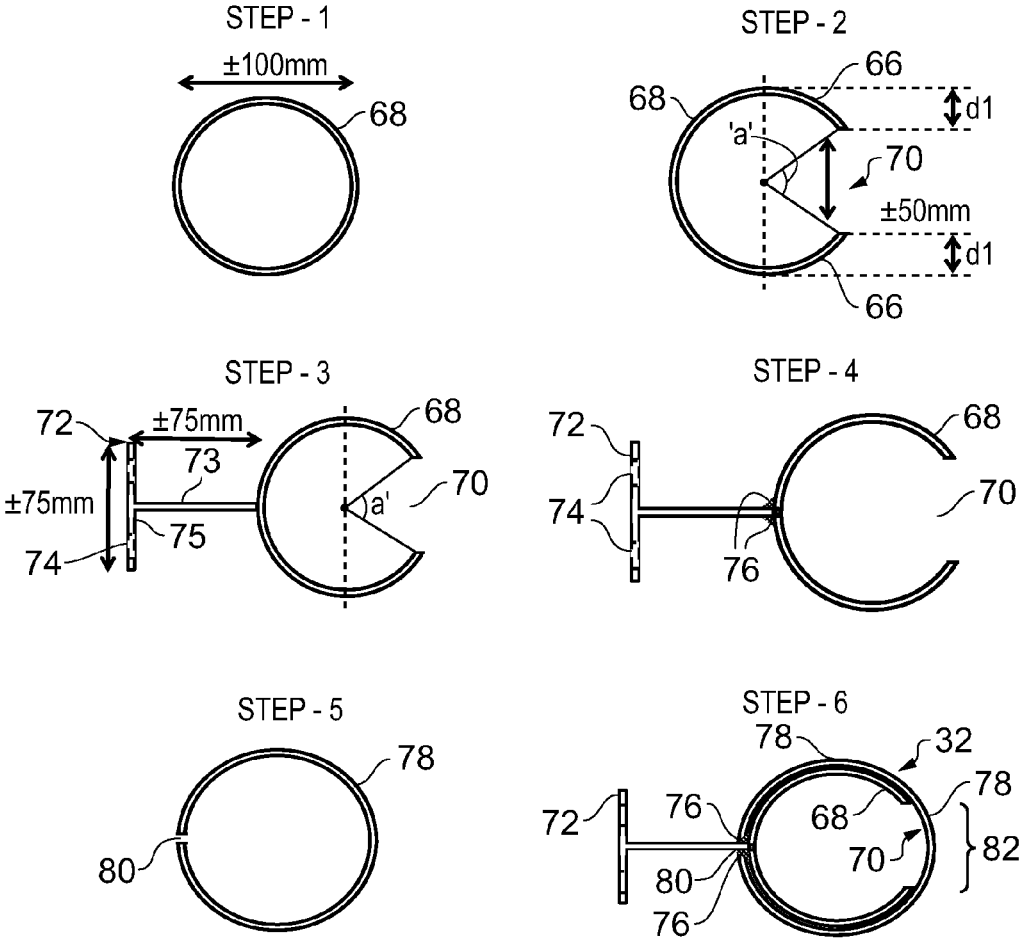

FIG. 7A shows plan views of components of a guideway tube and associated support illustrating its construction according to a fifth embodiment of the invention.

Figure 7B:
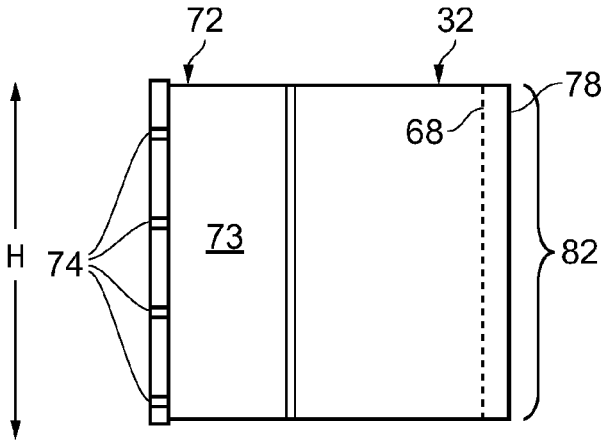

FIG. 7B shows a side elevation view of the guideway tube and support of FIG. 7A.

Figure 8:
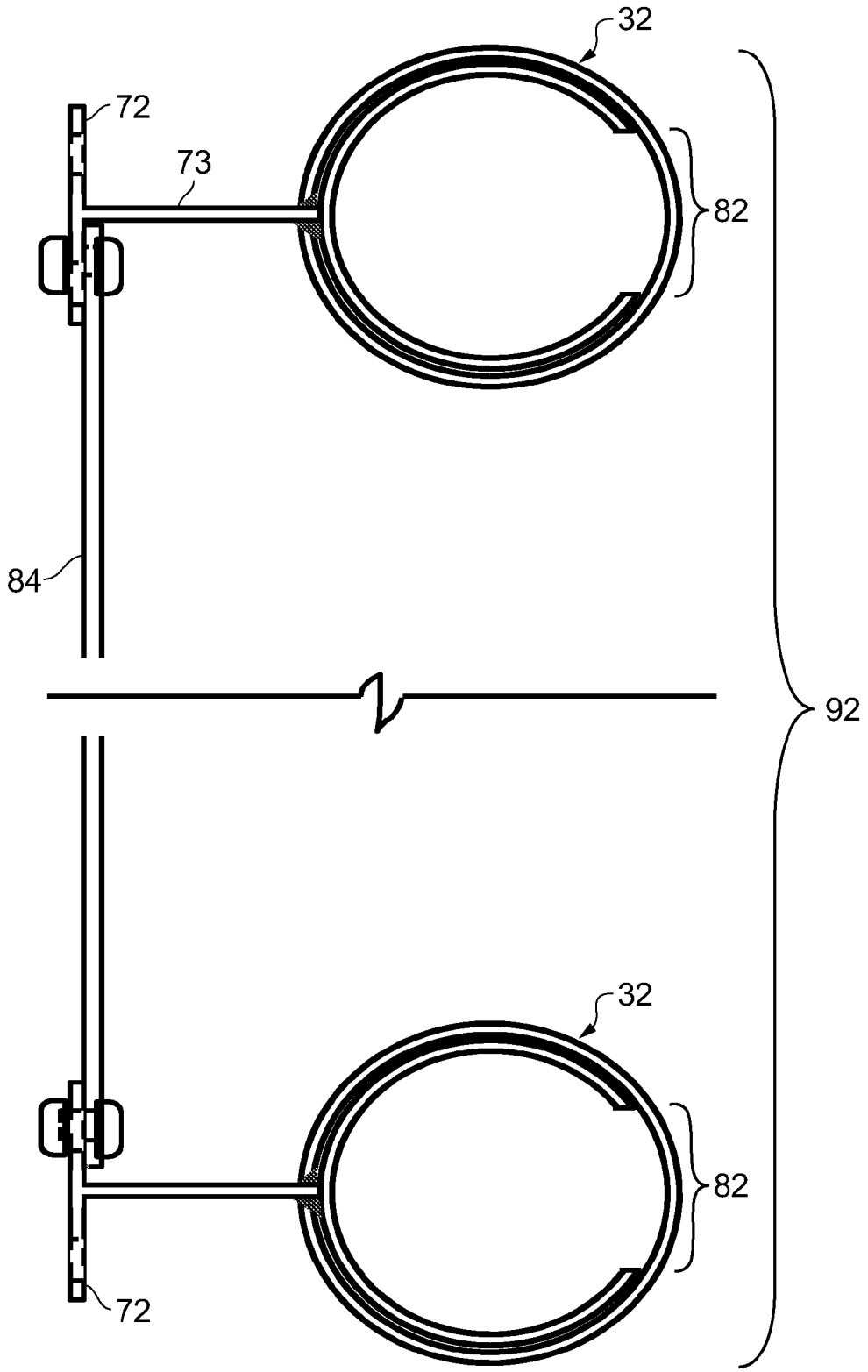

FIG. 8 shows a plan view of an example guideway tube assembly comprising two guideway tubes according to a sixth embodiment of the invention, for fixing along a height of a reinforcement cage to form a ladder assembly (or for forming as a ladder assembly prior to fixing to a reinforcement cage).

Figure 9:
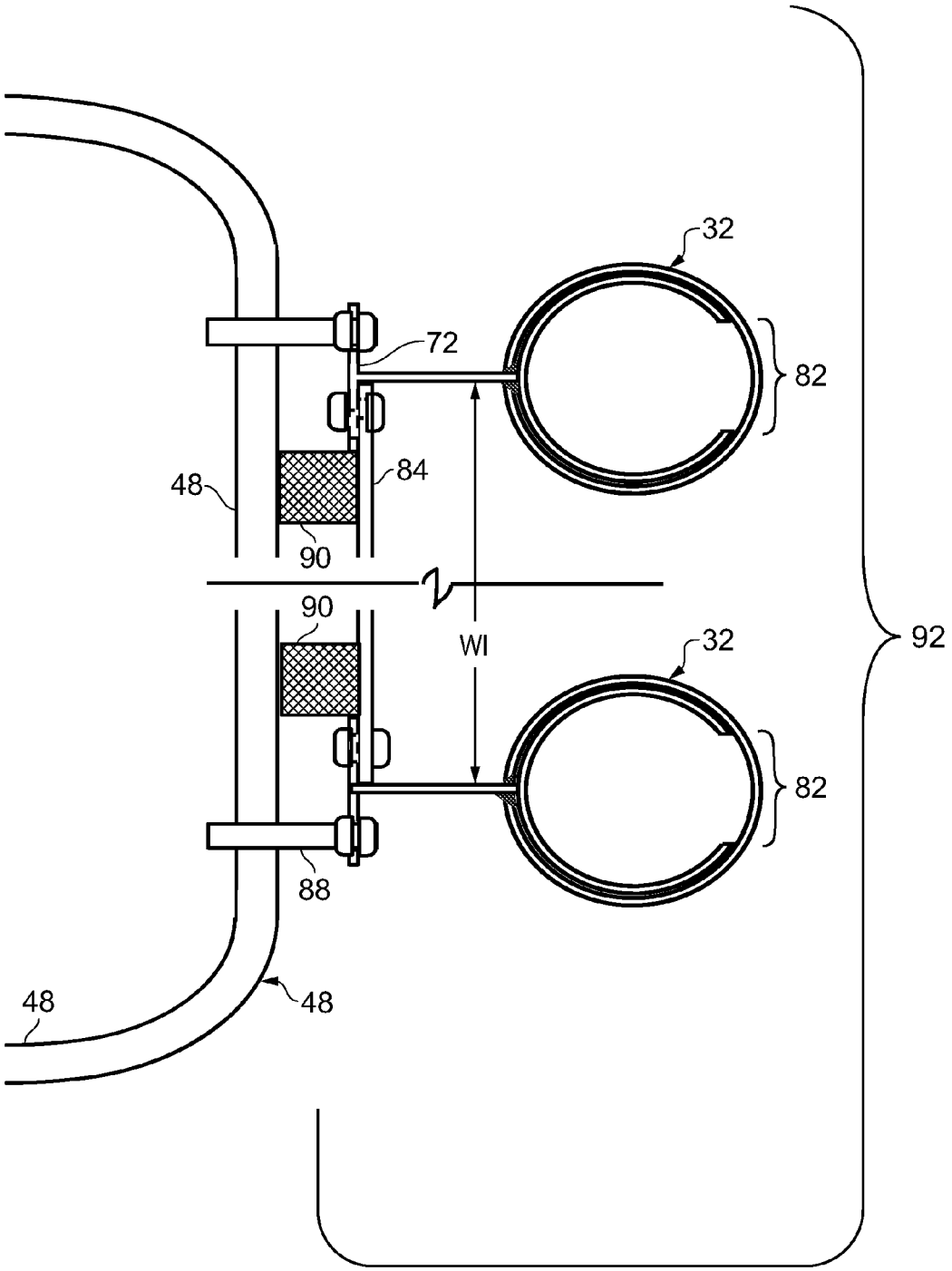

FIG. 9 shows a plan view of the guideway tube assembly of FIG. 8 fixed to a reinforcement cage.

Figure 10A:
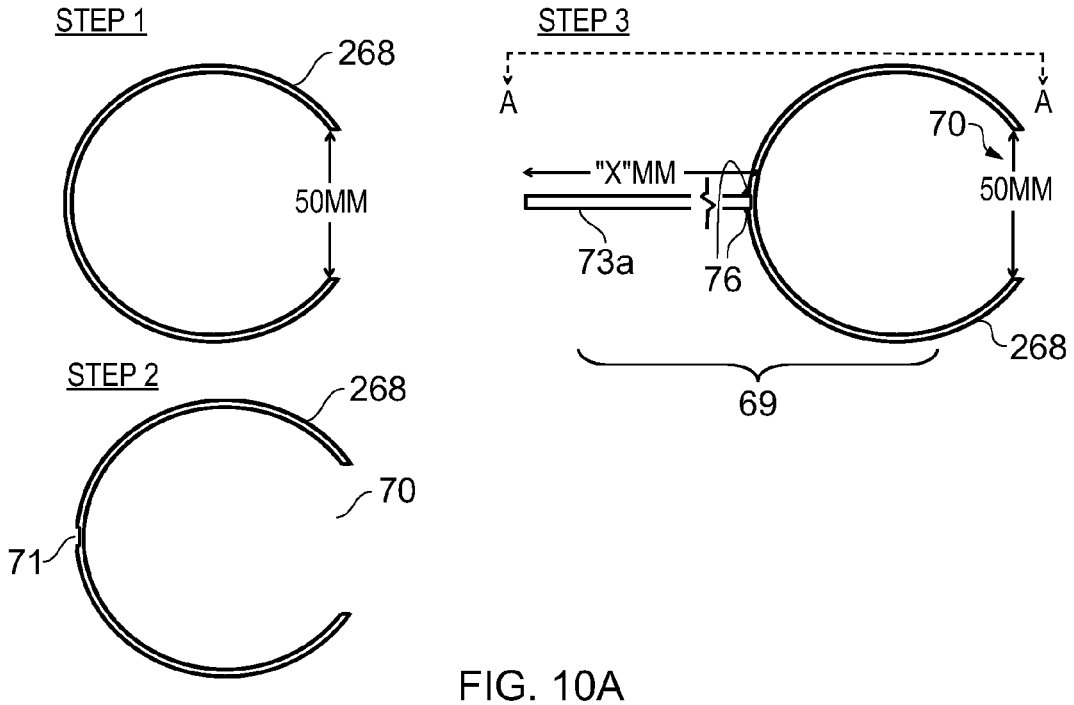

FIG. 10A shows plan views of a bracket for use in a guideway tube according to a seventh embodiment of the invention, particularly suitable for use when no tension connection between neighbouring concrete panels is required.

Figure 10B:
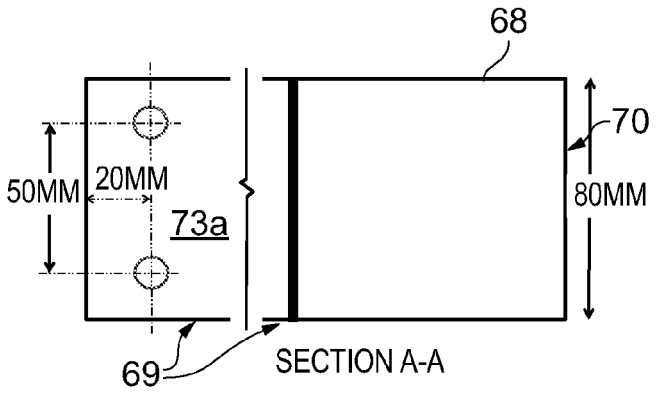

FIG. 10B shows a side view of the bracket of FIG. 10A.

FIG. 100 shows a perspective view of the bracket of FIGS. 10A and 10B.

Figure 10C:
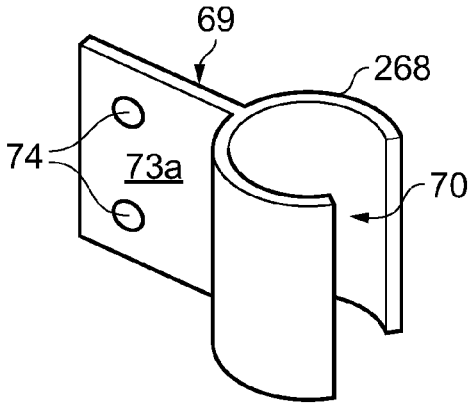

FIG. 10Di shows a front elevation view and FIG. 10Dii shows a side cross sectional elevation (along line CC') view of the bracket of FIGS. 10A, 10B and 10C in a ladder assembly suitable for holding two guideway tubes according to an embodiment of the invention.

Figure 10E:
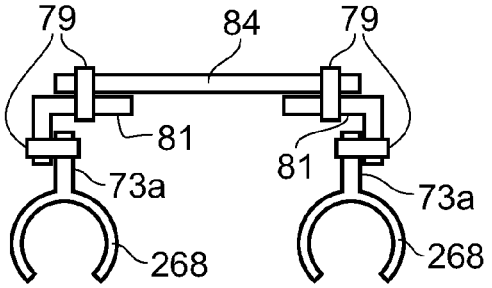

FIG. 10E shows a plan view of the ladder assembly of FIG. 10D.

Figure 10F:
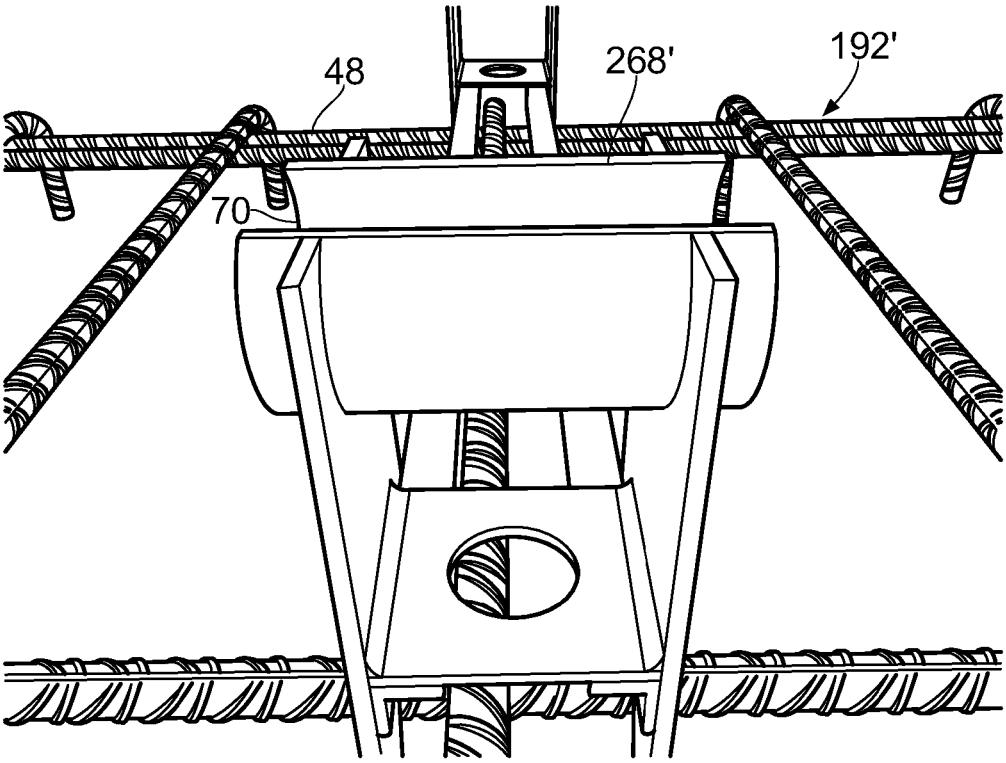

FIG. 10F shows a perspective view of an alternative bracket and a ladder assembly and framework.

Figure 10G:
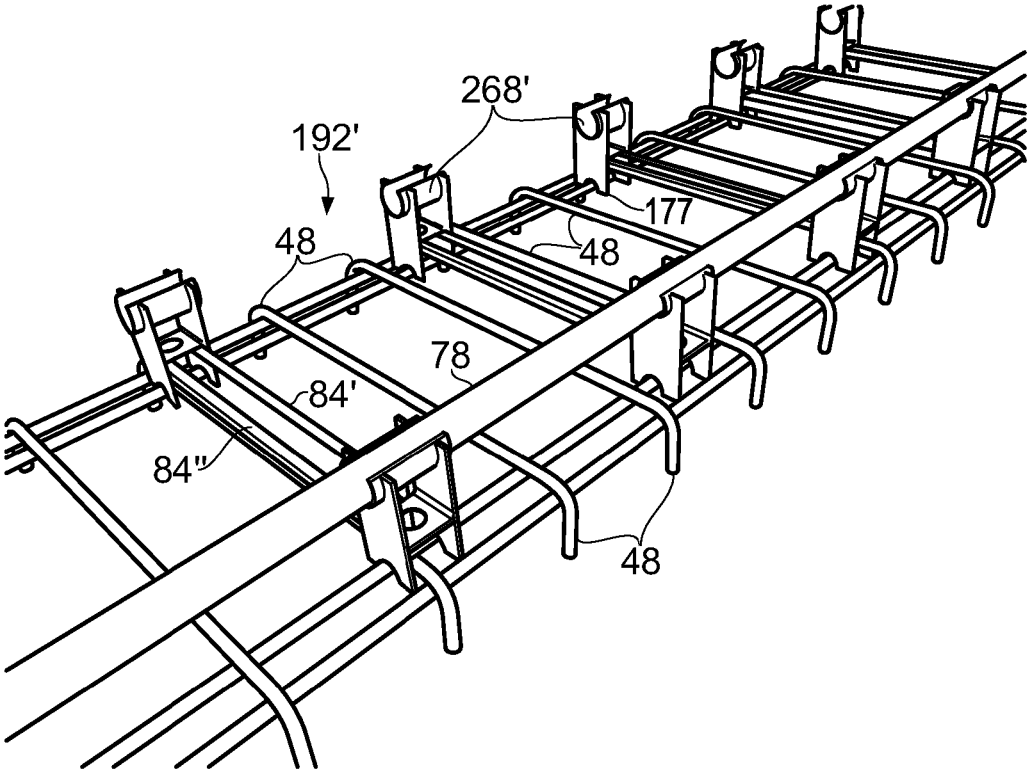

FIG. 10G shows a perspective view of the ladder assembly and framework of FIG. 10F with a sacrificial tube mounted in one set of brackets.

FIG. 10Hi shows a rear view, FIG. 10Hii shows a side view and FIG. 10Hiii shows a front view of the ladder assembly of FIG. 10F.

FIG. 10Ii shows a rear view, FIG. 10Iii shows a front view and FIG. 10Iiii shows a cross-sectional plan view of part of the ladder assembly of FIG. 10F.

Figure 11A:
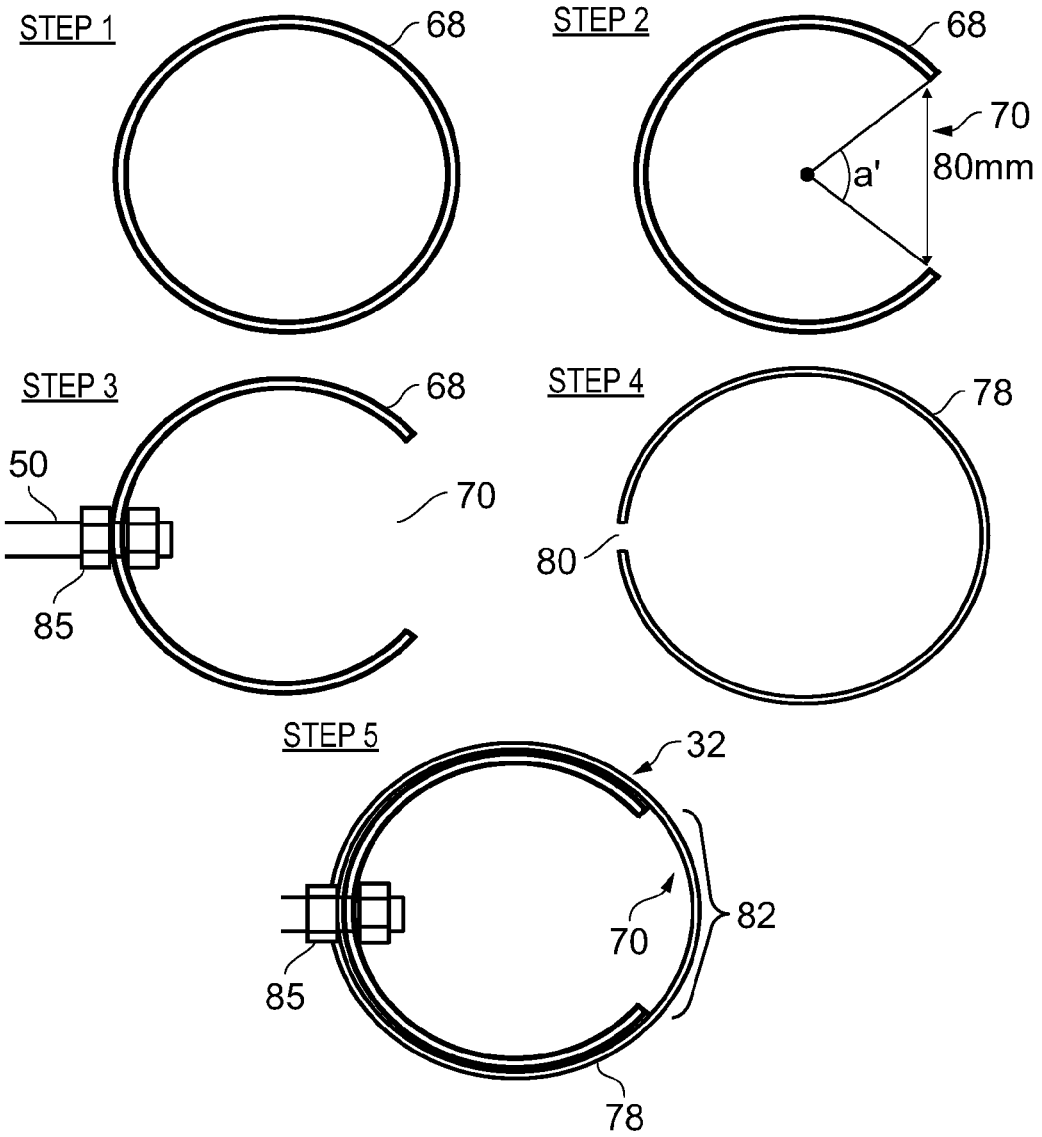

FIG. 11A shows plan views of a guideway tube during construction according to an eighth embodiment of the invention.

Figure 11B:
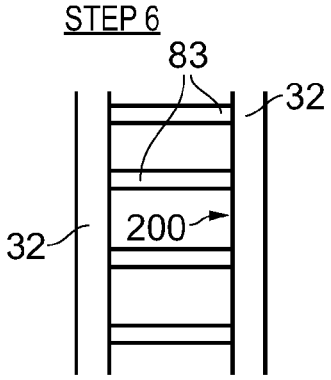
Figure 11C:
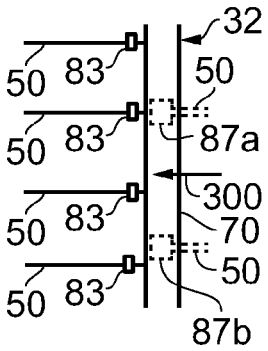

FIG. 11B shows side elevation views of the guideway tube of FIG. 11A in a ladder assembly suitable for fixing to a reinforcement cage.

FIG. 110 shows a side elevation view of the ladder assembly of FIG. 11B viewed in the in the direction of arrow 200.

Figure 11D:
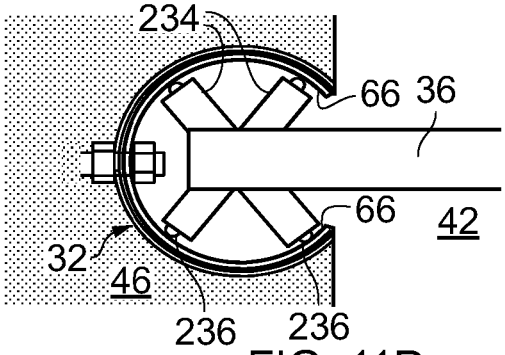

FIG. 11D shows a plan cross-sectional view of the guideway tube of FIG. 11A showing an alternative guide, travelling in the guideway tube after cutting, according to a ninth embodiment of the invention.

Figure 11E:
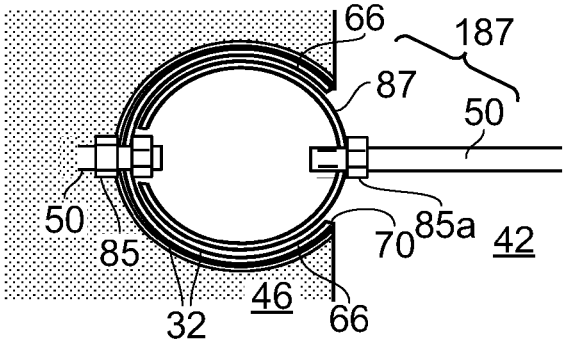

FIG. 11E shows a plan cross-sectional view of the guideway tube of FIG. 11A interengaging with a tension connection assembly of a neighbouring panel according to a tenth embodiment of the invention.

Figure 11K:
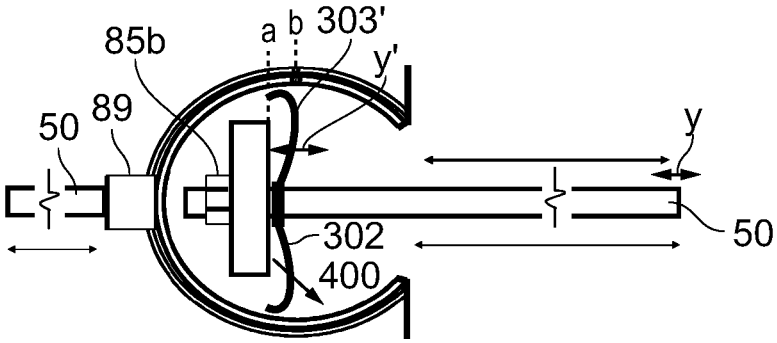
Figure 11L:
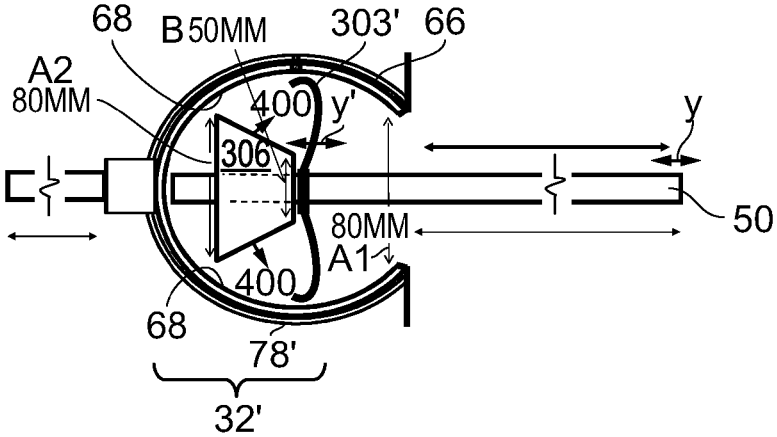
Figure 11F:
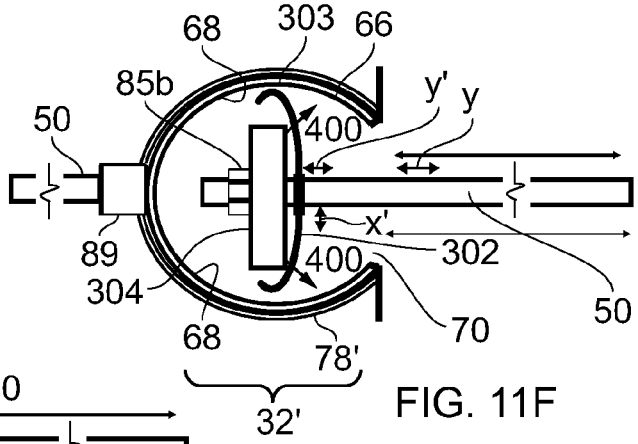

FIG. 11F shows a plan cross-sectional view of a guideway tube with an alternate tension connection assembly between neighbouring panels.

Figure 11G:
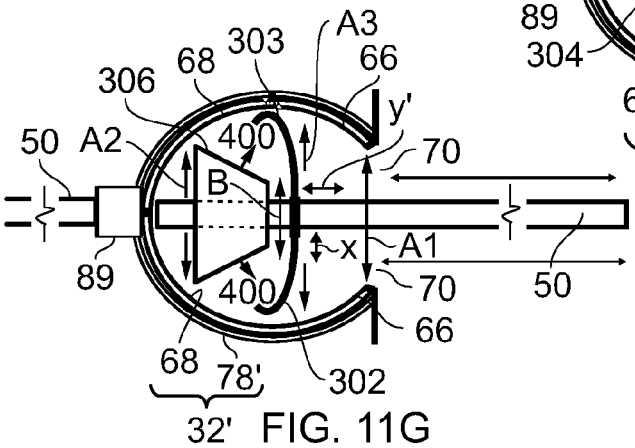

FIG. 11G shows a plan cross-sectional view of a guideway tube with a further alternate tension connection assembly between neighbouring panels.

Figure 11H:
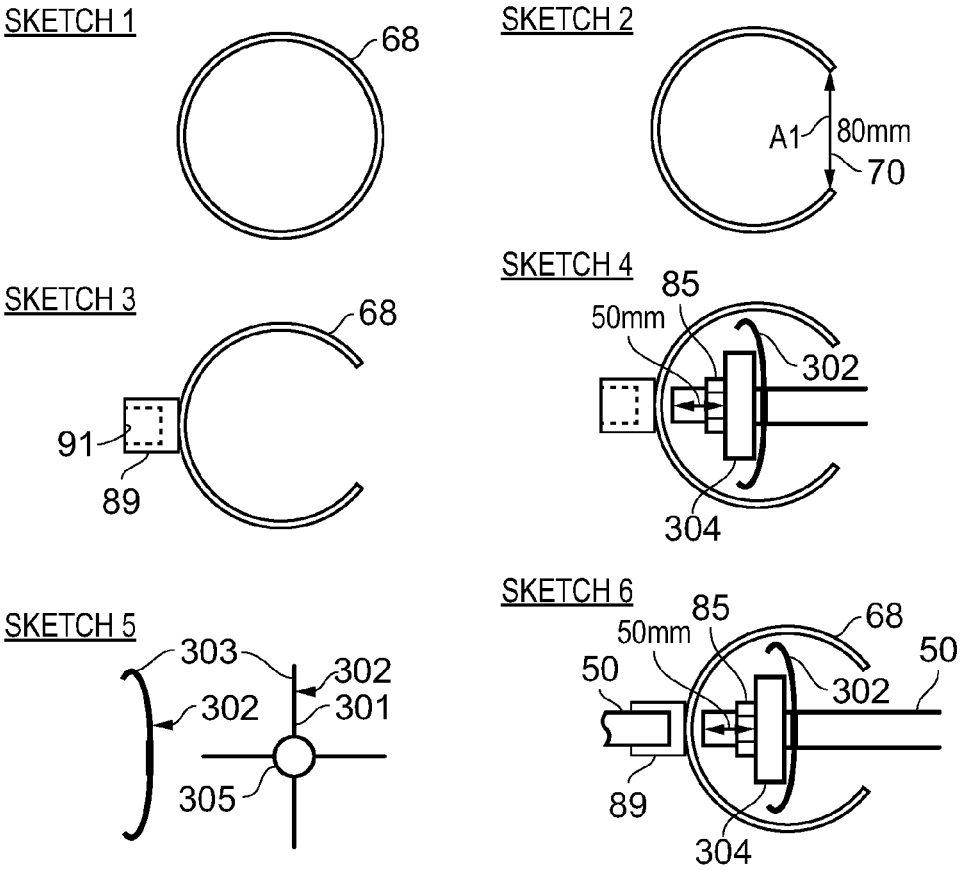

FIG. 11H shows a sequence of plan cross-sectional views of the alternate tension connection assembly of FIG. 11F illustrating various steps in its manufacture and implementation.

Figure 11I:
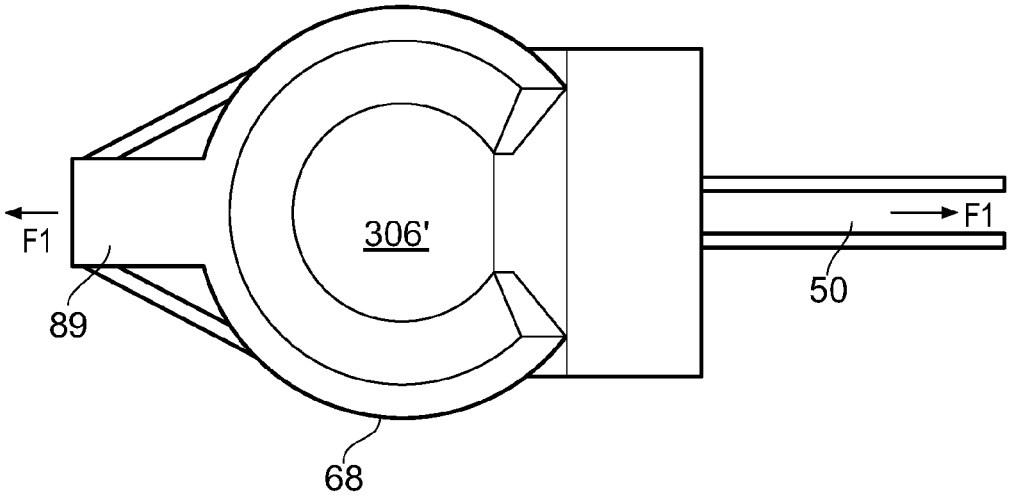

FIG. 11I shows a perspective view from above of a further alternate tension connection assembly between neighbouring panels.

Figure 11J:
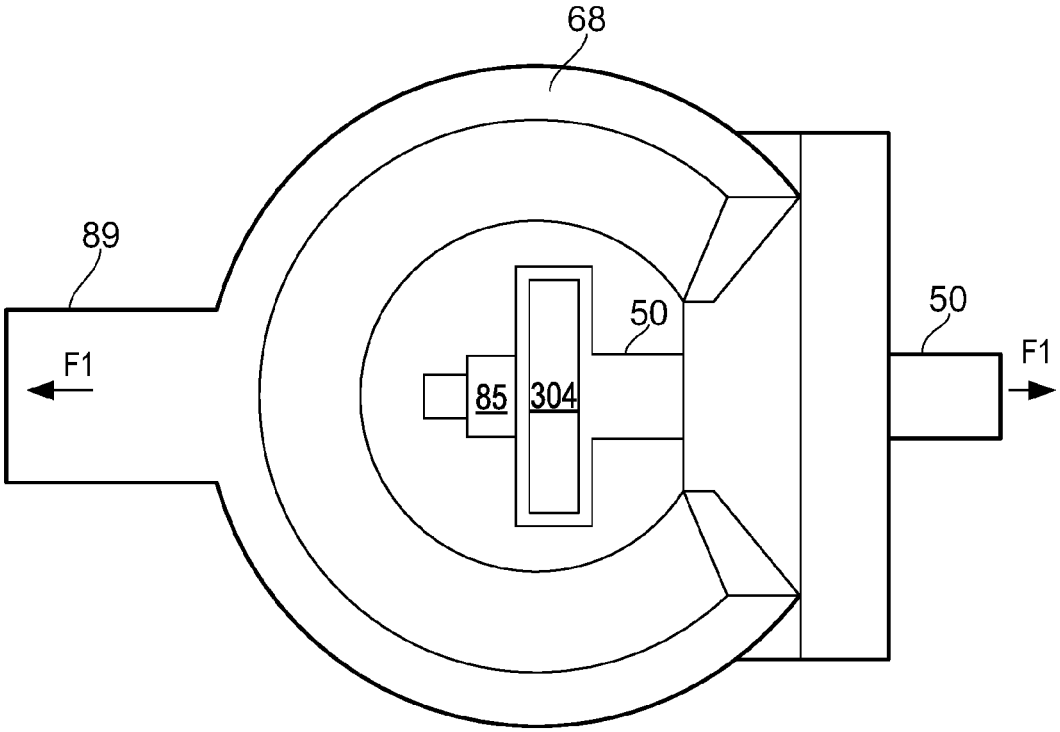

FIG. 11J shows a perspective view from above of the tension connection assembly of FIG. 11F.

FIG. 11K shows a plan cross-sectional view of a guideway tube with a further alternate tension connection assembly between neighbouring panels comprising an alternate positioning element and the protruding key element of FIG. 11F.

FIG. 11L shows a plan cross-sectional view of a guideway tube with a further alternate tension connection assembly between neighbouring panels with the alternate positioning element of FIG. 11K and the truncated cone protruding key element of FIG. 11G.

Figure 12:
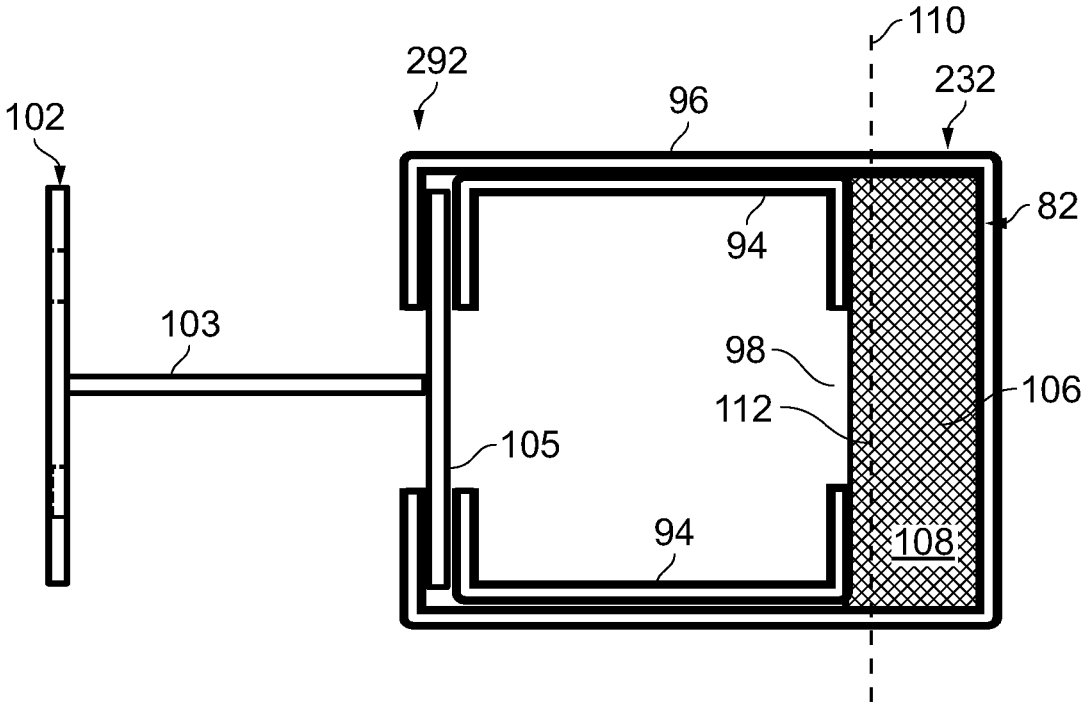

FIG. 12 shows a plan cross-sectional view of an alternative guideway tube assembly according to an eleventh embodiment of the invention.

Figure 1:
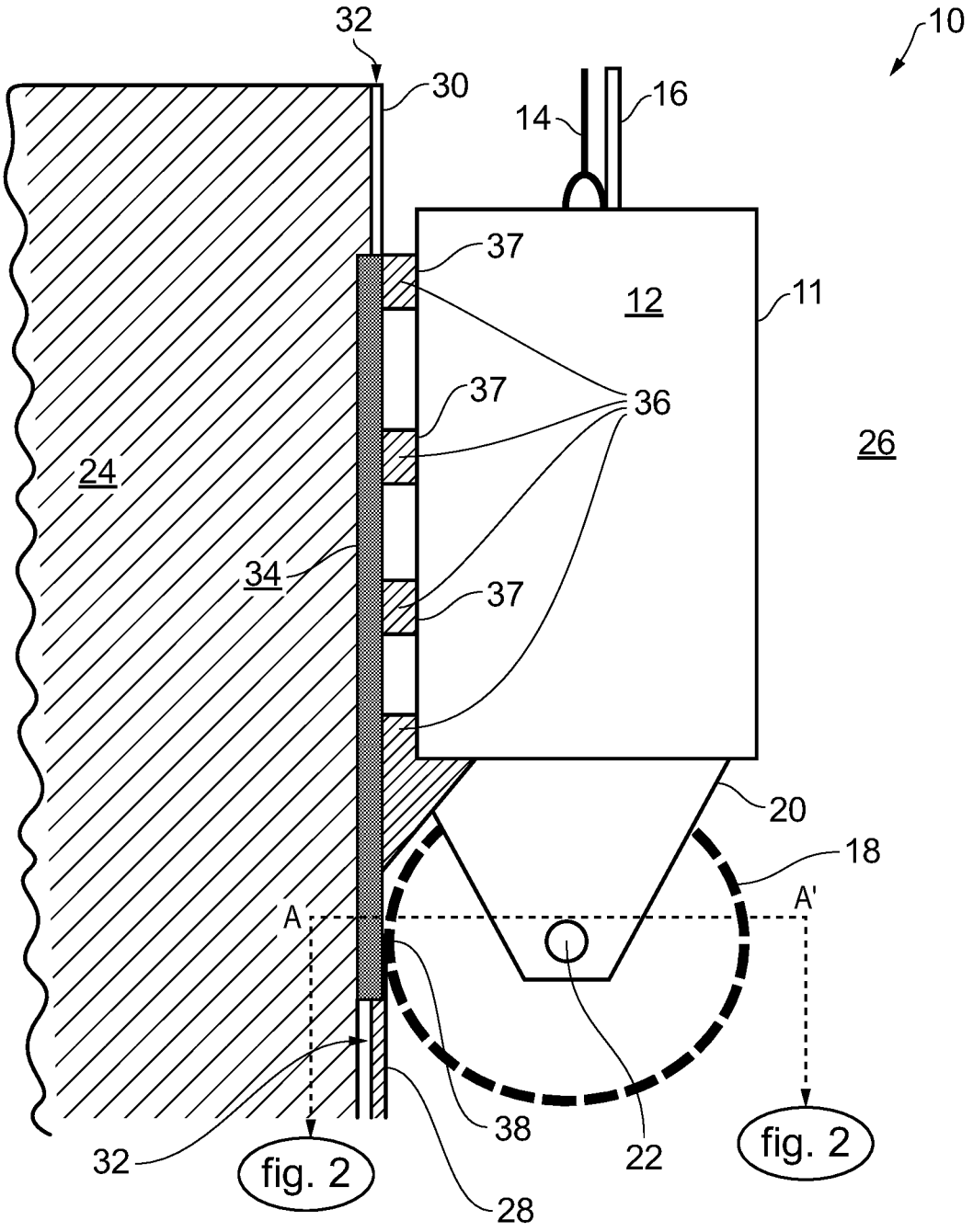
FIG. 1 shows a schematic side elevation view of an apparatus according to a first embodiment of the invention.
Figure 13A:
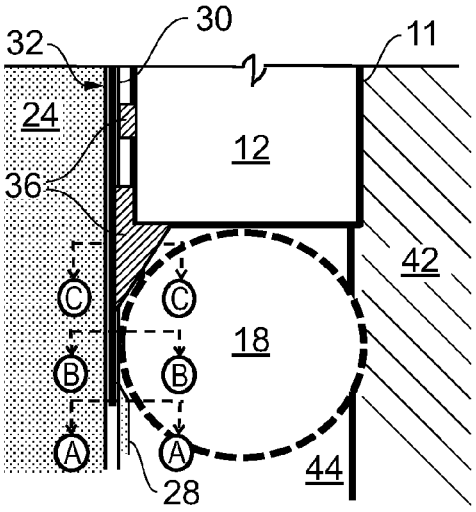

FIG. 13A shows a schematic side elevation view of a milling machine cutting along a guideway, according to the first embodiment of the invention (seen in FIG. 1).

Figure 13C:
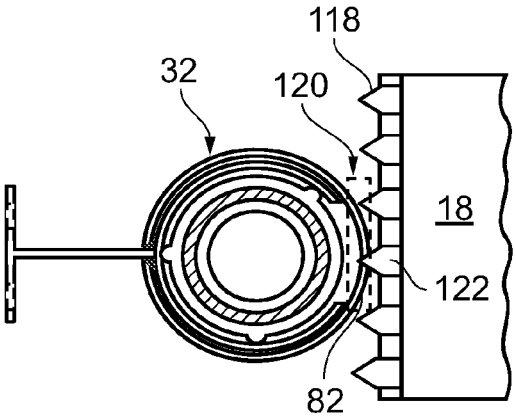
Figure 13B:
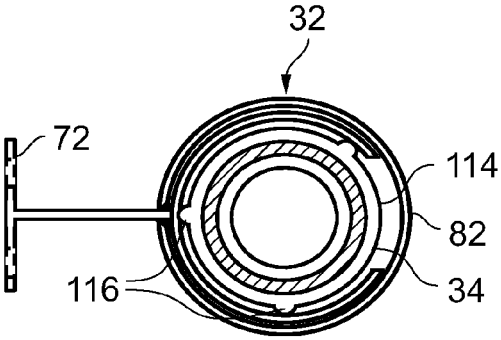

FIG. 13B shows a plan cross-sectional view of a guideway tube and milling machine during cutting to illustrate tolerances.

FIG. 13C shows a plan cross-sectional view of a guideway tube and guide according to the first embodiment of the invention.

Figure 13D:
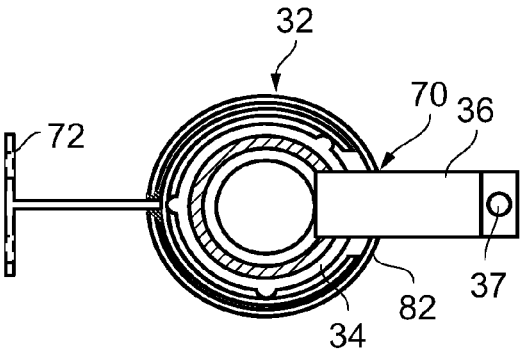

FIG. 13D shows a plan cross-sectional view of a guideway tube, guide and mill guide supports according to the first embodiment of the invention.

Figure 14A:
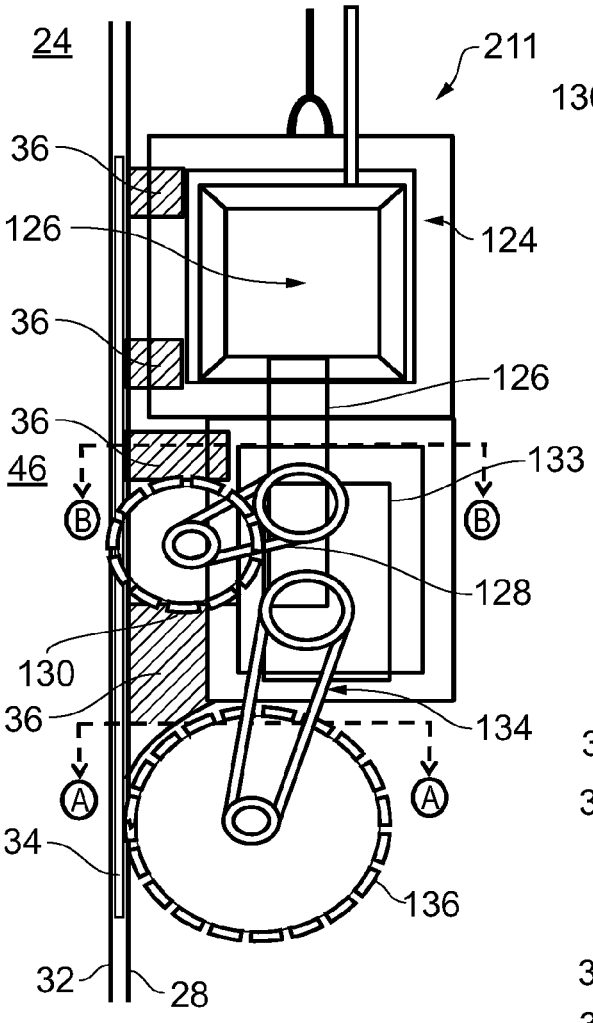

FIG. 14A shows a schematic side elevation of a milling machine having three cutting wheels according to a twelfth embodiment of the invention illustrating power connection and drive trains. An optional fourth wheel is shown.

Figure 14C:
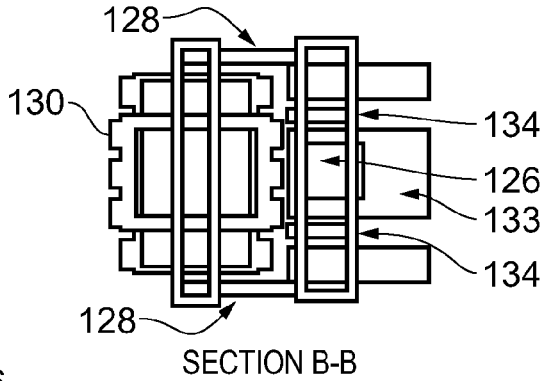
Figure 14B:
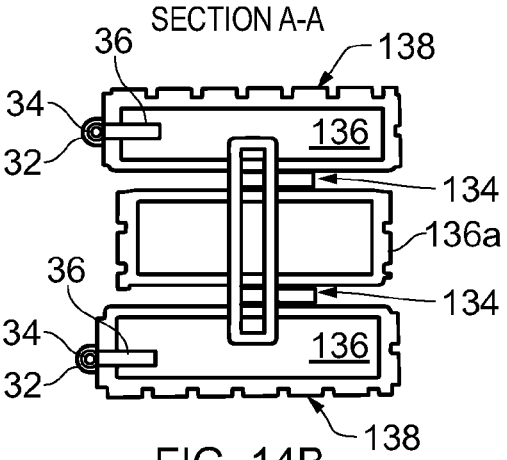

FIGS. 14B and 14C show schematic plan cross-sectional views of the milling machine of FIG. 14A, along lines AA and BB respectively.

Figure 14F:
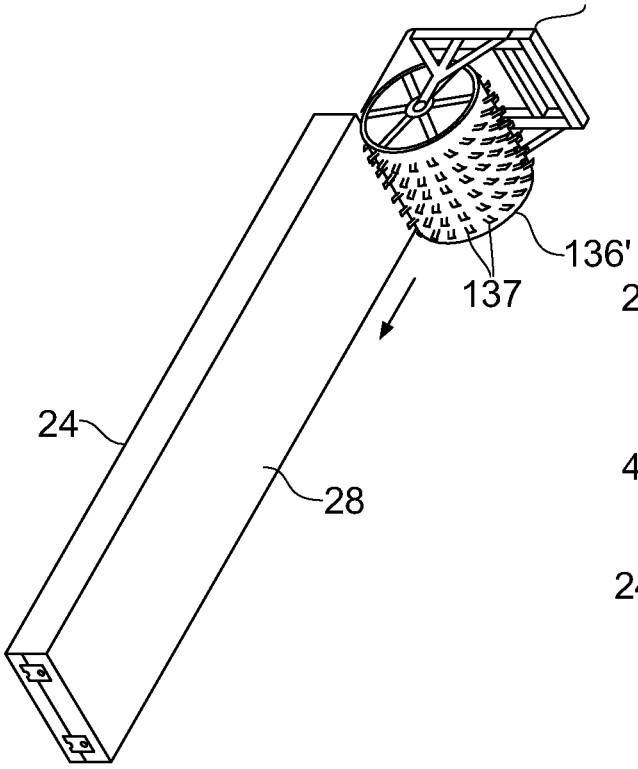
Figure 14D:
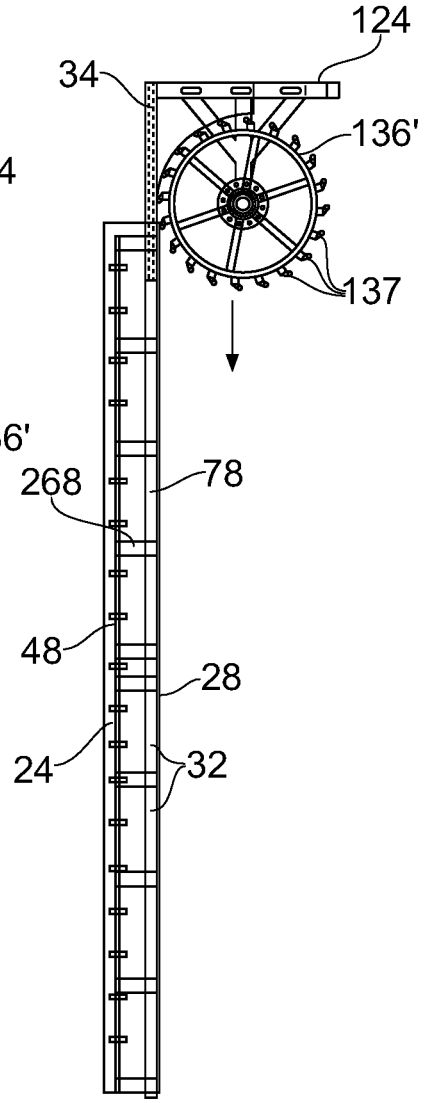

FIG. 14D shows a side cross-sectional view of an end face of a first concrete panel and a milling machine according to the invention.

Figure 14E:
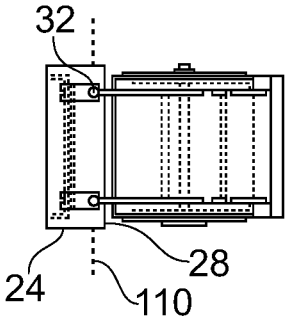

FIG. 14E shows a plan cross-sectional view of the concrete panel and milling machine of FIG. 14D.

FIG. 14F shows a perspective view of the concrete panel and milling machine of FIG. 14D.

Figure 15:
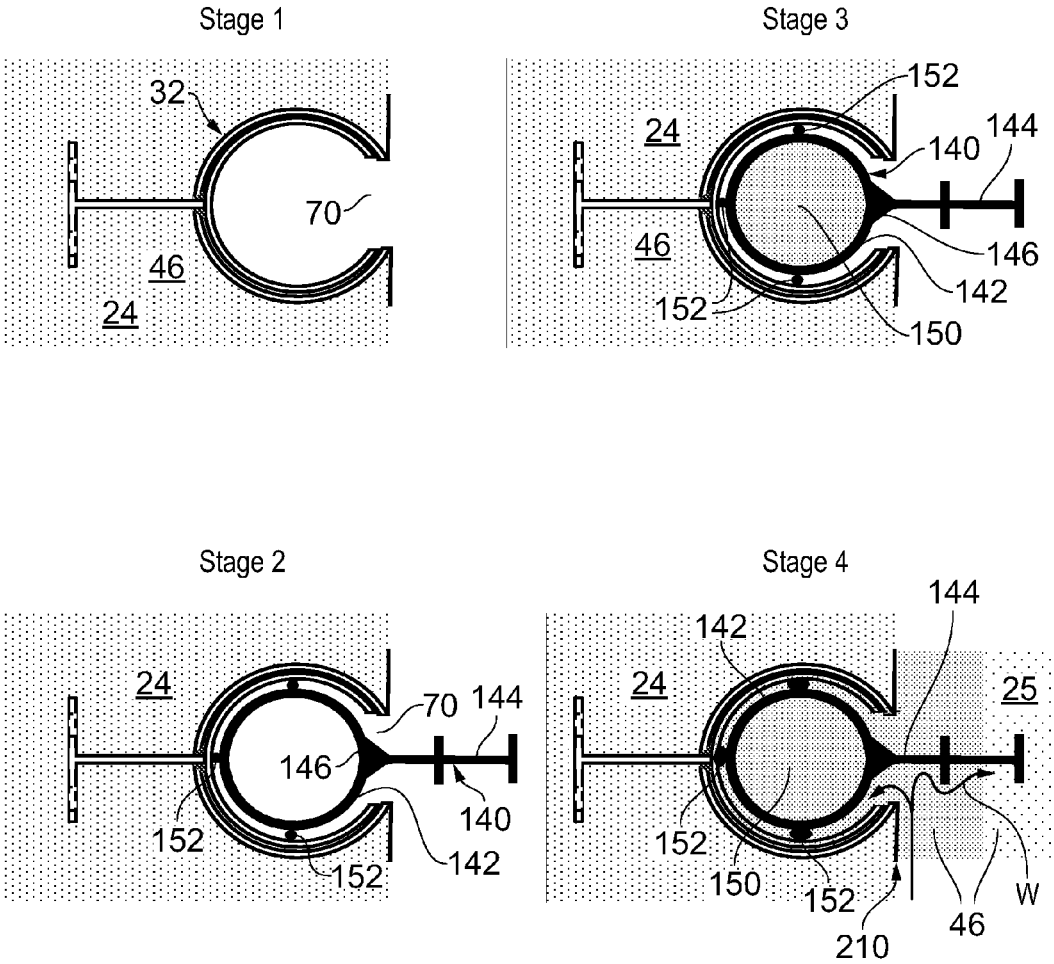

FIG. 15 shows plan, cross-sectional views of a guideway tube and a waterbar assembly illustrating the steps of constructing a waterbar.

Figure 16A:
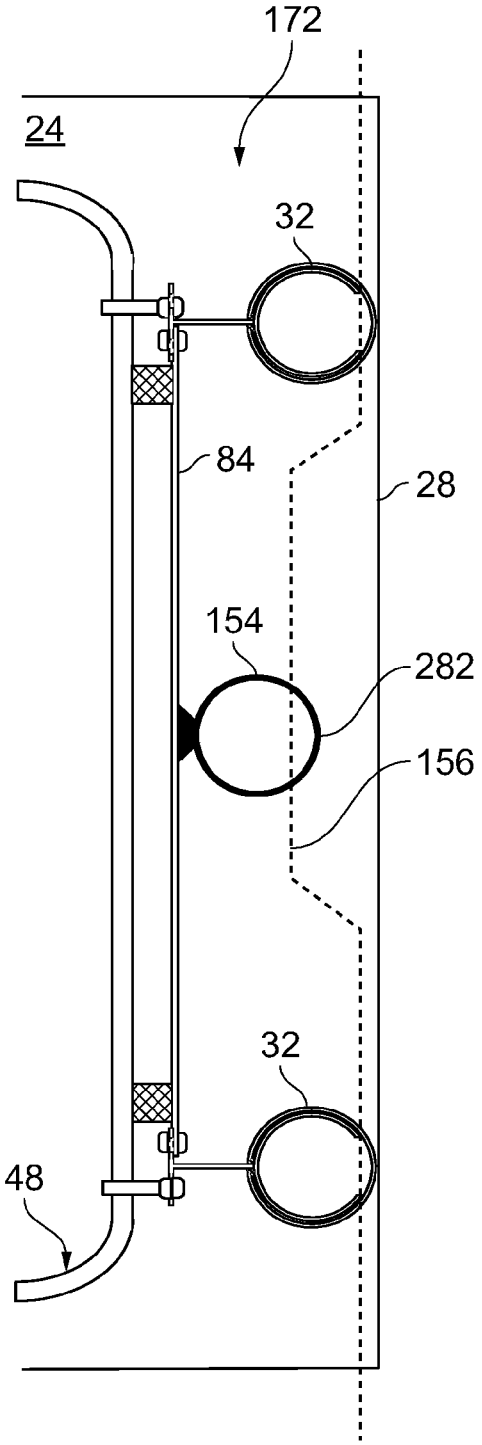
Figure 16B:
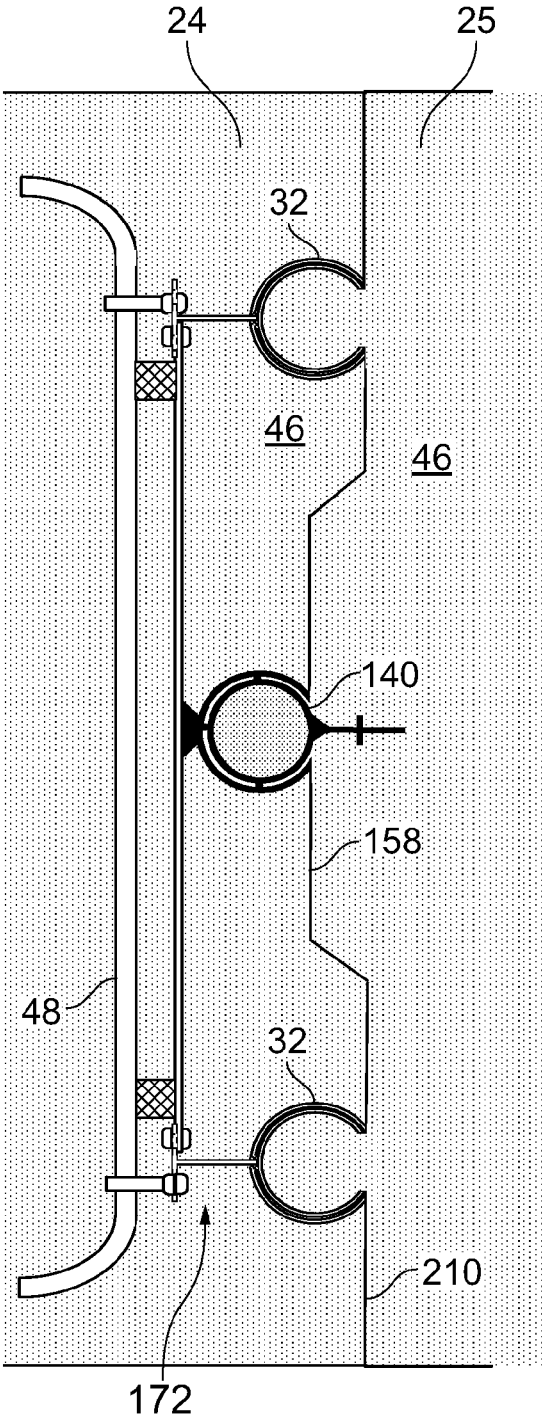

FIGS. 16A and 16B show plan cross-sectional views of an end face guideway assembly in an end of a first concrete panel, before and after having cutaway an end face of the first concrete panel to form the joint face of the first concrete panel, the guideway assembly having two outer guideway tubes for forming a construction (shear) joint and a central guideway tube for forming a waterbar according to a thirteenth embodiment of the invention. An optional shear key rebate 158 is also shown.

FIG. 16Ci, FIG. 16Cii and FIG. 16Ciii show plan cross-sectional views of an end face guideway assembly in an end of a first concrete panel, respectively before (FIG. 16Ci) and after (FIG. 16Cii and FIG. 16Ciii) having cutaway an end face of the first concrete panel to form the joint face of the first concrete panel, the guideway assembly having two spaced outer guideway tubes for forming a construction (shear) joint and a central clip and pipe for receiving a waterbar (after a portion of the pipe circumference is cutaway according to a further embodiment of the invention.

Figure 17:
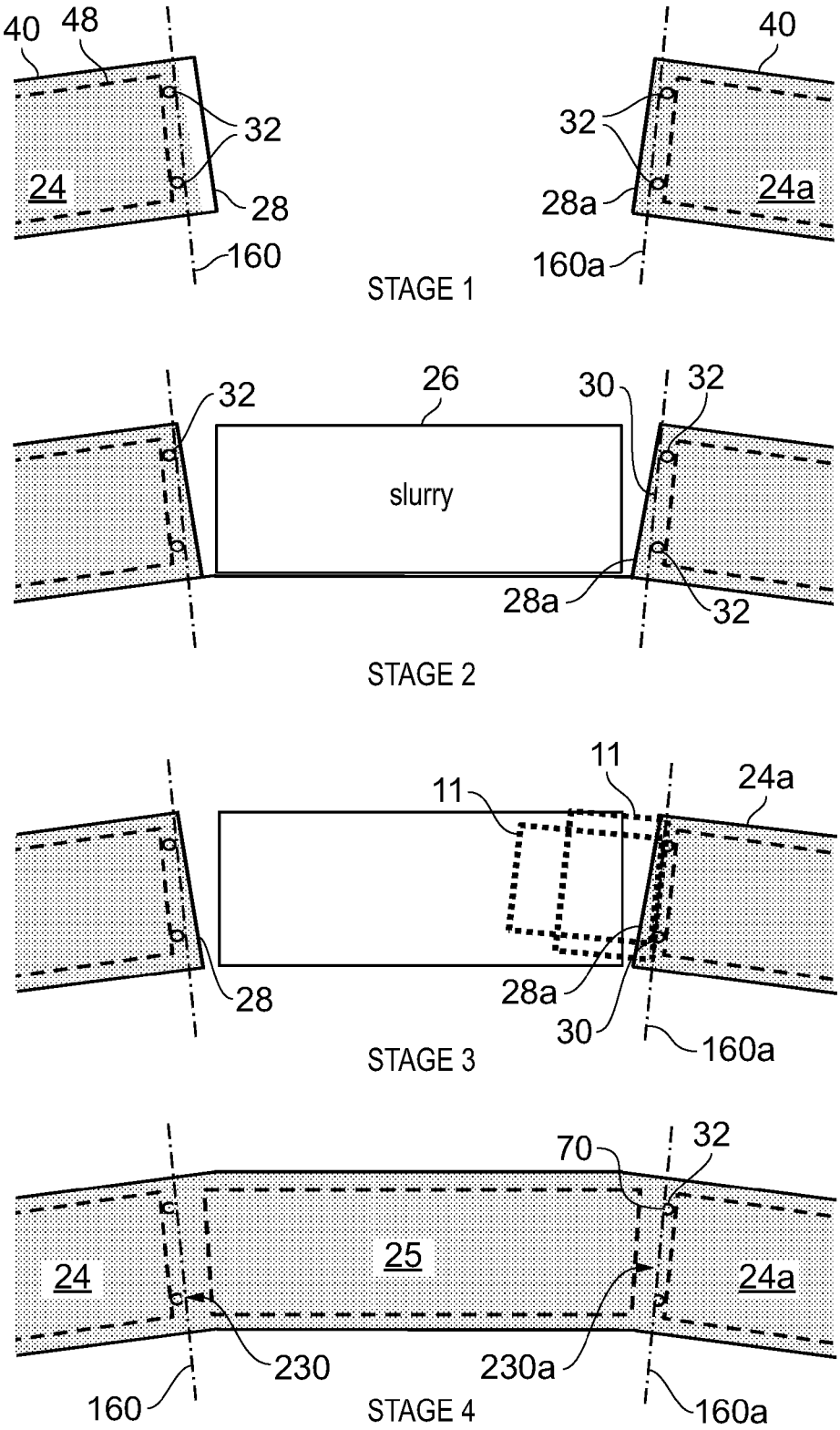

FIG. 17 shows schematic plan views of the panels of a diaphragm wall shaft (or corner in a diaphragm wall) at various stages of construction, the expected cutting face as defined by the end face guideway assembly lying substantially along a radius of curvature of the shaft (or corner) according to a fourteenth embodiment of the invention.

Figure 18A:
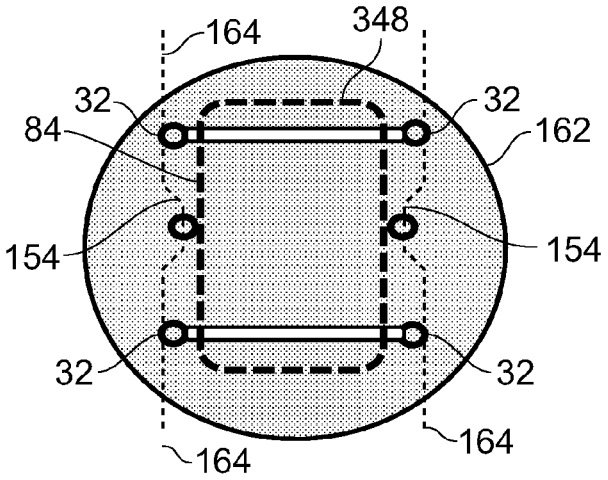

FIG. 18A shows a plan cross-sectional view of a bored concrete pile having a guideway assembly according to an embodiment of the invention installed.

Figure 18B:
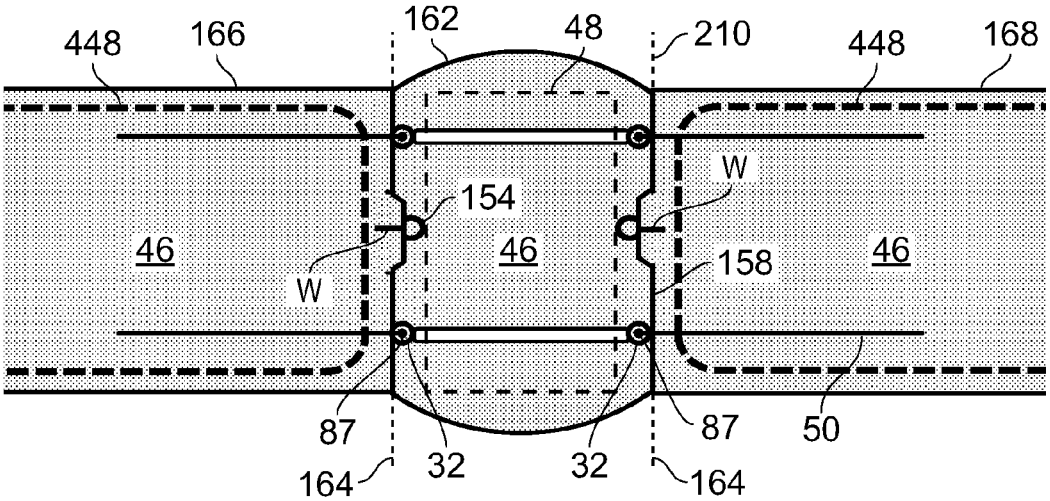

FIG. 18B shows a plan cross-sectional view of panels of a diaphragm wall having a bored pile such as that shown in FIG. 18A as a connector "panel" between the more usual panels of rectangular cross section, the bored pile in effect acting as both a "panel" (according to the invention) and as a bored pile, for providing extra strength and foundation capability than a usual diaphragm wall panel.

Figure 18C:
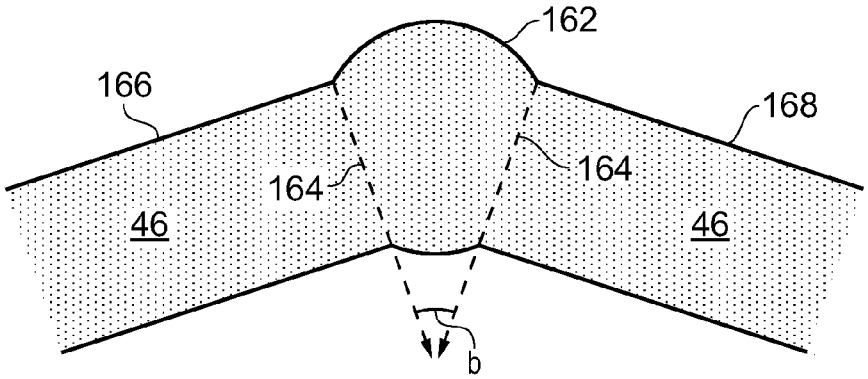

FIG. 18C shows a plan cross-sectional view of panels of a diaphragm wall shaft (or corner) such as that in FIG. 17 utilising the bored pile acting as an intermediary "panel" from FIG. 18A according to the invention.

Figure 19:
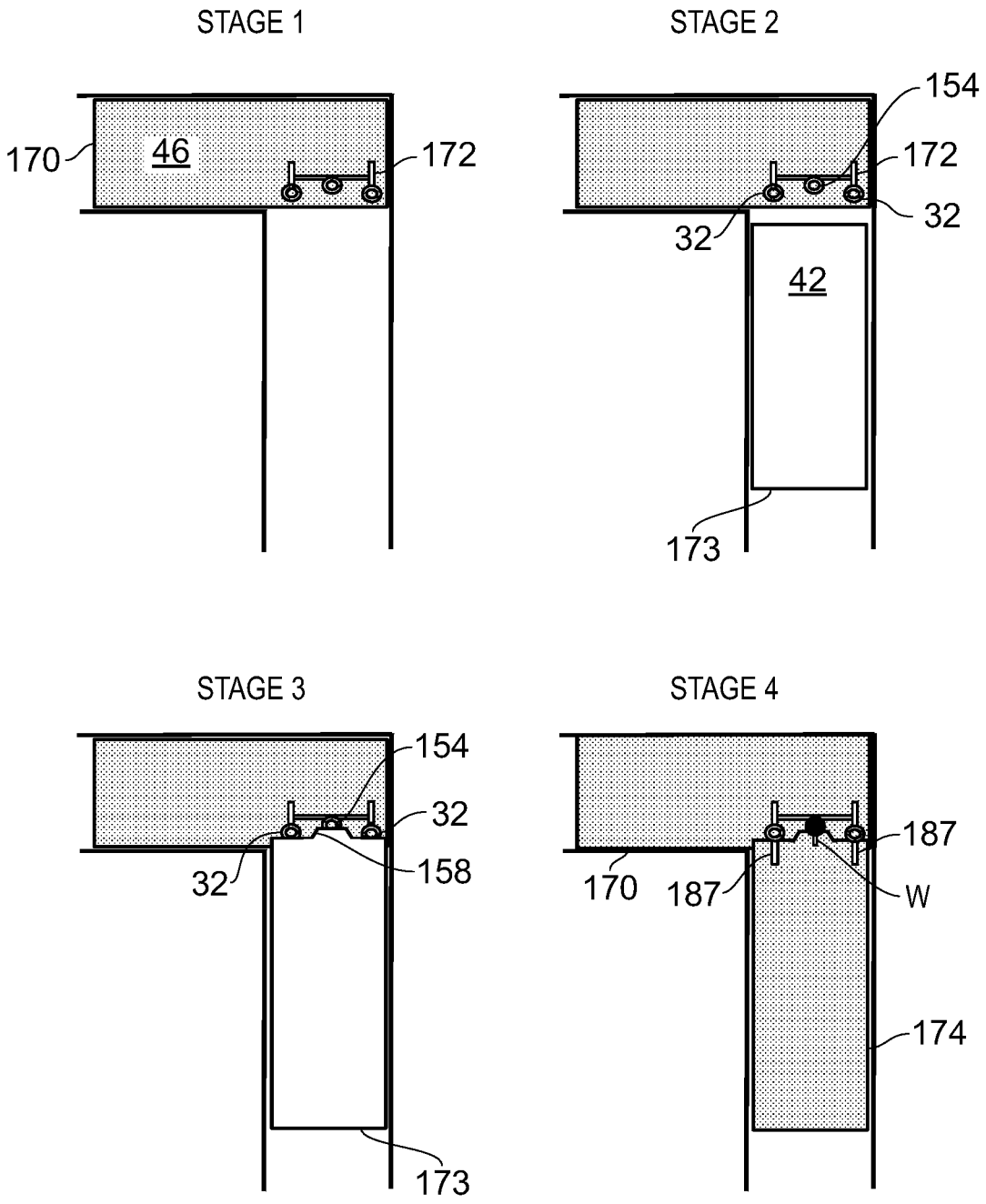

FIG. 19 shows plan views of panels during construction of corners, such as a right angle corner, of a diaphragm wall using one example embodiment of an end face guideway assembly. Other guideway assemblies comprising one or more guideways may be used.

Figure 20A:
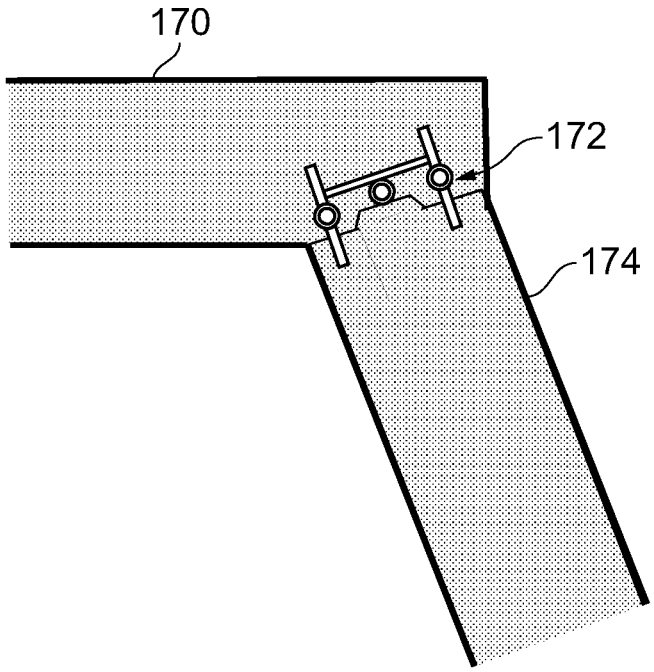
Figure 20B:
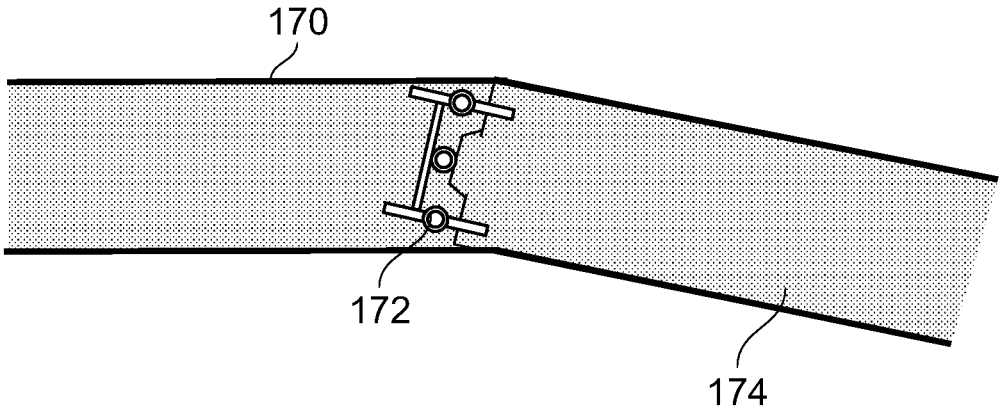

FIGS. 20A and 20B show plan, cross-sectional views of panels during construction of non-right angle corners of a diaphragm wall also using an example end face guideway assembly.

Figure 21I:
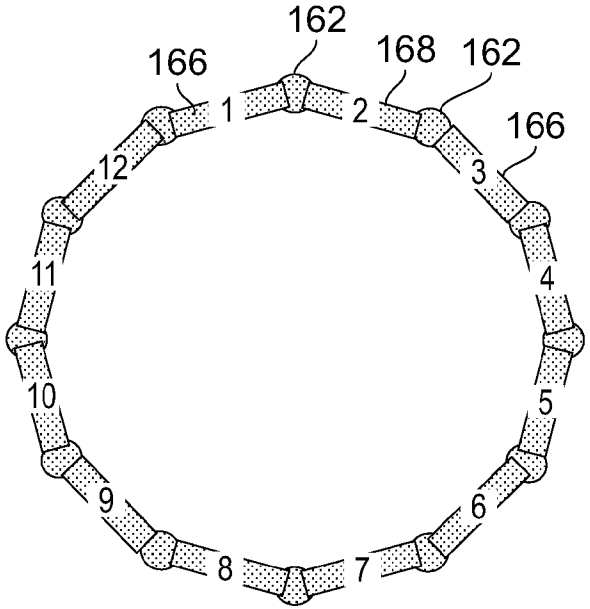
Figure 21I:
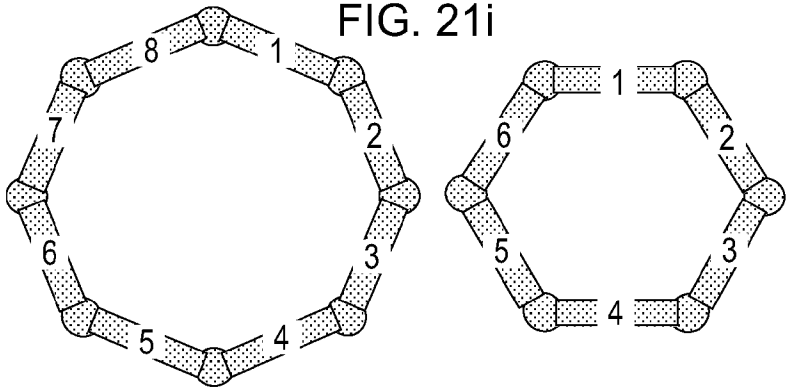

FIGS. 21*i*, 21*ii* and 21*iii* show schematic plan views of three arrangements of bored piles incorporating an end face guideway assembly according to the invention and planar panels of rectangular cross-section to form medium diameter shafts (such as 8 m to 20 m).

Figure 22A:
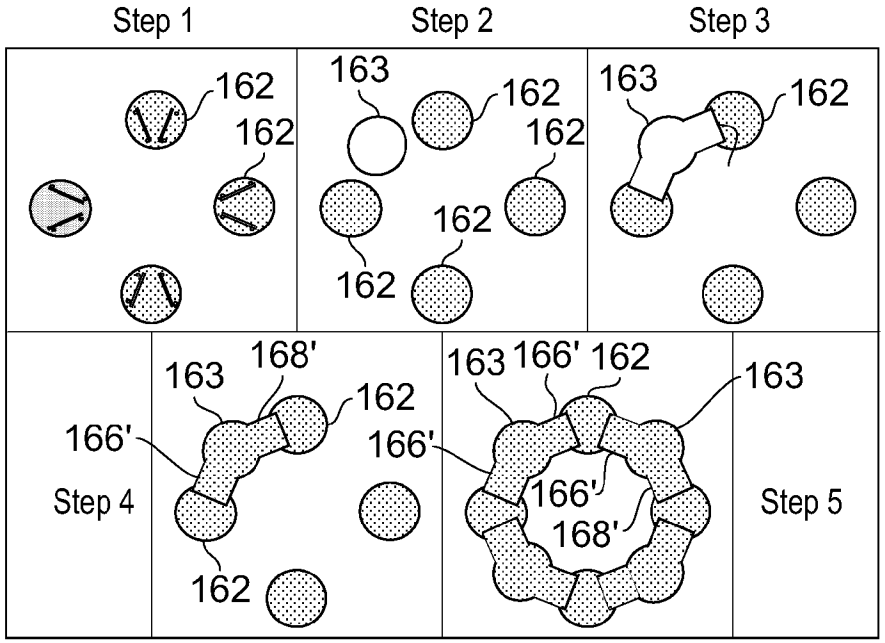

FIG. 22A shows a schematic plan view of a sequence of steps for installation of primary bored piles 162 and secondary bored piles 163 to form smaller diameter shafts (such as 3 m to 10 m). The primary bored piles 162 incorporate two end face guideway assemblies having one or more and typically two guideways according to the invention which are used to form a joint with the secondary bored piles 163. Four primary and four secondary bored piles are shown.

Figure 22B:
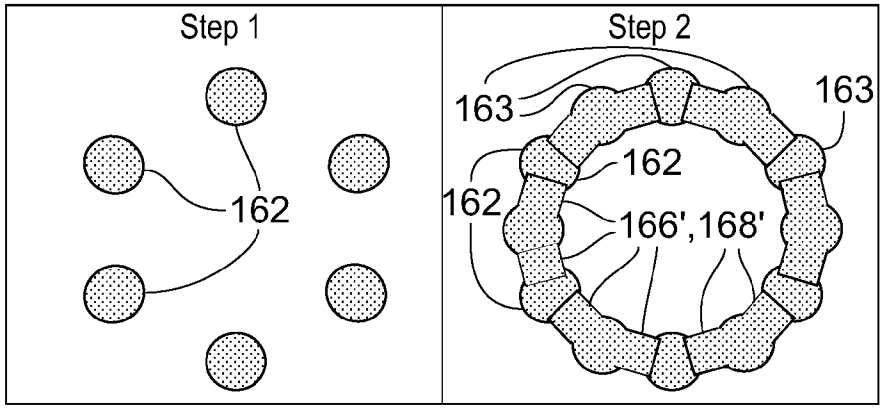

FIG. 22B shows a schematic plan view of connected contiguous bored pile walls to form a shaft of diameter of around 5 m with six primary piles and six secondary piles.

Figure 23A:
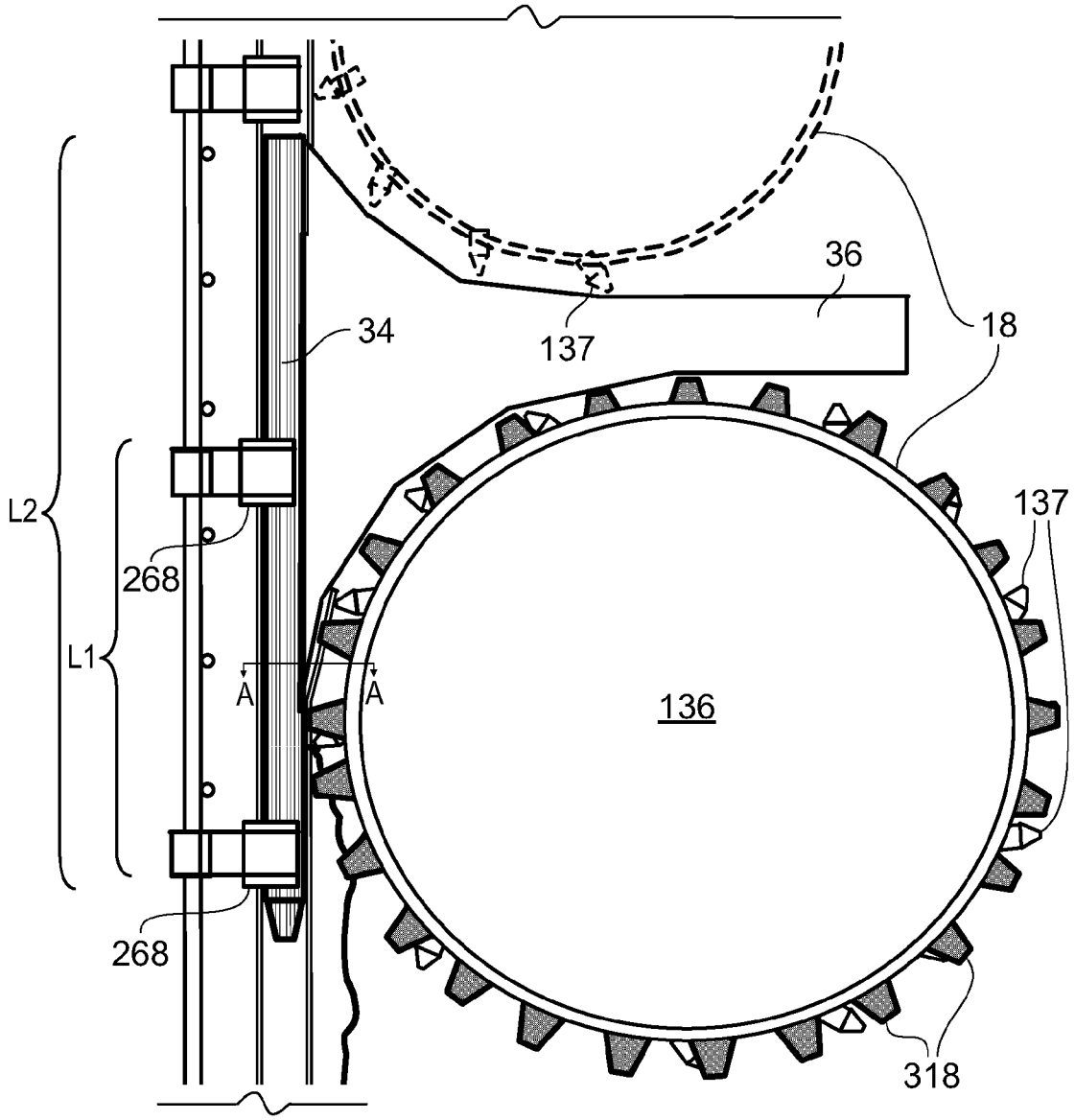

FIG. 23A shows a schematic side elevation view of a milling machine having at least one end face cutting wheel incorporating saw blade teeth according to a further embodiment of the invention.

Figure 23B:
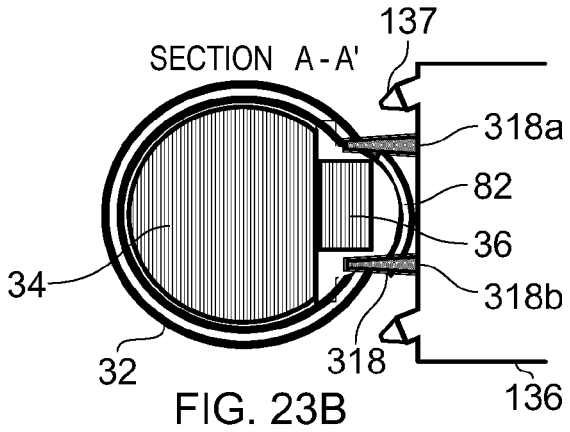

FIG. 23B shows a plan view of the milling machine of FIG. 23A along line AA'.

Figure 23E:
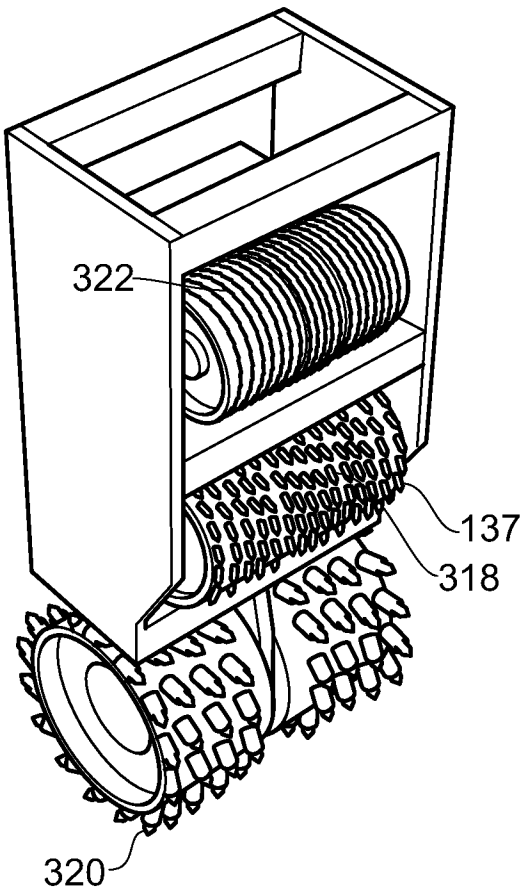
Figure 23D:
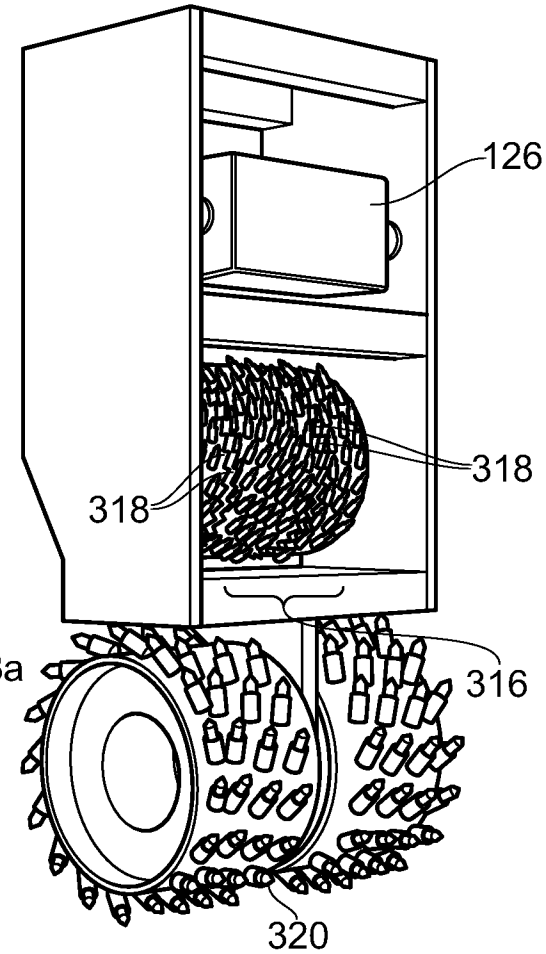
Figure 23C:
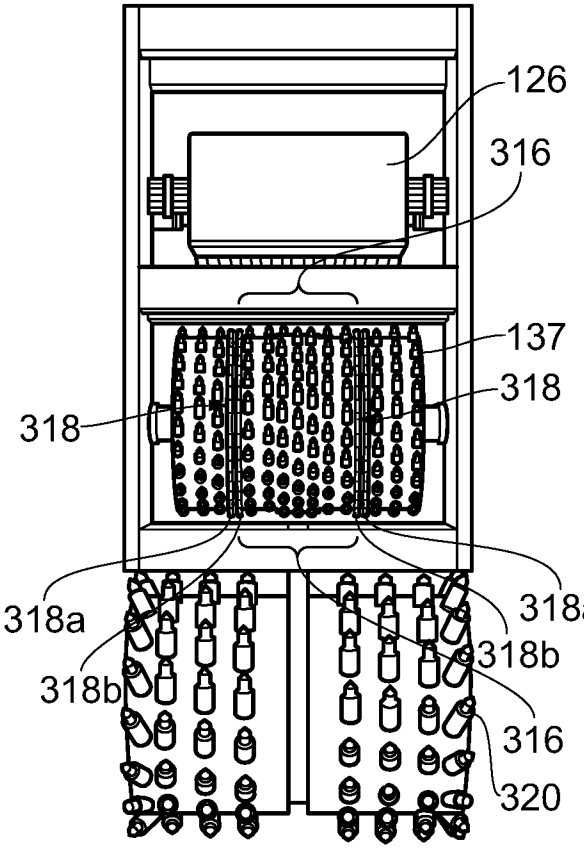

FIGS. 23C, 23D and 23E show, respectively, two rear and one front perspective view of a milling machine such as that shown in FIGS. 23A and 23B incorporating an additional optional lower wheel set.

Figure 24A:
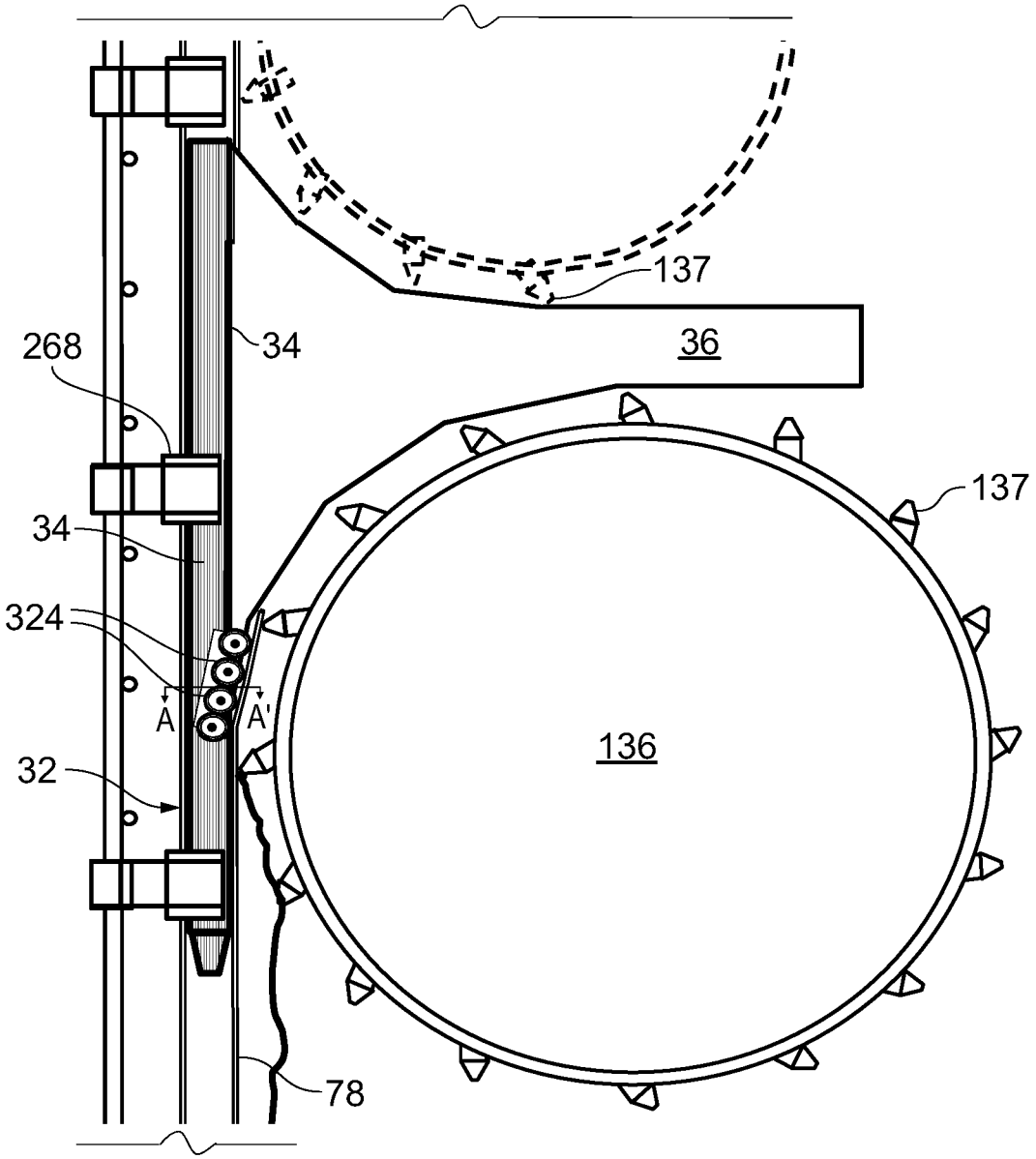

FIG. 24A shows a schematic side elevation view of a milling machine having at least one end face cutting wheel incorporating rotatable disc cutters according to a further embodiment of the invention.

Figure 24B:
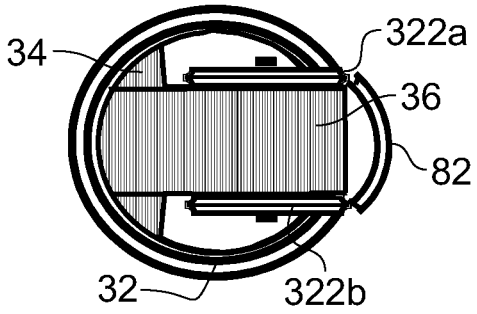

FIG. 24B shows a plan view of the milling machine of FIG. 24A along line AA'.

Figure 25:
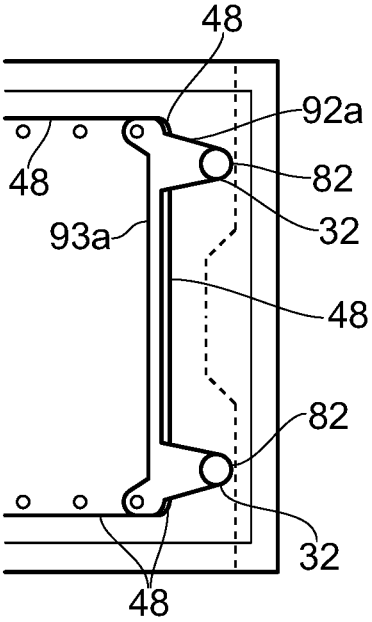

FIG. 25 shows a cross-sectional view from above of an alternative guideway tube assembly 92*a*.

Figure 26:
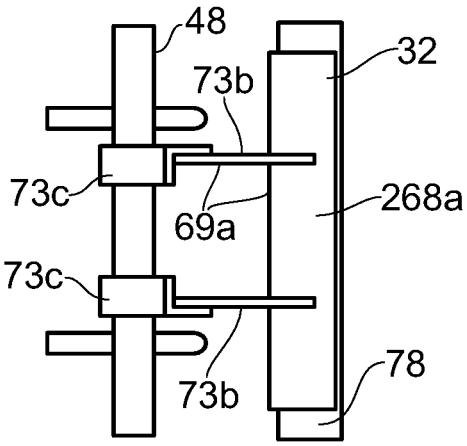

FIG. 26 shows a side elevation view of an alternative guideway tube bracket 69*a*.

Figure 27I:
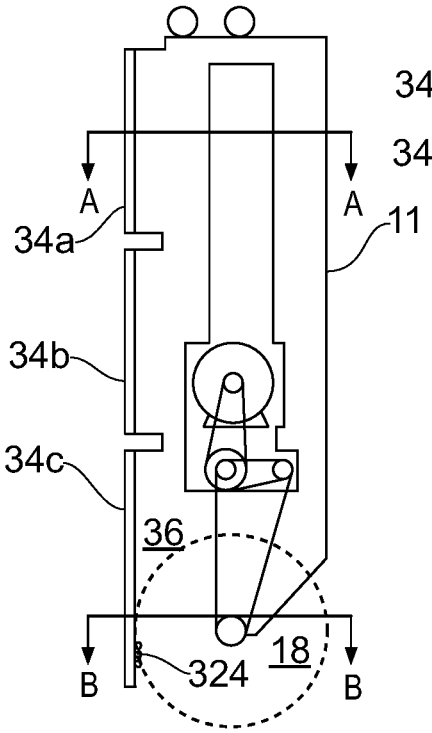

FIG. 27*i* shows a side elevation and FIGS. 27*ii* and 27*iii* show plan cross-sectional views of an alternative apparatus according to the invention incorporating a single external milling wheel 18 mounted on a driven central axle. Also seen are a plurality of vertically and horizontally spaced guides 34*a*, 34*b* and 34*c*.

Figure 28:
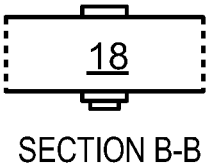
Figure 28:
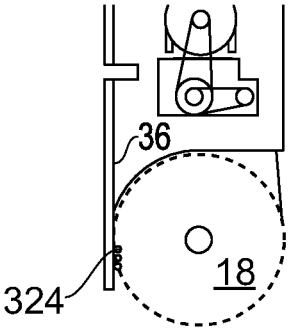

FIG. 28 shows a side elevation view of the lower part of an alternative apparatus according to the invention incorporating a single external milling wheel 18 mounted on a central axle and driven by a drive belt about its periphery.

Figure 29B:
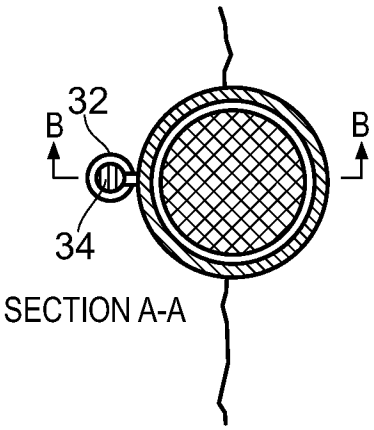
Figure 29B:
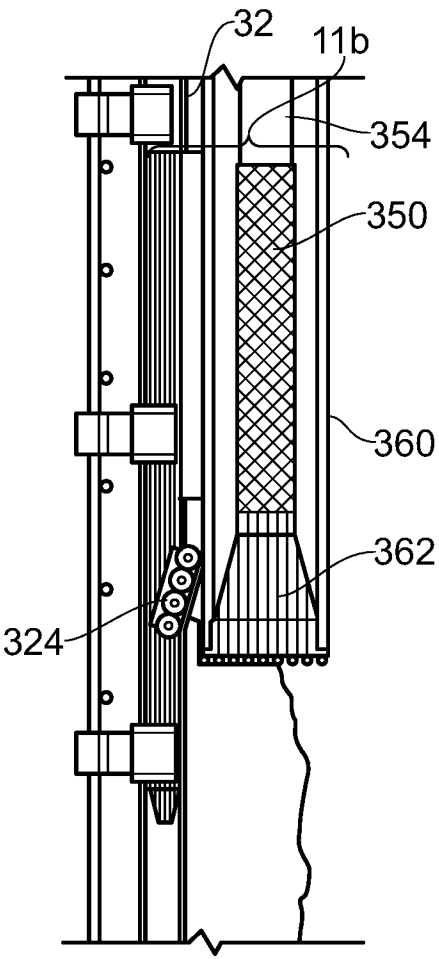
Figure 29B:
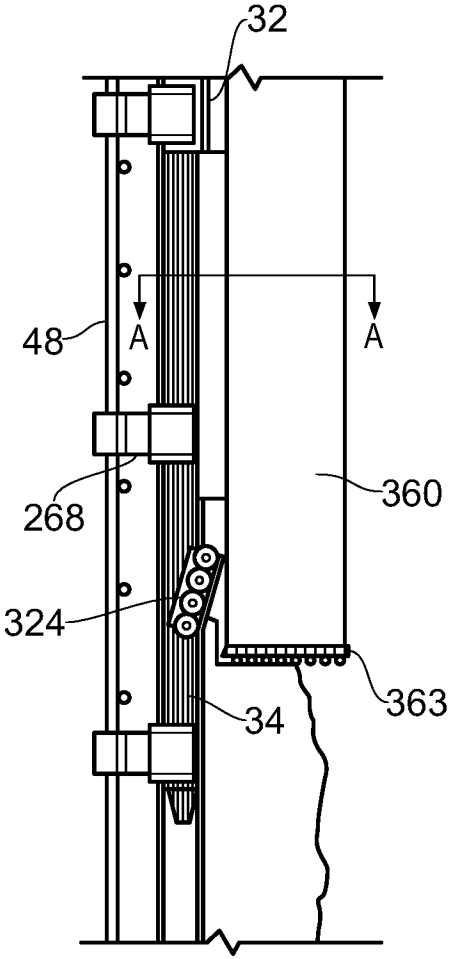

FIG. 29Ai shows a side elevation view and FIG. 29Aii shows a plan cross-sectional view, and FIG. 29Bi and FIG. 29Bii show side elevation views and FIG. 29Biii shows a plan view alternative apparatus according to the invention incorporating a cutting element in the form of a rotary drill. FIGS. 29Ai and 29Aii show an arrangement that may be used in a pre-excavated hole to prepare a face of an adjoining panel and FIGS. 29Bi, 29Bii and 29Biii shows an arrangement that may be used to bore a hole as well as prepare a face of an adjoining panel.

Figure 30:
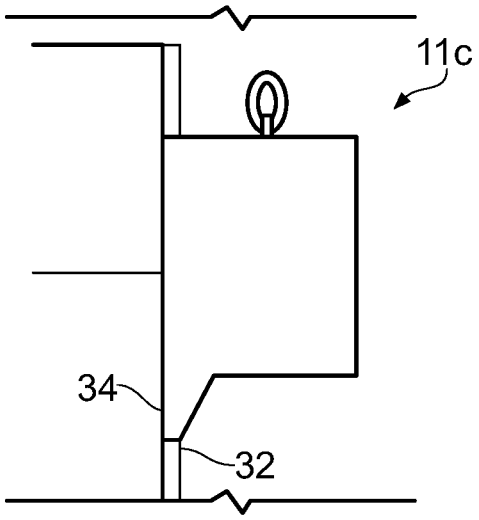

FIG. 30 shows a side elevation view of a chisel.

Figure 31:
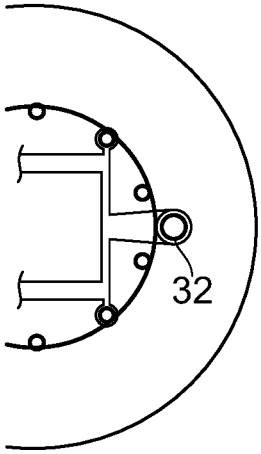

FIG. 31 shows a plan cross-sectional view of a circular panel and reinforcement cage having a single guideway tube suitable for use for example with an apparatus according to the invention comprising a drill to form a contiguous pile wall.

Figure 32:
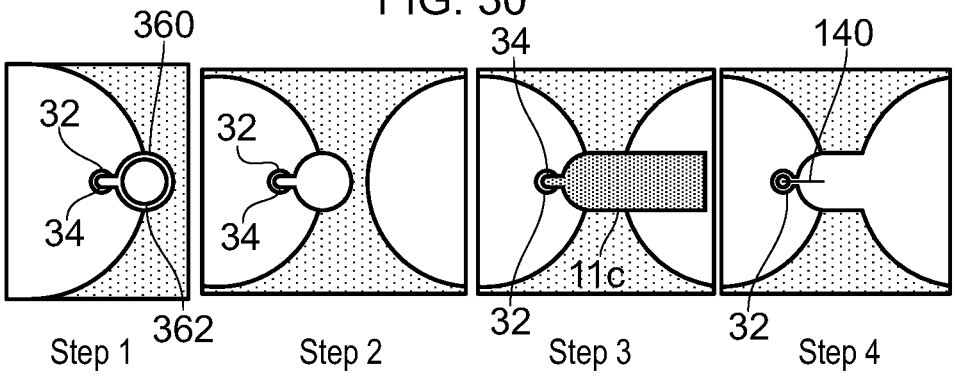

FIG. 32 shows plan cross-sectional views of the formation of two adjoining concrete circular panels into a contiguous pile linear wall by the formation of a drilled joint using, for example, the apparatus of FIG. 29A or 29B, the chisel of FIG. 30 and the guideway arrangement of FIG. 31.

Figure 33:
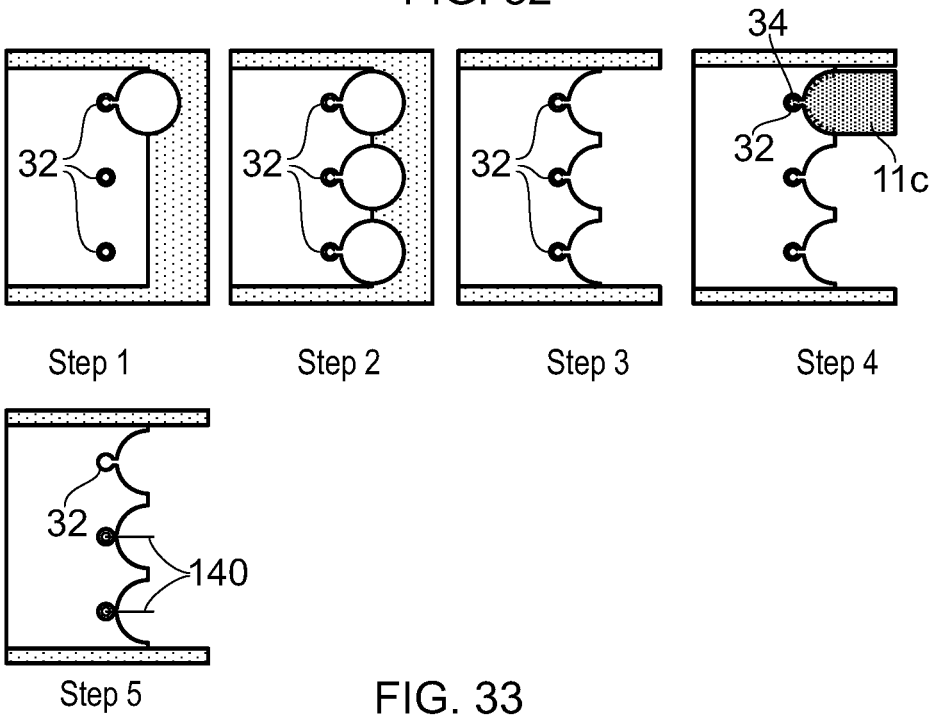

FIG. 33 shows plan cross-sectional views of the formation of two adjoining concrete planar panels into a contiguous pile wall using, for example, the apparatus of FIG. 29A or 29B.

Figure 27I:
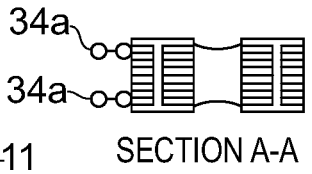
Figure 34:
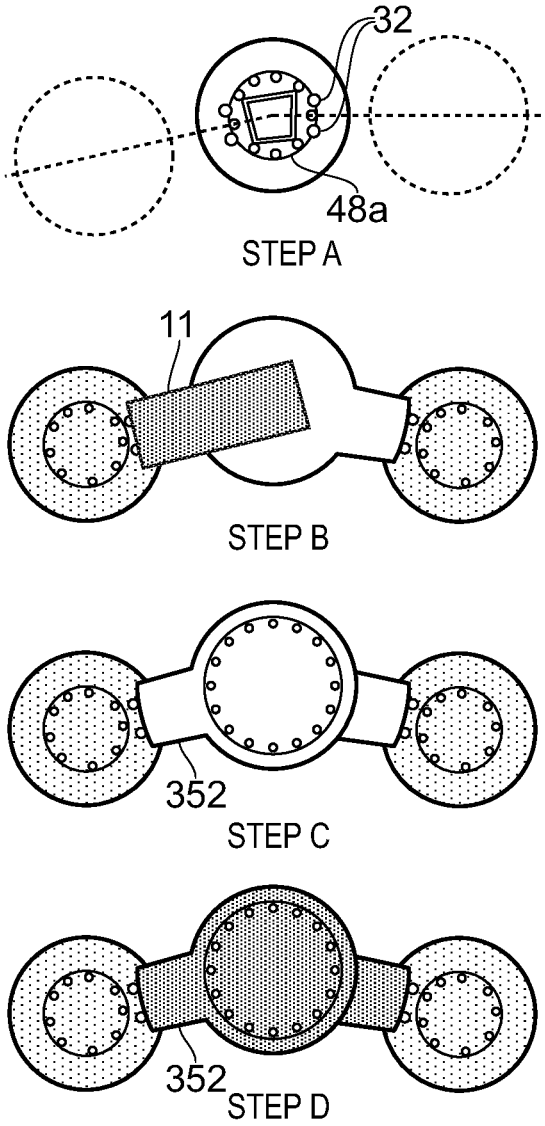

FIG. 34 shows plan cross-sectional views of the formation of three adjoining concrete circular panels into part of a contiguous pile non-linear wall that could form a shaft using, for example, the apparatus of FIG. 27 or 28 and a modified (now circular) reinforcement cage and guideway arrangement similar to that seen in FIG. 25.

DETAILED DESCRIPTION OF THE INVENTION

In the previous and following descriptions, diaphragm walls are referred to for ease of reference as a particularly suitable example of the application of the invention. Nevertheless, it is to be understood that various concrete embedded retaining walls such as diaphragm walls or shafts, contiguous pile walls or shafts, and secant pile walls or shafts and the like may also be constructed using the principles of the invention requiring a joint between two panels and the term diaphragm wall is to be understood to include such other walls unless the context requires otherwise.

Whilst the previous and following descriptions refer to steel and/or plastic as preferred materials, other materials of suitable hardness, durability and flexibility for the purpose intended may be used without departing from the scope of the invention. Similarly whilst various preferred dimensions are mentioned these may be varied as required within the limits of the purpose for the element so dimensioned.

Furthermore the previous and following descriptions refer to panels that are typically planar and rectangular in cross-section, having two generally planar substantially parallel "side" faces and two generally planar, substantially parallel "end" faces. However, it is to be understood the invention may be used with other shaped panels such as "panels" of circular cross-section such as piles as is described later. Whilst the apparatus and methods of the invention are particularly described herein in relation to "end" faces (also known as "end" walls) of generally rectangular concrete panels, it is to be understood that the apparatus and methods of the invention can be used in relation to "side" faces (also known as "side" walls) of a rectangular panel, "end" and/or "side" faces (also known as "end" and/or "side" walls) of a rectangular panel or indeed faces (also known as walls) of another shaped "panel" such as a circular "panel". The term "panel" should be interpreted to include these various embodiments except where the context determines otherwise.

FIG. 1 shows a schematic side elevation view of an apparatus 10 according to a first embodiment of the invention comprising a cutting mechanism in the form of a mill 11 having a mill body 12, a wire mill support rope 14, a mill hydraulics feed 16, a cutting element in the form of at least one cutting wheel 18 (typically a milling wheel), a cutting wheel support 20 and mill wheel axle 22. Whilst the invention is particularly suitable to the use of a mill having a cutting wheel as a cutting element to form the cutting mechanism, a grab, drill or other cutting mechanism may be used. Indeed, initial trench excavations may use any suitable excavator, typically a grab of known type.

A first concrete panel 24 is cast and a second panel trench is excavated adjacent panel 24. Second panel trench 26 is typically filled with slurry, such as bentonite slurry, to prevent its collapse. The first panel and the second panel are typically rectangular in cross-section although, as will be shown in relation to FIGS. 18A and 18B. A bored pile of differing (typically circular or square) cross-section may be used as a "panel" within the context of the invention. Typically a narrow soil column may be left in between the first panel 24 and the newly excavated trench 26 for forming a second panel.

First concrete panel 26 has an end face 28 that is approximately vertical over its length. This verticality is determined by a first cutting machine, typically an existing grab, used to excavate the trench for the first panel. Similarly the verticality of the walls of the second excavated trench is determined by the cutting machine, typically an existing grab, used to excavate it. The grab (not shown) is guided by gravity and therefore is usually vertical in its movement during excavation but it may be subject to sideways movement during excavation due to the ground it encounters. The end face 28 of first panel 24 may therefore deviate from vertical within various tolerances expected during the excavation.

A guideway tube 32 is concreted into panel 24 adjacent end face 28. Guideway tube 32 is typically hollow and sealed at its base to prevent ingress of slurry or concrete until a sacrificial portion is cut. As will be described below, end face 28 is cut way by the action of the cutting machine of the invention (here mill 11) to form a milled end face 30 of panel 24. The mill 11 prepares the end face 28 ready for a joint with a neighbouring panel which is poured later.

Mill 11 has an elongate guide 34, supported on one or more, and preferably at least two vertically spaced, mill guide supports 36 to mill body 12, that travels in guideway tube 32 during cutting (here milling) of end face 28 of panel 24. Guide 34 may extend along a substantial portion of the guideway tube opposite the mill 11 to guide and (as will be described in more detail later) anchor the mill to the end face 28 of panel 24 so as to resist lateral movement of the mill away from the end face 28 of panel 24 during cutting. Thus, the mill 11 of the invention can be used to mill one face of a panel rather than having to mill two opposing end faces of two panels concurrently to provide equal (balancing) dig resistance to the milling action during milling on each side of the mill as required in prior art mills.

Figure 2:
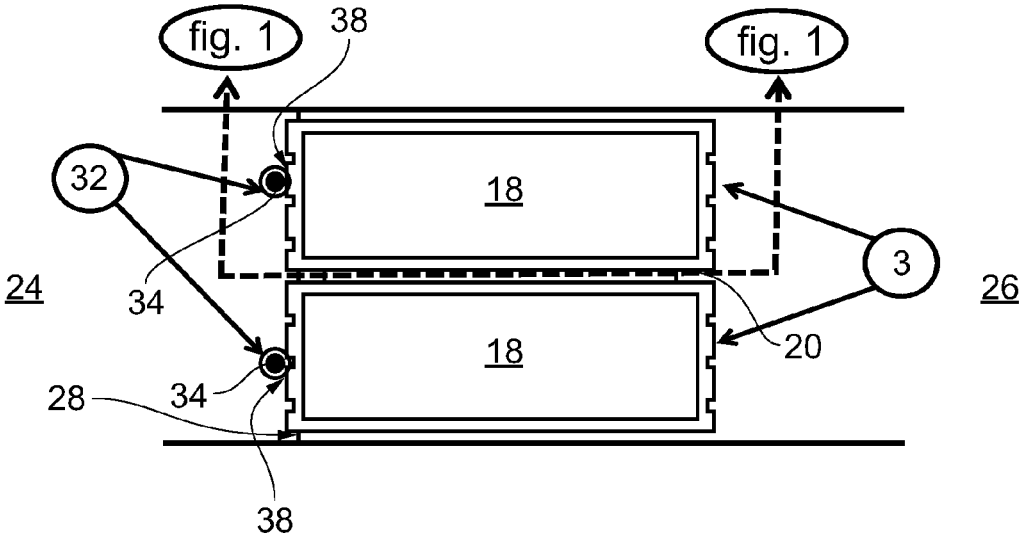
FIG. 2 shows a schematic plan view of the apparatus of FIG. 1 along line AA'.

Mill guide supports 36 may be mounted on limited movement hinges 37 on supports 36 on the mill body 12, so as to allow some flexibility within the tolerances of the apparatus 10, and reduce the risk of the guide 34 getting stuck in the guideway tube 32. A cutting element in the form of mill wheel 18 cuts the end face 28 of first panel 24 in the region of cutting zone 38 to form a cut end face 30 of first panel 24. As will be seen in FIGS. 27*i* to 27*iii*, a number of (in use) laterally and vertically spaced guides 34 may be provided, and one or more of these may also be hingedly mounted (perhaps in two orthogonal directions) so as to introduce play into the system and reduce the risk of the guide(s) getting stuck. Typically one guide is held fixedly in relation to the cutting mechanism whilst the others are slightly movable but this may not be the case, FIG. 2 shows a schematic plan view of the apparatus of FIG. 1 along line AA'. Mill 11 may have a cutting element comprising two or more sub-elements such as two mill wheels 18 as shown in FIG. 2 (or one, three or more wheels). One or more guideway tubes may be provided in this invention. Indeed, end face 28 of first panel 24 may be provided with two laterally spaced guideway tubes 32 as shown here. Where two or more guideway tubes are provided these are typically laterally spaced so as to provide a guiding action to mill 11 over a lateral extent of end face 28 of panel 24.

FIGS. 3Ai to 3Aiii show stages 1 to 5 of a method of installing a diaphragm wall according to a second embodiment of the invention. Plan and/or side views of trenches and panels at various stages of constructions are shown.

In stage 1, a first trench 40 is excavated in soil 44, using, for example an existing excating machine, such as a grab. The first trench 40 is continuously filled with slurry 42 as the excavation progresses to prevent the trench collapsing (as is standard practice).

Typically the dimensions of the trench will be 2 m to 8 m in length 'L' (or longer) by 0.6 m to 2.4 m width 'X' by 20 m-120 m depth 'D'. The length of the trench will vary depending upon the ground conditions, the site considerations and the requirements of the diaphragm wall. One or more reinforcement cages may be used. The excavating grab or mill width is chosen to suit the required trench width. The overall width of the cutting wheels of the cutting machine of the present invention for preparing the end face 28 of concrete panel are typically of similar width as the width of the excavating grab or mill that first excavates the trench. The overall width of the body of the cutting machine of the present invention will be less than the width of the excavating grab or mill that first excavates the trench.

Prior art excavator grabs or mills are used to excavate the trench and exert equal digging or cutting force on both sides of the grab bucket halves, or opposing cutting wheels (and therefore encounter balancing resistance). In the present invention it is preferred to cut along a single face of a single panel at one time. This allows a method of placing adjacent panels one after another (in series) to be used as well as first placing two concrete panels and subsequently placing a third concrete panel in between.

At shallow depths, other forms of joint preparation may be used such as peel off end stop formers. In one example embodiment of the present invention, in very deep trenches, such peel off end stop formers may be used at the shallow depths (up to 20-30 m) to prepare or to partially prepare the panel end face, and the deeper depths may be prepared according to the present invention.

In stage 2, a reinforcement cage 48 is lowered into the slurry filled trench 40. Typically the reinforcement cage 48 is made from bars 50 such as steel bars in a suitable arrangement and density for the size and shape of the trench and the desired diaphragm wall purpose. The reinforcement cage 48 comprises a guideway tube 32 at one end (or at both ends if the panel being constructed is a starting panel in a diaphragm wall or a panel in between two further planned trenches) The guideway tube may be lowered separately along the height of the end face of the slurry filled trench 40, but, if a reinforcement cage is to be used, it is convenient to attach it to the reinforcement cage and lower it at the same time. The guideway tube 32 is typically hollow and may be sealed at its lower end and along its length to prevent ingress of slurry 42. A sealed guideway tube may be filled with liquid such as water as it is lowered to aid its descent.

In stage 3, the slurry 42 is displaced from the first trench 40 by introducing concrete 46 into the bottom of first trench 40. The guideway tube 32 is now concreted into first panel 24 adjacent end face 28.

In stage 4, a second panel trench 52 is dug adjacent end face 28 of first concrete panel 24. Second trench 52 is filled with slurry 42 to prevent its collapse. Due to the depth of the trench, and the variation in verticality of both the end face 28 of the first panel 24 and the end of the second trench 52, a narrow soil column of varying width may be left adjacent the end face 28 of first concrete panel 24 and the end of second slurry filled trench 52. The width of the remaining soil column, if any, is probably less than 0.5 m, for example 100-300 mm.

In stage 5, a cutting apparatus according to the invention, here mill 11, is used to cut along the length of the end face 28 and along the end of second trench 52 so as to join these together. A guide 34 is provided on the mill 11 opposite mill body 12, and preferably as close to cutting wheel 18 and the cutting zone 38 as possible. The guide is slotted into the guideway tube 32 and guides the position of the cutting zone 38 of cutting wheel 18 with respect to the end face 28 of first concrete panel 28. Furthermore, the cutting wheel is arranged with respect to the guide so that the cutting wheel also cuts away a portion of the guideway tube along its length allowing ingress of slurry 42 into guideway tube 32. The cutaway portion of the guideway tube 32 may be removed completely or may be cut open, in either case it is cut away to allow ingress of slurry (and later concrete). The guide 34 may be provided laterally opposite the cutting wheel 18 and the cutting zone 38. In such circumstances, that portion of guide 34 in that region may be thinner than elsewhere to avoid being cut by wheel 18.

Due to variations in verticality and tolerances in the various elements (guide(s), guideway tube), the cutting wheel may not cut along the entire length of the guideway tube 32 but it cuts along at least a portion of its length and preferably over substantially all the length of guideway tube 32. Further the cutting wheel is arranged to cut about a portion of a periphery of the guideway tube (in a direction generally perpendicular to its length), in the region of a sacrificial wall element of the guideway tube as will be described later. Thus an elongate slot is opened up along the length of the guideway tube 32 about a portion of its periphery (in a direction perpendicular to its length) and along its length. The guide supports 36 travel in this elongate slot (breaking any remaining sacrificial wall element if necessary) as guide 34 travels in guideway tube 32. Furthermore, sufficient peripheral wall of the guideway tube remains about its periphery (in a direction perpendicular to its length) and the guide is of sufficient size so that the guide 34 is retained in the guideway tube 32 even after the guideway tube sacrificial wall element has been cut away. Thus, the guide 34 acts as an anchor in guideway tube 32 resisting sideways movement of the mill 11 away from the end face 28 of concrete panel 24.

In the event the guideway tube is not being cut by the cutting wheel, the appropriate cutting wheel may be removed for inspection and replacement of any worn cutting teeth and the wheel may be reset.

In this embodiment of the present invention, a prepared end face 30 of first concrete panel 24 is revealed by the cutting action of mill 11, and a slurry filled recess in the form of cut guideway tube 32 concreted in the first panel 24 is opened up. This prepared face forms a clean, well defined, accurately positioned surface with which to form a joint with the neighbouring panel. This slurry filled recess formed by cut guideway 32 is in fluid communication with the second panel trench 32 so that when concrete is poured (not shown) into the second panel it fills the slurry filled recess (displacing slurry) in the guideway tube 32 concreted into the first panel thereby providing interengaging keying features between the panels forming a construction joint. Thus, a construction joint is provided between the two adjoining panels by cutting an end face 28 of the first concrete panel using an apparatus according to the invention having a guideway tube with a sacrificial wall element concreted into the end face of the first panel, and a cutting machine and guide for engaging with the guideway so as to guide (and preferably also anchor) the cutting machine during cutting.

Additional steps such as first replacing slurry 42 with clean slurry to ease pour of concrete 46 into the first or second trench may be carried out without departing from the scope of the present invention.

FIGS. 3Bi and 3Bii show optional stages 6 to 7 of a method of installing a diaphragm wall according to the first embodiment of the invention. In step 6, a second reinforcement cage having a guideway tube 32 at one end may be placed in the slurry filled second trench. In step 7, the slurry 42 is displaced by concrete 46 being introduced at the base of the second trench. The steps may be repeated with any suitable variations until a completed diaphragm wall is provided. If a closed diaphragm wall is required, such as for use in a shaft, then the first panel trench may include a guideway tube at either end so as to form a continuous wall with each construction joint between adjacent panels being formed according to one or more embodiments of the invention.

Connections 54 between the guideway tube 32 and the reinforcement cage 48 may be arranged to provide some limited movement between the guideway tube 32 and reinforcement cage 48.

FIG. 4 shows a plan view of a diaphragm wall constructed according to a second embodiment of the invention with an optional second panel reinforcement key element 54 in second panel 25 for engaging in cut guideway tube 32 of neighbouring first panel 24. The key element may be attached to a reinforcement cage 48 of second panel 25 and lowered along with the reinforcement cage 48. Key element 54 may comprises a single elongate key element that extends over a substantial portion of the height of the cut guideway tube. Optionally, the key element 54 is flexible along its length. Several smaller, but still typically elongate key elements 54 may be provided. Alternatively the key element(s) 54 may be separate from the reinforcement cage 48 and may be lowered into cut guideway tube 32 separately.

The key element has a protruding portion for engaging with the cut guideway tube 32. The protruding portion is typically of larger dimension than the cut slot along the length of guideway tube 32 so that this cannot be extracted laterally out of cut guideway tube 32.

FIGS. 5*i* and 5*ii* show plan and side views of two adjacent panels illustrating a method of joining two such panels, such as first and final panels in a closed loop diaphragm wall according to a third embodiment of the invention. Here, a first concrete panel 40 and a penultimate concrete panel 60 have a last slurry filled trench 58 excavated in between them. The opposing end faces of first panel 40 and penultimate panel 60 each have a guideway tube 32 concreted in (typically attached to reinforcement cages 48). Mill 11 is used to mill along the respective end faces of first panel 40 and penultimate panel 60 to prepare, for each concrete panel, a cut end face and a cut guideway tube 32, which fills with slurry as the cut of the end face is made. Expected lines of cut of the cutting apparatus of the invention, such as mill 11, are shown at 62 and 64.

FIGS. 6*i* and 6*ii* show a side elevation and plan view of an example reinforcement cage having two keying elements one each at respective ends thereof for use in the third embodiment of the invention according of a fourth embodiment of the invention. A double ended reinforcement cage 148 may be used having key elements 256 for engaging in cut guideway tubes 32 of panels 40 and 60 as the reinforcement cage is lowered into the slurry filled intervening trench 58. To reduce the risk of the double ended reinforcement cage sticking as it is lowered there is some flexibility of movement of the key elements 256. For example, these may be flexibly mounted on reinforcement cage 148, and/or these may be flexible along their lengths and/or these may each comprise individual sections that move independently and are spaced along the height of the reinforcement cage 148.

FIG. 7A shows plan views of components of a guideway tube 32 and associated support illustrating its construction and FIG. 7B shows a side elevation view of the guideway tube and support. A steel pipe 68 of, for example 100 mm diameter and ±5 mm wall thickness is provided (step 1) and has a slot 70 cut in it along its length by any suitable cutting means. The slot 70 extends, to a limited extent, about a portion of the periphery of the pipe (perpendicular to the longitudinal axis along the pipe); here a 50 mm wide slot is cut. Typically the angular extent "a" of the slot is or is less than 90°, and more preferably is or is less than 60°. Thus, depending sections 66 of pipe 68, being the free sides of the pipe 68 extending towards slot 70, are provided ensuring that the slot 70 is narrower than the pipe diameter. Typically, widths dl of each depending sections 68 across the cross-section of the pipe 68 are more or less equal.

A T-section 72 having a flange 73 and rear cross panel 75 with throughbore holes 74 therein is welded at 76 to the rear of the pipe opposite slot 70 (steps 3 and 4). A sacrificial tube 78 of sacrificial material such as plastic (PVC for example) of slightly larger diameter, say 110 mm has a narrow slot 80 cut along its length (step 5). In step 6 the sacrificial tube 78 is slid over the steel pipe 68. The slot 80 of the sacrificial tube 78 is located over weld 76. Further, the sacrificial tube 78 covers slot 70 to form a sacrificial element 82 about the periphery of the combined pipe structure and along its length. The sacrificial tube 78 seals slot 70. Typically, this is because tube 78 is slightly resilient and is sized to grip the outer surface of pipe 68. Thus, a guideway tube 32 is formed having a sacrificial element 82 which extends about a portion of the periphery (in the region of slot 70). Here, the sacrificial element extends over the circumference of the guideway tube 32 as the guideway tube 32 is circular. Alternative shapes of pipe 68 and sacrificial tube 78 to form guideway tube 32 can be envisaged such as square, rectangular, hexagonal etc.

Referring to FIG. 7B, it can be seen that flange 73 and rear panel 75 forming T-section 72 extend continuously over the length of guideway tube 32 to a height H. The height H may be several tens of meters long, sufficient to install in a trench of desired depth.

FIG. 8 shows a plan view of an example guideway tube assembly comprising two laterally spaced guideway tubes 32 for fixing along a height (optionally of a reinforcement cage) to form a ladder type guideway tube assembly 92. T-sections 72 are bolted or otherwise fixed to steel straps or cross bars 84. These serve to space the guideway tubes 32 laterally apart from one another for cooperating with similarly laterally spaced guides 34 on mill 11. Typically, cross bars 84 are spaced along the length of the guideway tubes 32 to form a ladder type structure. Once this is concreted in (typically after fixing the ladder type structure to the reinforcement cage—see FIG. 9—and lowering the modified reinforcement cage into a slurry filled trench) the cross bars 84 serve little further purpose as the guideway tubes are held fast in place by the concrete. Laterally spaced guideway tubes 32 to assist in guiding the mill 11 with respect to sideways movement across an end face 28 of a concrete panel in addition to guiding, and preferably anchoring mill 11, to end face 28 so as to resist lateral movement perpendicularly away from end face 28 during milling.

FIG. 9 shows a plan view of the guideway tube assembly 92 of FIG. 8 fixed to a reinforcement cage 48. Fixings 88 and spacers 90 locate the guide tube assembly 92 with respect to the reinforcement cage 48. In this example the separation of the sacrificial wall elements in the two guideway tubes 32 is determined by the separation W1 of the T-sections 72.

Referring briefly to FIG. 25, a plan view of an alternative guideway tube assembly 92*a* is shown. Here guideway tube assembly 92*a* comprises two laterally spaced guideway tubes 32 integrally formed with a cross bar bracket 93*a*. The cross-bar bracket 93*a* is bolted rigidly to reinforcement cage 48.

FIGS. 10A, 10B and 100 show a bracket 69 formed from a short length of "T"-section connected to a short length of steel pipe 68 for use in supporting a pipe of sacrificial material (see 78 in FIG. 10D) in an alternative guideway tube, particularly suitable for use when no tension connection (across steel reinforcement) between neighbouring concrete panels is required. In step 1, an 80 mm long section of steel pipe section 268 has a 50 mm wide slot 70 cut along its length. In step 2, a rebate 71 is cut along a rear of pipe section 268 opposite slot 70. A flange 73*a* of the same or similar height (along the pipe) as the pipe section 268 is welded to the pipe section 268 at weld 76. Throughbore holes 74 are provided in flange 73*a*.

FIGS. 10Di and 10Dii show front elevation and side cross sectional elevation (along line CC') views of a ladder type guideway tube assembly 192 comprising two laterally spaced sacrificial pipes 78 of sacrificial material and vertically spaced supporting brackets 268 on each sacrificial tube 78 along its length. The brackets 268 are bolted to L sections 81 which in turn are bolted to cross bars 84 by bolts 79 as shown in FIG. 10E. Other types of fixing such as welding could be used.

A side cross sectional view of guideway tube assembly 192 along line CC' is seen in FIG. 10Dii. The vertical separation of the brackets 268 is typically regular and is denoted by L1. A guide 34 is shown in dotted lines within the guideway tube 32 formed from sacrificial tube 78 and bracket 268. The length of the guide 34 is L2. Typically, in this alternative embodiment of a guideway tube 32, the length L2 of the guide is greater than L1 the separation of brackets 268 and preferably greater than 2×L2, i.e. more than double the distance separating the vertically spaced brackets 268. Therefore the guide 34 is held within the guideway tube by at least two brackets 268 no matter what its position along guideway tube 32.

Referring now to FIGS. 10F, 10G, 10Hi to Hiii and 10I*i* to 10Iiii, these show an alternative bracket 268' and an alternative ladder assembly 192' and part of the framework of a reinforcement cage 48. The bracket 268' has a circular wall portion part of which has been cutaway at gap 70. The bracket 268' is typically made from steel. The pipe 78 of sacrificial material is threaded along into the series of brackets along the ladder assembly 192'. The outermost surface of the sacrificial material is contiguous with the inner most surface of the brackets 268'. The guideway tube 32 (not labelled) here comprises the pipe 78 of sacrificial material and the brackets spaced therealong. The guideway tube is sealed at its lower end and prevents ingress of slurry or concrete until the pipe is cut open, in the region of the pipe along the gap 70 of brackets 268'.

Each bracket 268' is provided with one or more depending portions 177 that can be used for welding or bolting about a (in use vertical) rod of the reinforcement cage 48. A cooperating rear element 178 may be used. The depending portions 177 and cooperating element 178 may each be u-shaped so as to provide a gap to accommodate a rod of the reinforcement frame 48.

Two cross bars or straps 84', 84" may be used to hold a pair of brackets spaced apart (in use typically in a horizontal direction). Thus the guideway assembly may comprise two or more spaced apart guideway tubes 32 (for example, each comprising tube 78 and a series of brackets 268').

Referring briefly to FIG. 26, there is shown a side-elevation view of an alternative supporting bracket 268*a* mounted in a ladder assembly. Here a single supporting bracket 268*a* comprises two vertically (in use) spaced supports 73*b* connecting to cage 48 via mounts 73*c* to form a robust (square section) mounting arrangement for guideway tube 32.

FIG. 11A shows plan views of a guideway tube during construction suitable for use when a tension connection between reinforcement in neighbouring panels is required across the joint. In step 1 a hollow section steel pipe is cut into sections to correspond to the height of the reinforcement cage to which it is to be attached. In step 2 a slot 70 of angular extent 'a' about the periphery of the pipe 68 is cut along the pipe length. In step 3 several holes are bored through the pipe section 68 along its length and reinforcement bars 50 are attached using suitable fixings such as nuts and bolts. In step 4 a plastic pipe 78 of similar length and slightly larger diameter has a slot 80 cut along its length. In step 5 the plastic pipe section is lid over the steel pipe section 68 to provide a cover for slot 70 in steel pipe 68, the cover being of sacrificial (here plastic) materials to form a sacrificial wall element 83 in guideway tube 32. Typically, the slot is sealed (to prevent ingress of slurry and/or concrete) until the sacrificial wall element 82 is cut during joint preparation. The pipe 78 may be of suitable (e.g. resilient) material and of suitable dimensions and shape to provide such a sealing action about pipe 68 over slot 70.

FIG. 11B shows a side elevation view of the guideway tube 32 formed in step 6 into a ladder assembly suitable for fixing to a reinforcement cage. FIG. 110 shows a side elevation view of the ladder assembly viewed in the in the direction of arrow 200. Once in place in a concrete panel and subsequently cut, keying elements 87*a* and 87*b* of a reinforcement cage of a neighbouring panel mounted on reinforcement bars 50 may be located in one or more positions up and down guideway tube 32. Concrete (not shown) can flow into the cut guideway tube 32 (see arrow 300) and can concrete in keying elements 87*a* and 87*b* into the guideway tube to form a tension joint across neighbouring panels. Keying elements are typically formed from short hollow steel sections fixed to reinforcement bars 50 connecting into the cage of the neighbouring panel (as seen in FIG. 11E).

FIG. 11D shows a plan cross-sectional view of the guideway tube 32 showing an alternative guide 234 travelling in the guideway tube 32. Here guide 234 comprises cross members (such as bars or panels). Guide 234 comprises here (or indeed in other embodiments of guide 34) one or more or a number of resilient or spring loaded members 236 distributed about its outermost edges for facilitating travel of the guide 234 (or guide 34) in guideway tube 32 during cutting. The depending sections 66 of pipe 68 resist sideways movement of the guide out of the guideway tube 32.

FIG. 11E shows a plan cross-sectional view of the guideway tube 32 interengaging with a tension connection assembly 187 of a neighbouring panel. Tension connection assembly 187 comprises a keying element (such as keying elements 87*a* and 87*b*) fixed by locking nut 85*a* to a reinforcement bar 50 of a reinforcement cage (not shown) of the neighbouring panel. The depending sections 66 of pipe 68 resist keying element 87 from moving out of slot 70 during pouring of concrete or subsequently.

FIGS. 11F and 11K show a guideway tube with an alternate tension connection assembly between neighbouring panels comprising a protruding key element (302, 304) mounted on a bar 50 within guideway tube 32'. The protruding key element (302, 304) can be viewed as an anchoring element anchoring one panel to the next.

A threaded tube 89 typically of square section and made from steel is welded or bolted to the rear of the guideway tube 32' to enable the guideway tube to be mounted on a bar 50 of a reinforcement cage of a first panel.

Guideway tube 32' here comprises a continuous circular pipe 78' of sacrificial material surrounding a continuous circular pipe 68, typically made of steel. The pipe 78' of sacrificial material (elsewhere described more generally as the second tube) and the steel pipe 68 (elsewhere described more generally as the first tube) are in close contact with one another so that a seal is formed to prevent the ingress of slurry or concrete into the guideway tube 32' until the sacrificial material is cut in the region of cut 70. For example the pipe 78' of sacrificial material may be slightly resilient and may be expanded slightly to form a resilient seal over the outermost surface of pipe 68. In this and other embodiments the pipe 78' of sacrificial material and the steel pipe may have other cross-sectional shapes but a smoothly varying profile is preferred such as oval or circular. This assists in providing strength to the pipe of sacrificial material to withstand the pressure of slurry and concrete at greater depths than hitherto, preventing ingress of slurry and concrete until the pipe of sacrificial material is cut.

The protruding key element (302, 304) may be of any suitable form and in this example embodiment comprises a disc shaped protruding member 304 mounted, optionally pivotally mounted, on a steel reinforcement bar 50 of a reinforcement cage. A locking nut 85*b* fixes this in place on steel bar 50. The protruding key element (302, 304) may be slidably mounted on bar 50, and/or bar 50 may be slidably mounted on reinforcement cage 48 (of a second panel), in either case to enable a limited of amount of play or movement 'Y' of the protruding key element to assist in the installation of the protruding key element (302, 304), and more typically a number of the protruding key elements, down the guideway tube 32. This installation typically takes place along with installation of the reinforcement cage 48 of a second panel. In this example embodiment the protruding key element also comprises a positioning element 302 to assist in positioning the protruding member 304 within guideway tube 32'. In this example embodiment, the positioning element 302 comprises a number of legs (see 301 in FIG. 11H) having one or more curved outer corner portions 303 for engaging with an innermost surface of the steel pipe 68. As can be seen in FIG. 11H, the positioning element here comprises four equally angularly spaced arms attached to a central hoop 305 which moves freely on bar 50. Nevertheless the movement of the positioning element 302 is restricted to the central portion of the guideway tube 32' by the engagement of the curved outer corner portions 303 of the arms 301 of positioning element 302 with the inner wall of the guideway tube (here the inner wall of the steel pipe 68).

The disc shaped protruding member 304 may be circular in shape. It is held centrally (FIG. 11F) within the guideway tube or to the rear of a central portion of the guideway tube 32 relative to cut section 70 (FIG. 11K) or the cutaway sacrificial wall element by means of the positioning member 302. Thus in FIG. 11K a front most edge 'a' of the disc shaped protruding member 304 lies rearward of a central diameter 'b' of the guideway tube 32' by the action of the positioning member 302 and curved outer corner portions 303'. The disc shaped protruding member 304 may be of similar size as the width of gap 70 or it may be slightly wider. When in use if tension is applied to the bar 50 the protruding key element (302, 304) here (FIG. 11F) comprising a disc shaped protruding member 304, held centrally within guideway tube 32', exerts a force in a direction 400 against the depending portions 66 of the guideway tube 32', However a force is also exerted along the direction of bar 50.

Other types and forms of protruding key elements that can function as anchoring elements in tension connections between panels can be envisaged. One such alternative, also in two part form although this is not required, is a particularly advantageous embodiment, and this is shown in FIGS. 11G and 11L. Here the protruding key element (302, 306) comprises a conical shaped protruding member, here a truncated cone protruding member 306 which may have any suitable cross section such as circular or rectangular. A front face of the truncated cone protruding member 306 has a width B smaller than the width of gap 70 which is labelled A1. The rear face of the truncated cone protruding member 306 has a width A2 which may be larger than width A1 the gap 70 or of roughly the same dimension. The angled side faces of the truncated cone protruding member 306 are now roughly perpendicular to the expected direction of force 400, directing the bulk of the force at the depending sections 66 of the guideway tube 32'. The smaller front face of width B engages with the concrete surrounding it and when under tension exerts a comparatively smaller force in a direction along the bar 50, than the embodiment of FIGS. 11F and 11K.

It is of note that in FIGS. 11K and 11L the positioning element 302 and associated arms 301 (see FIG. 11H) curve slightly forwardly of the hoop 305 before curving rearwardly towards the rear of the guideway tube (32 (relative to gap 70), this arrangement assists in keeping the central hoop 305 of the positioning element 302 centrally located in the guideway tube. Thus the curved outer corner portions 303 now lie forwardly of the hoop 305 so as to engage the inner wall of the guideway tube 32 as the hoop moves away from a central position within the guideway tube. It should also be noted the protruding member 306 in FIG. 11L lies rearwardly of the centre of the guideway tube, its front face (not labelled) being roughly in line with and adjacent to the hoop 305.

FIG. 11H illustrates various steps in its manufacture and implementation of the alternate tension connection assembly of FIGS. 11F, G, K and L. A steel pipe has a gap 70 cut out and square section 89 threaded internally (at 91) welded to it at various points along its length. For clarity the second tube, here a pipe of sacrificial material, is not shown. A protruding key element (here 302, 304) is mounted on a bar 50 and slid into place (down the steel pipe 68). A close up front view of the positioning element 302 is shown having four arms at 301 and curved outer corner portions 303 at the ends of each arm to engage the inner surface of the steel pipe 68. The hoop 305 is large enough to allow the positioning element 302 to spin on the bar 50 again facilitating its descent in the pipe 68 of the guideway tube. Once the gap 70 is cut away from the pipe of sacrificial material (not shown) then concrete can enter into the guideway tube surrounding the protruding key element (302, 304 or 302, 306) and anchoring it in concrete. The protruding member 304 306 of the protruding key element (302, 304, or 302, 306) protrudes into the concrete and is anchored within it resisting extraction from the guideway along the direction of bar 50. To a certain extent in the case of protruding element 304 and more so in the case of protruding element 306, this is because the concrete between these protruding key elements 302, 304 and the depending sections 66 of guideway tube 32 (and of pipe 68) is compressed (in direction 400) by the action of pulling in the direction of bar(s) 50.

FIG. 11I shows a further alternate tension connection assembly between neighbouring panels in which a solid protruding key element 306' is shown comprising a solid protruding member 306 which is sized and shaped to fit closely within the pipe 68. Whilst the anchoring capabilities of such a protruding key element works well and it is positioned centrally within the pipe 68 (by virtue of its edges engaging the inner wall of pipe 68), it would be more difficult to install than other embodiments of this aspect of the invention. Nevertheless, protruding key elements that comprise a single component for example a protruding member that acts both as a positioning and anchoring member could be envisaged from the enclosed description.

FIG. 11J shows the tension connection assembly of FIG. 11F. Both FIGS. 11I and 11J show the direction of the pulling forces F1 when two neighbouring panels (for example in a shaft or linear wall) are under tension, for example due to horizontal loads such as when these are holding back soil and/or water.

FIG. 11L shows a plan cross-sectional view of a guideway tube with a further alternate tension connection assembly between neighbouring panels with the alternate positioning element of FIG. 11K and the truncated cone protruding key element of FIG. 11G.

FIG. 12 shows an alternative guideway tube assembly 292 comprising an alternative guideway tube 232 and a T-section 102.

Guideway tube 232 comprises a back plate 105 which is fixed (by bolts or welding—not shown) two opposing square section, U-shaped steel sections 94. Opposite back plate 105, a gap between the opposing free ends of the U-shaped steel sections 94 provides an elongate slot 98. Back plate 105 and U-shaped sections 94 may be provided as a single section, typically in steel. Back plate 105 is welded to T-section 102. A square section outer PVC tube 96 surrounds U-shaped sections 94 to close slot 98, sealing slot 98 to prevent unwanted ingress of slurry or concrete.

In one embodiment (not shown) PVC tube 98 is substantially contiguous with U-shaped section 94 over their respective inner and outer surfaces. In contrast in the embodiment shown in FIG. 12, an elongate void 106 is provided between the outer periphery of the U-shaped steel sections 94 and the inner periphery of the elongate rectangular tube 96. Void 106 is filled with void forming material 108 (typically polystyrene) to from a sacrificial wall element 82.

During cutting (typically milling) of an end face of a concrete panel in which guideway 232 is installed, the sacrificial wall element 82 formed by the void filling material in void 106 and associated PVC tube 96 is cutaway. An expected line of cut 110 is shown, the actual line of cut may vary and no void forming material 106 or a greater thickness of void forming material 106 may remain. As mill 11 descends cutting the end face of the panel, one or more guides 34 would travel within U-shaped steel sections 94. The guides 34 are mounted on supports 36 on the mill 11 and these travel in slot 98 between U-shaped sections 94. Any remaining void forming material 108 is sufficiently brittle to be broken by the supports 36 travelling in slot 98. The void forming material may be polystyrene or the like.

FIG. 13A shows a mill 11 having mill body 12 and a mill wheel 18 cutting an end face 28 of a concrete panel 24 with a guideway tube 32 installed in the end face 28 according to the invention.

Typically, the guideway tube 32 is within around 100-300 mm of the actual outermost end surface of end face 28 of concrete panel 24. The guideway tube 32 is typically within around 200 mm of the actual surface of end face 28 of concrete panel 24. Thus the cutting wheel 18 has to mill through 100-300 mm of concrete in addition to milling the distance required to remove at least part of the sacrificial wall element 82 from the guideway tube 32 along at least part of the length of the guideway tube 32. Consideration of the tolerances involved is important therefore.

Referring to FIGS. 13B and 13C a guideway tube 32 having a sacrificial wall element 82 is shown in relation to the cutting teeth 118 of rotating cutting wheel 18. Cutting wheel 18 rotates about a horizontal axis. Dotted line box 120 illustrates the positional tolerance for the system optionally, including allowance for wear of teeth 118. Preferably a centrally positioned tooth 122 in the lateral (in use horizontal) direction with respect the guideway tube 32 is slightly longer than its neighbours to positively engage the sacrificial wall element 82 of guideway tube 32 when the neighbouring teeth engage the surrounding concrete of end face 28.

The guide 34 may preferably be provided with one or more centralising projections 116 to facilitate location of guide 34 centrally within guideway tube 32 and/or to facilitate travel along guideway tube 32. Centralising projections may be spring loaded and/or comprise resilient material and/or comprise wheels and/or comprise bearings to facilitate travel of the guide 34.

FIG. 13D shows guide 34 and guide support 36 travelling in the aperture formed by milling away of sacrificial wall element 82 in the region of slot 70. Even if the aperture is poorly formed or not formed at all, the weight of mill 11 and the upwardly outwardly steeply sloping wall of lower guide support 36 (seen in FIG. 13A) would break through any remaining sacrificial material with little difficulty.

FIGS. 14A, 14B and 14C show an alternative milling machine 211 having three (optionally four) cutting wheels. As will be appreciated by those skilled in the art from the disclosure contained herein, one or more cutting wheels may be used. These may be spaced apart laterally (horizontally and/or vertically, in use). The arrangement shown in FIGS. 14A, 14B and 14C is particularly advantageous as it results in a shear key rebate being formed in the end face 28 of a concrete panel 24.

Here mill 211 comprises a mill support frame 124, a hydraulic motor and connecting power train 126, an upper wheel drive chain 128, an upper central cutting wheel 130, a gearbox 133, lower wheel drive train(s) 134 and two spaced apart lower wheels 136. An optional central lower wheel 136*a* may be provided.

Lower wheels 136 may engage the sides of faces of the trench during its descent whilst cutting end face 28. Therefore lower wheels 136 may also be provided with cutting teeth 138 on their side faces.

As with the mills seen in FIGS. 1 and 13A, the guide 34 extends along guideway tube 32 and has a length more or less that of the milling machine. One or more separate, vertically spaced guides may be provided but it is thought that a single element guide 34, preferably extending over the height of at least the cutting region of the mill, or more preferably over the height of the mill itself provides more guidance to the motion of the mill with respect to the guideway tube.

The guide supports 36 define the lateral distance of the mill 11, 211 from the guideway tube 32 and this distance is held constant within tolerances, over the extent of the guide. Thus a longer guide provides a greater height of guideway tube 32 over which the lateral distance between the guideway tube and the mill 11, 211 is controlled.

In FIG. 14A two laterally spaced guideway tubes 32 are provided (not shown). The lateral separation of guideway tubes 32 is determined by the required lateral separation of the lower guide wheels 136. The upper cutting wheel 130 may protrude further out than lower cutting wheels 136 to provide a centrally positioned shear key rebate, in between guideway tubes 32 in end face 28 of the concrete panel 24 (see example 158 in FIGS. 16A and 16B).

FIGS. 14D, 14E and 14F show an end face 28 of a first concrete panel and a milling machine according to an example embodiment of the invention. A mill support frame 124 carries a lower wheel 136' which has a number of teeth 137. Only a few teeth 137 are shown for clarity. These teeth may be of any suitable kind; for example, bullet teeth (also known as picks) such as those available on milling drums from the WIRTGEN GROUP. As will be described later, a cutting mechanism of the invention may comprise one or more of teeth such as bullet teeth 137 and/or one or more sawtooth blades comprising one or more sawtooth teeth, and/or one or more rotatable cutting wheels. For convenience, the following description will refer to bullet teeth.

A first concrete panel 24 has a ladder assembly according to the invention installed therein comprising at least two laterally spaced guideway tubes 32. Here the guideway tubes 32 comprise a continuous pipe 78 of sacrificial material held in a series of (vertically) spaced apart steel brackets 268. The ladder assembly (not labelled) is mounted on a reinforcement cage 48 of first panel 24. As the cutting wheel 136 (here a milling drum) descends, it is driven to rotate by a motor (not shown), positively cutting the concrete and any intervening soil column along a line of cut 110, also simultaneously cutting the sacrificial material of pipe 78 in the gap 70 (not shown). A guide 34 travels within the guideway tube 32 enabling correct positioning of the cut line 110 with respect to the first concrete panel 24 and the guideway tubes 32 concreted within it.

Referring briefly to FIGS. 27*i* to 27*iii* and 28, two alternative milling apparatus according to embodiments of the invention are shown. The cutting mechanism is in the form of two cutting elements. The first cutting element is a single (here driven) milling wheel 18. The first cutting element cuts along the height of the concrete wall. The second cutting element comprises a series of passively rotating cutting wheels 324 located on mill wheel support 36 so as to engage and cut the sacrificial portion of guideway tube 32 from the inside as the milling apparatus descends. This will be described in more detail in relation to FIGS. 24A and 24B. Whilst two cutting elements are described here one or both may be used.

Two alternative driving systems for mill wheel 18 are shown, one is mounted on an internal driven axle (FIGS. 27*i* to 27*iii*), the other is driven by an external drive belt (FIG. 28) which allows a greater depth of concrete to be removed, as the axle hubs do not protrude and so impede operation.

Three pairs 34*a*, 34*b*, 34*c* of guides 34 are shown. In use, the guides in each pair 34*a*, 34*b*, and 34*c* are spaced horizontally, and the pairs are spaced vertically to guide the mill 11 over most or all of the lateral and vertical extent of the mill 11. To reduce the risk of the guides 34 getting stuck due to tolerance problems, one guide may be fixedly mounted to the body of mill 11, and the other guides may be hingedly mounted in one or two directions for example, in two orthogonal directions, such as vertically along and horizontally across the face of the concrete panel). Thus one guide may be fixedly mounted and the remaining 5 guides hingedly mounted. Alternatively all six guides 34*a*, 34*b*, 34*c* may be hingedly mounted. Limited movement hinges may be used. The number and spatial arrangements of guides may be varied to suit the practical situation.

FIG. 15 shows the installation of a waterbar 140 (a water flow impeding element). In stage 1, a guideway tube 32 is cast in a panel and the sacrificial wall element is substantially cutaway according to the invention. In stage 2 a PVC pipe 142 with a PVC extrusion 144 is lowered into the guideway tube 32. Pipe 142 is optionally rigid. Waterbar 140 may comprise other types or material and/or arrangements of resisting waterflow. Here, waterbar 140 comprises plastic such as PVC in a pipe with a plastic extension 144 having a convoluted surface welded to it (weld 146). The convoluted surface or plastic extension 144 provides a convoluted path (W) for waterflow to creep through the joint formed between first and second concrete panels (24 and 25 in FIG. 3A). Hydrophilic material in the form of strips 152 may be positioned about the outer surface of pipe 142 within guideway tube 32. A mesh (not shown) may be used to hold the hydrophilic strips in place or may itself be hydrophilic and surround pipe 142.

In stage 3, grout 150 may be inserted into pipe 142 of water-flow impending element 140. In stage 4, concrete is poured to form second concrete panel 25. The concrete causes the hydrophilic elements 152 to swell impeding water ingress through the joint around the back of pipe 142 and forcing water to adopt a convoluted path W around convoluted shaped extension 144 to pass through the concrete joint 210.

FIGS. 16A and 16B show a further guideway assembly 172 having two spaced guideway tubes 32 attached to a reinforcement frame 48 in a similar manner to that shown in FIG. 9. In between laterally spaced guideway tubes 32 is a water-seal tube 154. Water-seal tube 154 may be plastic such as PVC. Other sacrificial materials may be suitably used as would be understood by those in the art. Water-seal tube 154 is an elongate tube fixed to crossbars 84 which in turn are fixed to reinforcement cage 48. Preferably the water-seal tube 154 is slightly set back from an end face 28 of first concrete panel 24 so as to allow for an indentation in the expected line of cut 156. Thus, the slightly protruding upper wheel 130 of mill 211 of FIG. 14A may be used to mill a rebate 158 in the end face 28 of first concrete panel 24 and to remove sacrificial wall element 282 from waterseal tube 154.

As seen in FIG. 16B, a waterflow impeding element 140 with a convoluted extension may then be inserted into waterseal tube 154 for providing a waterbar within rebate 158 of concrete joint 210, as described with reference to FIG. 15. In this case, no tensioning between reinforcement cages of neighbouring concrete panels has been provided and guideway tubes are simply filled with the concrete of second panel 25 when this is poured to form a constructing joint 210 with waterbar 140.

Tensioning across one or more guideway tubes 32 between neighbouring panels may also be provided (for example as described in relation to FIG. 11E). Thus a plain construction joint, construction joint with shear key rebate 158, a construction joint with waterbar and optional shear key rebate, a construction joint and tension joint with optional waterbar and optional shear key rebate, and all variations and combinations thereof are provided by embodiments of this invention.

FIGS. 16Ci, 16Cii and 16Ciii show an end face guideway assembly (guideway tubes 32, brackets 268, crossbars 84) in an end of a first concrete panel, the guideway assembly having two laterally spaced outer guideway tubes 32 and a central clip 308 and supplementary tube in the form of pipe 310 for receiving a water-bar element 312 after a portion of the pipe circumference is cutaway during a cut by a cutting mechanism along a line 110. The clip 308 may be sized and shaped so that pipe 310 which is typically made of MDPE (medium density polyethylene) snap fits into it. Several clips 308 may be provided along the ladder assembly. The cutting mechanism here (typically a milling wheel with various teeth and raised teeth sections (see 316 in FIG. 23C) may also be provided with a central sawtooth blade for cutting along line 110 and also cutting along pipe 310 over at least part of its length. This is possible within the various tolerances of the cutting machines in part due to the alignment of the laterally spaced guideway tubes 32 and the guide 34 mounted on the cutting machine. Thus, in an example embodiment, in a single cut 110 (one descent of the machine of FIG. 14F for example), the two guideway tubes 32 are cut in the region of their sacrificial portions along with the front face of the first concrete panel (thus the front face being prepared so as to form a proper construction joint with a neighbouring panel). A shear key rebate 158 is also shown in the end face of the first concrete panel, also having been formed as cut 110 is made by the cutting machine.

Furthermore, in this example embodiment, a further supplementary tube in the form of pipe 310 of the same or different sacrificial material is cut in the same descent of the cutting machine to enable a water bar to be mounted therein. A waterbar 312 is provided with a hydrophilic strip 314 which is typically preinstalled in u-shaped end portions of the waterbar 312. Typically, the hydrophilic strip is resilient and is slightly compressed as it is pushed into the u-shaped end sections of waterbar 312 so as to be resiliently held in place. The waterbar 312 is slid down into place in cut pipe 310', one end passing along cut pipe 310' and along the the inward cut into the end face of the first concrete panel, the other 'free' end protruding into the trench for the second panel filled at this stage with slurry. Once this second panel is filled with concrete, the water bar 312 is securely held in place across the joint along the height of the two panels. The waterbar 312 comprising the hydrophilic strip 314 is typically connected to and therefore lowered along with the reinforcement of the second trench (along with any tension joint connection components if required).

FIG. 17 shows a method of constructing a corner in a diaphragm wall with radially cut end faces. This can be extended to a sufficient number of panels to form a shaft (such as a circular diaphragm wall) having end faces of the individual panels cut along respective radiuses of the circle circumscribed by the shaft. Variations included convoluted shaft shapes with end faces of panels cut along the radius of curvature of the required corner.

FIG. 17 shows in stage 1, two alternate concrete panels 24 and 24*a* having a gap for forming an interconnecting panel in between. Each panel 24, 24*a* has two laterally spaced guideway tubes 32 at respective end faces 28, 28*a* thereof. The plane containing the two laterally spaced guideway tubes 32 is at a small angle with respect to the end face 28, 28*a* of the panels 24, 24*a*. An expected line of cut 160, 160*a* for each panel is shown. This expected line 160, 160*a* of cut lies along the plane containing the sacrificial wall elements (not shown) of the guideway tubes 32. The panels 24, 24*a* have been cast into trenches dug along a tangent of a curve and a reinforcement cage 48 and associated guideway assembly at at least one end, comprising the guideway tubes 32, has been shaped as a part segment of a circle to provide guideway assemblies (and hence guideway tubes) that lie along a radius of the same curve. Thus, the mill is guided to cut end face 28 not in a plane parallel to end face 28 but rather along a radius of the curve (to which the panel(s) 24, 24*a* are a tangent).

In stage 2, a trench 26 is excavated and filled with slurry.

In stage 3, a mill 11, cuts along the expected line of cut 160*a*, determined by the position of guideway tubes 32, at an angle to the plane of originally cast end face 28 of panel 24*a* (along a radius). Two mills 11 are shown in dotted lines to illustrate that it may be appropriate for the mill body to fit within the trench width, when cutting an end face at an angle.

In stage 3 the intervening concrete panel 25 is cast providing construction joints 230, 230*a* that lie along the radius of curvature of the diaphragm wall. This arrangement is particularly suitable for a diaphragm wall shaft.

FIGS. 18A, 18B and 18C show how a bored pile 162 can be used as a 'panel' within the context of the invention. A bored pile 162 can be constructed into bedrock and provide additional structural capability to a diaphragm wall, especially if interspersed amongst more usual generally planar concrete panels.

Bored pile concrete 'panel' 162 comprises a reinforcement cage 348 having a guideway tube assembly, similar to that shown on FIGS. 9 and 16A and 16B, at each end. Following excavations of neighbouring (planar) panel trenches (not shown) the "end" faces of the bored pile concrete 'panel' 162 is cut along lines 164 on each side. A reinforcement cage 448 is placed in each trench, the reinforcement cage 448 having keying elements 87 for engaging with guideway tubes 32 (and in particular with depending wings 66 of guideway tubes 32) to provide a tension joint between the bored pile 162 and the reinforcement cages of concrete panels 166 and 168 once these are poured.

A water-bar W may be inserted into the sealing tube to provide a construction joint 210 with a tension connection and a water-bar between neighbouring concrete structures (e.g. between bored pile concrete 'panel 162 and a neighbouring regular concrete panel 168).

FIG. 18C shows how a bored pile 162 could be cut at an angle, along a radius of curvature of a diaphragm wall as described in relation to FIG. 17, to provide a further advantageous embodiment of a diaphragm wall shaft. Here bored pile 'panel' is in between rectangular planar panels 166 and 168 the ends of which have been cast to match the cut sides of a bored pile 162 at an angle 'b' to one another along a radius of curvature of a circle to which the plane of panels 166 is a tangent (when seen in plan view).

FIGS. 19 and 20A and 20B show further example of corner formation in a diaphragm wall according to the invention. In FIG. 19, a guideway tube assembly 172 is located at a side face of a starter panel 170. A trench 173 for a neighbouring panel is subsequently dug at an angle to panel 170. A cutting machine (not shown) cuts the side face of the starter panel 170 back to form a prepared joint surface and remove sacrificial wall element(s) (not labelled) from guideway tubes 32. A shear key rebate 158, water-bar W and tension connection assembly 187 may optionally be provided in any combination as required.

Concrete is poured in trench 173 to form a joint at the prepared joint surface on the side of panel 170.

Similarly, FIG. 20A shows a change in direction by suitable placement of a guideway tube assembly 172 at an angle to a side face of panel 170. FIG. 20B shows a change in direction by suitable placement of a guideway tube assembly 172 at an angle to an end face of first panel 170.

FIGS. 21*i*, 21*ii* and 21*iii* show three arrangements of bored piles 162 (each a first concrete 'panel' of the invention) incorporating an end face guideway assembly according to the invention and planar diaphragm wall panels of rectangular cross-section 166, 168 to form medium diameter shafts (such as 8 m to 20 m). These panels can be constructed in the manner described in relation to FIGS. 18A, 18B and 18C. Shafts having 6, 8 and 12 bored piles 162 and a corresponding number of rectangular panels (numbered 1 to 6, 1 to 8 and 1 to 12, respectively) are shown.

Typically the diaphragm wall panels are excavated between the completed bored piles 162, the mill then runs down the guideway cast into the bored piles, thus forming a joint between the bored piles and the diaphragm wall panels.

FIG. 22A shows a sequence of steps for installation of bored piles 162 (each a first concrete 'panel' of the invention incorporating two end face guideway assemblies having two spaced guideways (not labelled)) and bored piles 163 each a second concrete 'panel' of the invention joined to the bored piles 163 by means of the invention to form small diameter shafts (such as 3 m to 10 m). Four primary 162 and four secondary bored piles 163 are shown.

In FIG. 22A, rectangular portions 166' and 168' are not separate panels; these are just the rectangular shaped connection removed by the mill. The secondary bored pile 163 and the two portions 166' and 168' are in fact one monolithic structure, connected to the primary piles 162, once it has been concreted.

FIG. 22B shows a schematic plan view of connected contiguous bored pile walls to form a shaft of diameter of around 5 m with six primary piles and six secondary piles. The primary bored piles will be installed by whatever method is required or most appropriate for the soils and site conditions. The secondary bored piles may be drilled in exactly the same way as the primary bored piles but the bore would then be filled with slurry (if it was not already full) and any temporary casing used to drill the pile would be extracted (removed). The mill would then travel down the bore of the secondary pile guided by the guideways in the two primary piles on either side to form the joints.

Referring briefly to FIG. 34, steps A to D for forming a non-linear diaphragm wall shaft using apparatus according to the invention is shown. In step A. a primary shaft is excavated and back filled with slurry to prevent collapse. A circular reinforcement cage 48*a* having two laterally spaced guideway tubes 32 according to an embodiment of the invention has been lowered into the slurry filled shaft which is then filled with concrete to form a concrete filled primary shaft. In step B, a second shaft is excavated (for example by conventional means). Next a milling machine 11 according to an embodiment of the invention comprising at least one pair of two laterally spaced guides 34 (not shown) uses the guideway tube 32 and its cutting mechanism to dig a second trench 352 and to prepare a front face of the primary concrete shaft. This is repeated with the primary shaft on the other side to give a slurry filled shaft with side protrusions in step C. In step D, this is filled with concrete to give a diaphragm wall.

FIGS. 23A and 23B shows a milling machine in position cutting an end face of a first concrete panel according to a further embodiment of the invention. The milling machine has an end face cutting wheel 136 incorporating a saw blade with at least one saw blade tooth 318 and preferably a series of saw blade teeth 318. It is desirable for two rows of laterally spaced saw blade teeth (typically in the form of two spaced saw blades) to be provided on the cutting wheel 136, in addition to conventional bullet teeth 137.

A guide 34 guides the cutting position of the bullet teeth 137 and of the sawblade teeth 318 in relation to the brackets 268 forming part of the guideway tube 32. The wheel 136 is typically driven to rotate by a motor (not shown). The conventional bullet teeth 137 are positioned on the wheel 136 so as to cut concrete from the end face of the first concrete panel and any intervening soil column. The saw blade teeth 318 are arranged to cut the sacrificial wall element of the guideway tube 32. Preferably, two rows 318*a*, 318*b* of saw blade teeth are provided. As wheel 136 descends, these two rows 318*a*, 318*b* of saw blade teeth cut at spaced locations across the sacrificial wall element along the sacrificial wall element. It should be noted that mill guide support(s) 36 are typically tapered so that these push the sacrificial wall element away from the remaining guideway tube enabling slurry (and later concrete) to flow more freely into guideway tube 32.

FIGS. 23C, 23D and 23E show perspective views of a milling machine such as that shown in FIGS. 23A and 23B incorporating an additional optional lower wheel set 320 for rough cutting of the soil column and/or concrete of the first concrete panel immediately beneath the machine. Two rows 318*a*, 318*b* of saw blade teeth 318 are shown on a middle cutting wheel for cutting the sacrificial wall element from outside the guideway. Bullet teeth 137 can be seen outside and in between sawblade teeth 318. A raised portion 316 of the cutting wheel can be seen: this enables cutting deeper into the end face of the first concrete panel to provide a shear key rebate such as that seen in FIGS. 16A, 16B and 16C. The shear key rebate can be used without the waterbar seen in FIGS. 16A, 16*b* and 16C. A motor 126 may optionally be provided at the top of the machine, alternatively a further milling wheel such as wheel 322 may be provided. This may be a finer milling wheel to finish more finely the end face of the first concrete panel. Alternatively or in addition, the wheel 322 may contain a raised portion such as 316 for cutting a shear key rebate, and/or a saw blade for cutting into a pipe 310 (seen in FIG. 16C) to locate a water bar therein.

FIGS. 24A and 24B show a further alternative embodiment of a milling machine having a cutting mechanism comprising a first cutting element in the form of at least one rotatable cutting wheel here a milling wheel 136. The cutting mechanism also here comprises a second cutting element in the form of a series of four rotatable cutting wheels 324 mounted adjacent one another spaced in a vertical direction close to the guide 34. These rotatable cutting wheels are typically not driven but may be, and are arranged on the mill wheel support 36 so as to engage internally with the innermost surface of the guideway 32. The rotatable cutting wheels therefore passively score and/or cut the innermost surface sacrificial wall element of the pipe 78 of sacrificial material of guideway tube 32 as the machine descends. Each one of the rotatable cutting wheels 324 is located progressively further away from the guide 34 so as to force the sacrificial wall element to be pushed and indeed typically cut away from the remaining guideway tube 32. It can be seen in FIG. 24B that two laterally spaced rotatable cutting wheels 322*a* and 322*b* are typically provided so two spaced scores and/or cuts across the sacrificial wall element 82 can be formed widening the gap so formed in the guideway tube enabling slurry (and later concrete) to flow more freely into guideway tube 32. It should be noted that mill guide support(s) 36 are also typically tapered so that these push away the sacrificial wall element away from the remaining guideway tube widening the gap so formed in the guideway tube also enabling slurry (and later concrete) to flow more freely into guideway tube 32.

Whilst it is desirable for the sacrificial wall element 82 to be completely cut away from the wall element along its entire length, it is sufficient for enough to be cut away to enable slurry (and later concrete) to flow relatively freely into guideway tube 32. Further whilst it is desirable for the sacrificial wall element to be cut away entirely from the remaining guideway tube 32 across its entire width, it is sufficient for enough to be cut away to enable slurry (and later concrete) to flow relatively freely into guideway tube 32.

FIGS. 29A and 29B show alternative apparatus for methods for forming joints in walls using rotary drilling techniques. FIG. 29A shows a drilling apparatus 11*a* comprising a first cutting element in the form of drill 350, the drill 350 comprising a drill bit 352, rotatable drilling rods 354 and three vertically spaced drilling rod support brackets 356. Drilling apparatus 11*a* also comprises a second cutting element in the form of a series of passive rotatable cutting wheels 324, and a guide 34 for guiding the drilling apparatus in the guideway tube 32 of a previously formed concrete panel. In use, drill bit 352 rotates about a vertical axis and drills away the concrete in front of guideway tube 32. In this particular embodiment, drill bit 352 may not cut the sacrificial portion of guideway tube 32 although it may do if the tolerances of the guide 34 position relative to the reach of the drill bit 352 is so arranged. Rather a second internal cutting element in the form of rotatable wheels 324 is provided. As the drilling apparatus descends the rotatable wheels 324 cut the sacrificial portion 82 (in this case) progressively away from the remainder of guideway tube 32.

FIGS. 29Ai and 29Aii show the type of drilling apparatus that could be used if the next diaphragm wall element or bored pile had already been excavated. A rotary drill bit 352 is used to remove a semi-circle of concrete from of the end of a previously constructed diaphragm wall element or bored pile. The drill rods 354 are supported and restrained by drilling rod support brackets 356 connected to the guide 34 which is running in the guideway tube 32. Each drilling rod support bracket 356 has a ring bearing or similar to allow the drill rods to freely rotate.

FIGS. 29Bi to 29Bii show a drilling apparatus 11*b* very similar to drilling apparatus 11*a* of FIGS. 29Ai and 29Aii, except here the drilling apparatus 11*b* is provided with a temporary casing 360 to prevent the drill being affected by falling debris. The temporary casing 360 is fixed to guide 34, optionally hingedly to allow for some tolerance variation. Drilling apparatus 11*b* comprises a first cutting element in the form of drill 350, a pilot drill bit 362 and rotatable drilling rods 354. Drilling apparatus 11*b*, also comprises a second cutting element in the form of a series of passive rotatable cutting wheels 324 and a guide 34 for guiding the drilling apparatus in the guideway tube 32 as the drilling apparatus drills a pilot hole for a next wall or shaft panel that has not yet been excavated.

Thus, FIGS. 29Bi to 29Biii show the type of drilling apparatus that could be used if the next diaphragm wall element or bored pile had not yet been excavated. In this example the drilling method employs a temporary casing 360 inside which drill rods 354 connect to the top of a down-hole-hammer that in turn is attached to a pilot bit which is locked into a ring bit on the bottom of the casing. This arrangement requires the ring bit 363 and pilot bit 362 to rotate but not the casing 360. This allows the casing 360 to be attached to the guide 34 that runs in the guide way thus providing the support and restraint to the drill bit 362.

Both of these examples can be used to form one or two or more half round exposed channels in the end of the concrete of an already constructed diaphragm wall element or bored pile.

FIG. 30 shows a chiselling apparatus 11*c* anchored to the wall by the guide 34 in guideway tube 32 to clean up the cut, exposed face of the concrete wall after cutting.

FIG. 31 shows a reinforcement cage having a single guideway tube for use with the drilling apparatus of FIGS. 29A and 29B having a single guideway tube 32 for engaging with a single guide 34 in the drilling apparatus.

FIG. 32 shows steps in the formation of a circular construction joint between two panels using the drilling apparatus of FIG. 29B and the guideway arrangement of FIG. 31. Step 1 shows the drilling apparatus 11*b* in place, and step 2 shows after drilling has been completed and the drill apparatus removed. In step 3, the chiselling apparatus ensures a prepared surface for good joint formation and the removal of any remaining concrete or soil column between adjacent panels. In step 4, a water bar 140 is inserted down guideway tube 32 to assist in providing a watertight seal.

FIG. 33 shows the steps in the formation of diaphragm wall joint by forming three adjacent circular joints across the face of the wall of the first concrete panel using the steps shown in FIG. 32.

Thus it will be appreciated by one skilled in the art from the disclosure herein that various alternative embodiments can be envisaged, For example, the cutting mechanism for cutting along the height of the guideway tube may comprise a first cutting element in the form of one or more bullet teeth, and/or one or more sawblade teeth and/or one or more rotatable cutting wheels, or a drill. The teeth may be arranged on the same cutting wheel or may be arranged on separate cutting wheels or mounts for cutting wheels. Thus, one or more driven (powered) external cutting components such as a milling wheel comprising bullet teeth, milling wheel with bullet and sawblade teeth, and a milling wheel with saw blade teeth may be used to provide a cut along the sacrificial element of the guideway optionally with any combination of raised portions to provide a shear key rebate. Alternatively or in addition, the cutting mechanism may comprises a second cutting element in the form of one or more passive internal (or indeed external) rotatable cutting wheels (which typically are freely rotatable) may be used to provide a cut along the sacrificial element of the guideway optionally with any combination of raised portions to provide a shear key rebate.

The jointing system of the invention will be capable of providing a panel jointing system equal to or better than the CWS system in the following respects:

- Water tightness
- Equivalent shear key
- practically a guarantee of full panel to panel connection across the entire joint In addition the present invention will be capable of providing the following benefits that cannot be provided by the CWS system:

- Additional shear transfer across the joint
- Tension connection between adjacent panels
- Allows incorporation of measures to further improve water tightness beyond that achievable with the CWS
- Allows more of the panel to be reinforced thus reducing reinforcement densities
- Allows for a joint between the face of one panel and the end of another panel
- Depth of joint only limited by equipment capabilities
- Joints with all the above benefits between diaphragm wall panels and circular bored or secant piles
- Allows the flexibility to form "special" constructions including radial panel joints for circular shafts.

The principle of the present invention is that a guideway track, preferably in the form of a guideway tube, will be cast into the concrete of a diaphragm wall panel. This track is used to guide a milling machine to form a construction joint between two panels. The milling operation takes place after the adjacent panel is excavated but before the slurry is cleaned or reinforcement installed.

Whatever shape of guideway track is installed it must be such that part of it can be cut away by the milling process to allow the guide connection plates to pass but sufficient must remain to be able to fully constrain the guides. The arrangements described use circular components for both the guideway track and guide but there are several possible shapes and arrangements that could fulfil this function, one of which is shown in FIG. 12. Alternative shape/arrangements of guideway track and guide may to be used.

The details described above of the ladder support and its' connection to the reinforcement cage 48 are purely indicative. The combined system will need to be rigid enough to maintain the necessary tolerances but flexible enough to be lifted and placed along with a reinforcement cage. The degree of rigidity may be adjusted to suit the specific situation. It will be desirable to use standard steel sections and other readily available components.

The guide which is to run in the guideway and keep the milling machine in the correct position may be either a solid (round) bar or another heavy duty (hollow) pipe or set of cross plates (see FIG. 11D) that fits within the circular guideway tube with about 5 mm of clearance. The length of the guide would depend on the size and arrangement of the milling machine but it is envisaged it to be between 2 m to 4 m long. The guide may be connected to the milling machine by flat plates around 40 mm thick.

The milling of the concrete will cause significant vibration throughout the machine. It would be undesirable to allow excessive shaking or vibration of the guide so one or more centralizers (236) between the guide and the track may be provided. This may be achieved by drilling and tapping holes in the guide and then fixing spring loaded single ball bearings or wear strips. These may assist to provide sufficient clearance and dampen vibration.

The tolerance box (see 120 in FIG. 13*c*) is shown as typically 10 mm, this may be increased to accommodate the cumulative effects of:

- Manufacturing tolerances of the equipment
- Horizontal movement of the guide even with the centralizers described earlier
- Wear on the teeth on the milling wheel Amendments to the arrangement which would increase the tolerances are:

- Cutting a slightly longer arc out of the guideway tube. The limiting factor being to retain sufficient length of the guideway tube circumference to adequately restrain the guide.
- Thinning down the guide where it is level with the centre of the milling machine. A reduction of say 10 mm to 20 mm in the overall guide thickness in the region of the cutting zone 38 (reducing to nothing a few centimeters above and below this level) is unlikely to cause unacceptable strength reduction in the guide.
- On the vertical line of the centre of the pipe track the milling wheel could have teeth or a grinding ring which protrudes slightly beyond the circumference of the rest of the teeth.

Even if the system had to deal with a thin layer of concrete overlying a still intact PVC pipe, the supports 36, should be able to easily break through given that it will be steeply inclined. The weight of the machine on the contact zone, if necessary, also would assist opening the sacrificial wall element 82 if required. It may be preferable for the PVC to be of the brittle variety so that it shatters rather than be plastic so it just bends out of the way.

The guide is preferably connected to the body of the machine through a limited movement hinge on one or both ends of support(s) 36. This would allow for any variation in spacing between two laterally spaced guideway tubes while only affecting the tolerances discussed above by an insignificant amount.

The milling machine of the invention is preferably capable of removing up to about 300 mm of concrete and a combined thickness of 500 mm of soil and concrete in front of the guideway tube. Therefore it would seem possible to reduce the diameter of the cutting wheel from the standard 1.4 m to 1.5 m to something around 500 mm or 1000 mm. With either of these sizes the system of housing the motor inside the wheel is probably not practical so it may sit remote from the milling wheel. The obvious place to put the hydraulic motor is in a frame above the wheel. The wheel would then need a suspension and fixing arrangement from the same frame and a chain drive coupling it to the motor. For ease of swapping wheels and other maintenance reasons, it is preferable not to site a suitable hydraulic motor inside the cutting wheel.

The reason for stating both 0.5 m and 1 m wheel diameter is that to adopt a system with a standard chain system coupling to a central axle running through the centre of the milling wheel, it would be preferable to ensure that the chain housing and connection at the axle would not be obstructed by concrete or soil. To achieve this, the wheel diameter would need to be 1 m or perhaps slightly more.

If there is the same general arrangement but the chain was complete with teeth then the milling wheel would cut across its full length and diameter so the smaller 0.5 m or so diameter of wheel may be adequate.

From the above the chain with cutting teeth is a preferred choice but there may be advantages in milling in two stages which would allow a more standard coupling chain. Thus, one preferred system is to mill the full face of the concrete in two passes either by vertically separated different width wheels in the one machine or making two passes down the joint using interchangeable wheel arrangements. For efficiency vertically separated wheels in the same frame would seem to be the best choice so details of one such possible arrangement, are shown in FIGS. 14A, 14B and 14C.

In the arrangement shown there are several possible benefits compared to other options:

- As shown cutting teeth can be fixed to the external side faces of the outermost wheels. This is necessary because there will be some misalignment, even if just a few tens of millimeters, in the panel excavation making it necessary to trim the trench sides as the machine advances if we want to mill across the total width of the joint.
- Only the two lower external milling wheels are intended to do any significant concrete cutting and this around the guideway tube to allow passage of the guide. The optional central lower milling wheel 136*a* is shown to have a slightly smaller diameter. This is because the primary purpose of this wheel is to remove the remaining soil from the face of the concrete.
- On the upper milling wheel smaller more closely spaced milling teeth could be used. These together with a higher rotation speed for this wheel are likely to produce a better cut concrete surface with more efficiency and less wear.
- The central section of the upper milling wheel 130 can be increased in diameter to produce a similar trapezoidal shaped shear key.
- The chain drive and the relatively small size of the individual milling wheels is likely to facilitate an arrangement that will make it easier and quicker to exchange wheels for maintenance and teeth replacement.

There are a few remaining general points in regard to the proposals for the milling machine:

- The size of the frame and any enclosure of the hydraulic motor and gear box sections preferably should be less than the trench width. The guideway tube and guide system will maintain the position of the machine and any attempt to use the body of the equipment to guide against the grab excavated trench sides may result in conflict between the two systems. A preferred maximum width, apart from the width across the lower cutting wheel, is at least 200 mm less than the trench width.
- The overall weight of the machine has to be considered. The mass is preferably sufficient so that it will damp the vibrations from the cutting action and also be sufficient for the lower track/guide connector to break off any remaining portion of the sacrificial element (PVC pipe not in contact with the steel pipe). At the other end of the scale it must not be so heavy that the guideway tube and guide system is compromised and an excessively large base machine is required. There is likely to be an optimum tension in the holding cable from the base machine that will produce the best production and least wear on the teeth. The optimum weight may be between 5 t and 10 t.

An existing grab crane may be used to operate the milling machine. The grab would have to be capable of being laid down and quickly released from the holding rope and hydraulic connections so that these may be switched to the milling machine whose hydraulics requirements would need to be compatible with the flows and pressures that can be supplied from the grab crane. This arrangement is very desirable. A purpose built base machine may alternatively be used.

Possible production rates are an average of 10 linear meters of joint per hour, with a possible worst case of 5 lm/hour and a possible best case of 20 lm/hour. Some variation would be attributable to concrete strength and it would clearly be an advantage to get onto the joint as soon as possible. If we assume 10 lm/hour and a 40 m deep panel then it will take about half a day to mill the joint including set up and moving times. Assuming a 3.1 m long panel and reasonable soils then the grab will take not much over one shift to dig the panel. As the programme for a typical project for 40 m to 50 m deep walls usually requires two or more grab cranes then it would seem more sensible for one joint milling machine to work with two grabs. The final cost of the milling machine is very likely to be less than the cost of a grab complete with base machine. It follows therefore that it may be better to let the grabs focus on excavation of panels. However there will always be the site that has limited space or other special constraints and for these it might still be an advantage to make the milling machine interchangeable with a grab.

Any new base machine would probably need to have the following:

- Crawler based with the capability to track with the milling machine even if outriggers of legs are used during the milling operation.
- 360 degree slewing capability
- Winch system comfortably capable of lowering and raising the milling machine. We can of course use two or more falls of rope as we do with hydro-mills.
- Hydraulic hose reel with tensioning capability.
- Short mast or swan neck type boom.
- Hydraulic power pack capable of running the milling machine and winch together but not necessarily the crawler tracks at the same time as we would never want to move the tracks if the mill was in operation or being raised or lowered.
- Operators cab complete with monitors and instrumentation providing the following information:

1. Load on the winch line
2. Depth
3. Direction of rotation for each set of wheels
4. Rotation speed for each set of wheels
5. Torque applied on each set of wheels 6. Pressure, flow and temperature information necessary for the safe and efficient operation of the hydraulic systems
7. Data processing systems capable of logging as a minimum 2, 3, 4 and 5 and also capable of downloading the information in an easily understood format.

Apart from standard controls for the operation of the tracks, slewing, winch and any mast or boom adjustment the following would be required:

Automatic incremental lowering of the winch line to maintain a pre-set load.

Controls to change the direction of rotation for either set of milling wheels.

Controls to change the rotation speed (rpm) for either set of milling wheels.

Controls to vary the applied torque to each set of milling wheels.

The tendency, in developed sites is for the (horizontal) length of deep panels to be kept as short as possible to reduce settlement and to minimise the time necessary to install the reinforcement cage and pour concrete. So although there is no reason why the present invention cannot be used in 6 m or 7 m long panels, its' use on panels in the order of 3 m long is more likely. Whatever length is selected it should be borne in mind that the present invention is likely to perform better if there is little or no soil left up against the concrete of the previous panel. The hydraulic grabs are not very good at chopping down and extending an already excavated trench. This is particularly true when the length of the trench extension is only a quarter or less of the grab length. If a panel is 50 m deep and the engineer requires it to be in the order of 3 m long then one needs to consider excavation tolerances to decide on the actual minimum length we should use. Most specifications require to work within a 1:200 vertical tolerance. For 50 m panel depth and taking the worst case maximum cumulative tolerance condition one would need to excavate a 3.3 m long panel to be sure of having the minimum 2.8 m length needed by the grab. This could leave 500 mm or more thickness of soil column to remove. A more realistic approach, particularly as experience has shown that the new hydraulic grabs can work to 1:400 or better, is to assume that the tolerances will never be cumulative and that a 1:200 single allowance or a 1:400 cumulative is a more reasonable approach. This would leave 250 mm or so of soil in front of the joint. The inventor suggests that one would use panel lengths of 3 m up to 50 m depth and 3.05 m from 50 m to 60 m deep.

After the milling machine has finished, the grab, while cleaning out the panel, may run down and up with the teeth hard up against the concrete to smooth out any misalignment issues in the trench sides.

The prior art joint former and associated water bar take up about 200 mm of the length of any panel. Above that we normally allow an additional clearance of about 250 mm at each end of the cage. Therefore the cage length in a 3 m long panel is 2.3 m. This means that nearly 25% of the panel remains unreinforced often causing problems with reinforcement density leading to closer spacing and doubling up of main bars.

With the present invention (and the optional water bar) located as shown in FIG. 9 more of the panel can be reinforced. The minimum advantage would be if the guideway tubes were hard against the soil at the end of the trench leaving the same 250 mm tolerance between the other end of the cage and the previous panel. There is about 200 mm between the face of the concrete (not in the shear key) and the reinforcement cage although this could be reduced to 150 mm if the ladder guideway tube was tight up against the cage. For this arrangement the unreinforced panel length reduces to about 15%. The maximum advantage would be gained if we used spacers and/or the guideway tube itself to install the cage with just 75 mm of cover to the joint. This would leave more depth of concrete to mill but would mean that 92% of the 3 m long panel could be reinforced reducing reinforcement densities by nearly 20%.

The present invention allows installation of a relatively easy and yet effective and reliable tension connection across the joints between panels. For example, a slightly smaller pipe, which fits snugly inside the guideway tube may be installed along with the reinforcement cage (e.g. see FIG. 11E). A long length of pipe might jam during cage lowering so this pipe might be best installed in small sections say with three of four reinforcement bars to each section. In either case the pipe and bars may need to be installed with the cage so they may need to be securely restrained yet loose enough to move backwards and forwards as the cage is lowered. The answer might be hoops/fixed to the inside of links of the cage, which can hold the bars securely but allow some movement particularly parallel to the line of the trench.

A polythene or similar sleeve filled with slurry down the middle of the smaller pipe is used to maintain a small positive head of slurry. The purpose of this is to ensure that after concreting it is possible to install a grout pipe, flush out all slurry and loose material and then after concreting the panel in stage 5 we pressure grout to fill all remaining voids in the pipe and guideway tube.

In a corner situation it may be that shear studs, rather than the full tension transfer indicated in FIGS. 20A and 20B, would be adequate. These could be attached to the rear of the guideway tubes.

Perhaps more awkward than a right angle corner panel are where changes of direction are required. These can also be accommodated by the present invention as illustrated in FIGS. 20A and 20B. Small (0° to 30°) or large (60° to 90°) changes of angle are readily achievable with the connection made either to the end or face of the adjoining panel. With direction changes between 30° and 60° it will probably be necessary to use void forming material, or some other alternative method, so as not to leave too great a depth of concrete beyond the capability of the milling machine to remove.

The ability to connect at corners and have tension connection across the joints is ideally suited to the construction of counterfort or "T" panels.

The reason for designing equal length panels with joints on the radials of a curve (typically a circle) to which the panels are tangents, is that it is an efficient, robust and simple design. Each panel is a keystone wedged in between the adjoining panels (see FIGS. 17 and 18C). If built it may reduce the costs of shaft construction significantly.

Another factor that makes the present invention advantageous for shaft construction is the guarantee of full panel contact across the joint.

FIG. 19 illustrates the sort of arrangement with which it would be possible to form a shaft about 20 m diameter and how it would be constructed. This example would produce starter panels with centre line lengths of around 2.7 m and closure panels of around 3.3 m using a 2.8 m long grab. However if we were to use a longer say 3.2 m grab and the 2.8 m for closures we probably could get all the panels the same length or as close as makes no difference.

The present invention may work with grabs, but there is no reason why it should not work in association with a hydro-mill. Typically with hydro-mill excavated diaphragm walls the joints are overcut with the mill to take account of tolerances in panel verticality and dig verticality. Using the present invention will allow the mill to move on to excavate the next panel and will mean less concrete to cut back because the overcut with the mill in the prior art has to be greater than with the present invention because of verticality considerations. The biggest benefit though, particularly with deep shafts, is that the present invention can provide full panel to panel contact across the joint something the existing technology cannot do.

The guideway tube can be installed in a bored pile. This example described in FIG. 18A shows a 1.5 m diameter pile with a 1.2 m thick diaphragm wall connecting to it. This application opens up a whole range of new possibilities for example:

connecting a diaphragm wall to a secant wall.

allowing panels/pile to fit a short length or awkward shaped section of diaphragm wall that could not be achieved with the standard grab length.

in areas where the clay is deep, Engineers might find a combination wall performing as a permanent soldier pile wall an attractive design solution for some situations. The bored piles would be poured dry, maximising bearing capacities, while the interconnecting diaphragm walls are taken only as deep as necessary to form the basement walls with minimal penetration below excavation level. The bored piles could even be under-reamed.

a similar arrangement with the bored piles socketed deep into the rock but the diaphragm wall stopping on the rock surface would be an efficient and cost effective way of constructing some deep basement projects.

The capability of creating structural connections between diaphragm wall panels and between piles and diaphragm walls could lead to all types of complex underground structures that could not have been previously considered or constructed. Connection structures for large shafts, Figure of eight or even cloverleaf, tie back or vertical column structures for high cantilever heights, interconnected walls/piles forming huge floating rafts for high loads in poor soils are possible implementations of the present invention.

Variations of the described embodiments can be envisaged from the description enclosed herein and all such embodiments are to be included within the invention.

The invention claimed is:

1. An apparatus for constructing a wall comprising:

at least one guideway tube along a height of a first wall of a first concrete panel and in which the at least one guideway tube is hollow, wherein the at least one guideway tube comprises a sacrificial wall element that extends along the at least one guideway tube and about at least a portion of a periphery of the at least one guideway tube; and at least one cutting mechanism configured to cut along the height of the first wall of the first concrete panel, the at least one cutting mechanism being arranged to cut along the height of the wall of the first concrete panel and along the sacrificial wall element of the at least one guideway tube so as to cut at least part of the sacrificial wall element of the at least one guideway tube to form an aperture in the at least one guideway tube along at least part of the height of the first wall to allow ingress of concrete into the at least one guideway tube.

2. The apparatus according to claim 1 comprising the cutting mechanism being arranged so as to cut away at least part of the first wall of the concrete panel across at least part of a width of the first wall and along at least part of the height of the first wall and so as to cut at least part of the sacrificial wall element of the guideway tube to form the aperture in the at least one guideway tube along at least part of the height of the first wall.

3. The apparatus according to claim 1 in which at least one of the at least one cutting mechanism is driven.

4. The apparatus according to claim 1 in which the cutting mechanism comprises a first cutting element configured to cut the concrete along the height of the wall of the first concrete panel and a second cutting element configured to cut the sacrificial wall element along the sacrificial wall element of the at least one guideway tube so as to cut at least part of the sacrificial wall element of the at least one guideway tube to form the aperture in the at least one guideway tube along at least part of the height of the first wall to allow ingress of concrete into the at least one guideway.

5. The apparatus according to claim 4 in which the first cutting element is driven and the second cutting element is driven or passive.

6. The apparatus according to claim 5 in which the first cutting element comprises at least one of a milling wheel and bullet teeth and the second cutting element comprises one of at least one a saw blade having saw blade teeth and at least one freely rotatable cutting wheel, or the first cutting element comprises a drill and the second cutting element comprises at least one freely rotatable cutting wheel.

7. The apparatus according to claim 1 in which the guideway tube comprises at least one of:

a first tube comprising a pipe having an aperture along its length; and sacrificial material closing the aperture to form the sacrificial wall element, a second tube of sacrificial material, or a pipe of sacrificial material.

8. The apparatus according to claim 1 in which the at least one guideway tube comprises:

at least one of a series of discrete first tube portions spaced along at least part of the height of the first wall, and a series of brackets spaced along at least part of the height of the first wall;

and said apparatus further comprises:

a second tube of sacrificial material along the height of the first wall of the first concrete panel and the discrete tube portions, or the brackets, spaced along the second tube of sacrificial material.

9. The apparatus according to claim 8 in which the first tube and the second tube are provided and the second tube substantially surrounds, or is surrounded by, the first tube.

10. The apparatus according to claim 9 in which a portion of, or substantially the whole of, the periphery of an innermost surface of the outermost tube is contiguous with a portion of, or substantially the whole of, the periphery of an outermost surface of the innermost tube, and in which the contiguous portions of the innermost and outmost tubes form a seal to substantially prevent ingress of concrete during pouring of concrete for the second panel.

11. The apparatus according to claim 1, in which the cutting mechanism comprises at least one guide configured to engage with at least one of the at least one guideway tubes so as to guide the cutting mechanism as it cuts along the first wall and along the sacrificial element and in which the cutting mechanism comprises at least one of the at least one guide configured to be anchored in the guideway tube so as to resist lateral movement of the cutting mechanism away from the wall during cutting.

12. The apparatus according to claim 11 in which at least two guides are provided and are configured to engage with one or more guideway tubes and at least two of the at least two guides are spaced in an arrangement comprising at least one of lateral or horizontal spacing from one another.

13. The apparatus according to claim 11 in which the angular extent of the sacrificial wall element about a portion of the periphery of at least one of the at least one guideway tubes is selected so as to enable a remaining portion of the at least one guideway tube, after at least a portion of the sacrificial wall element is cut, to anchor the at least one guide and cutting mechanism to the at least one guideway tube and to resist lateral motion of the cutting mechanism away from the first side wall of the first panel.

14. The apparatus according to claim 1 comprising at least one protruding key element configured to interengage with the at least one guideway tube so as to connect the first and second panels together, and in which the at least one protruding key element and the at least one guideway tube form a tension joint between the first and a second concrete panel, the at least one protruding key element configured to be at least one of sized or shaped with respect to the at least one guideway tube to form an anchor to resist lateral extraction from the at least one guideway tube.

15. The apparatus according to claim 14 comprising a first reinforcement cage having at least one of the at least one guideway tubes attached to the first reinforcement cage and a second reinforcement cage having the at least one protruding key element attached to the second reinforcement cage.

16. The apparatus according to claim 1 further comprising:

a supplementary tube of sacrificial material; and a water impeding element is located in the supplementary tube and extends into a second trench for providing a water bar between the first concrete panel and a second concrete panel.

17. A kit for use with the apparatus of claim 1 comprising one or more of:

at least one protruding key element configured to engage with a guideway tube; the at least one protruding key element configured to form an anchor to resist extraction from the guideway tube so as to form a tension joint;

at least one guideway tube comprising a sacrificial wall element;

at least one guideway tube comprising a first tube comprising a pipe having an aperture along at least part of a length of the pipe;

at least one guideway tube comprising discrete first tube portions;

at least one second tube having a sacrificial wall element;

at least one guideway tube comprising a pipe of sacrificial wall material;

a series of brackets for a pipe of sacrificial material;

a water impeding element joint comprising a supplementary tube of sacrificial material; or a water impeding element.

18. A method of constructing a diaphragm wall comprising:

a) casting at least one guideway tube comprising a sacrificial wall element that extends along the at least one guideway tube and about at least a portion of a periphery of the at least one guideway tube into a first concrete panel along a height of a first wall of the first concrete panel, wherein the guideway tube is hollow;

b) cutting along the height of the first wall of the first concrete panel;

c) cutting along at least part of the length of the sacrificial wall element of at least one of the at least one guideway tube and forming an aperture in at least one of the at least one guideway tube along at least part of the height of the first wall; and d) pouring a second concrete panel, so that concrete enters into the at least one of the at least one guideway tube via the aperture.

19. A The method according to claim 18 comprising cutting at least part of the first wall of the first concrete panel across at least part of the width of the concrete panel along at least part of the height of the first wall and cutting at least part of a the sacrificial wall element of at least one of the at least one guideway tube to form the aperture in the at least one guideway tube along at least part of the height of the first wall.

20. A The method according to claim 18 in which at least one of the following occurs:

step (b) and (c) occur substantially at the same time;

step (b) and (c) occur through the same cutting mechanism; or step (b) and (c) occur through the same cutting action.

21. A The method according to claim 18 comprising forming a tension joint by providing a protruding key element in a second panel configured to engage with the at least one of the at least one guideway tubes cast in the first panel via the aperture.

22. A wall formed using the apparatus of claim 1, comprising at least two or a series of concrete panels adjoining one another, the concrete panels comprising:

at least one guideway tube comprising a sacrificial wall element, the at least one guideway tube cast in concrete along a height of a first wall of a first concrete panel, and wherein the at least one guideway tube is hollow;

a cut of a first concrete panel forming a cut end face along the height of the first concrete panel; and a cut of at least part of the sacrificial wall element of at least one of the at least one guideway tubes forming an aperture into at least one of the at least one guideway tubes along at least part of the height of the first wall of the first concrete panel;

a joint integral with a second concrete panel formed from concrete wholly or partially filling the at least one guideway tube of the first concrete panel via the aperture upon pouring of concrete to form the second concrete panel.

23. The wall according to claim 22 comprising the cut end face of at least part of the first wall of the first concrete panel across at least part of the width and along at least part of the height of the first concrete panel, and the cut of at least part of the sacrificial wall element of the first guideway tube, along at least part of the height of the first wall of the first concrete panel.

24. The wall according to claim 22 comprising at least one protruding key element for interengaging with the guideway tube so as to connect first and second panels together and in which the at least one protruding key element and the guideway tube form a tension joint.

25. The wall according to claim 24 comprising a first reinforcement cage having the guideway tube attached to the first reinforcement cage and a second reinforcement cage having the at least one protruding key element attached to the second reinforcement cage.

26. The wall according to claim 22 in which two or more laterally separated guideway tubes are provided along the height of the first wall of the first concrete panel.

27. A kit for use in a diaphragm wall of claim 22 comprising one or more of:

at least one protruding key element configured to engage with a guideway tube; the at least one protruding key element configured to form an anchor to resist extraction from the guideway tube so as to form a tension joint;

at least one guideway tube comprising a sacrificial wall element at least one guideway tube comprising a first tube comprising a pipe having an aperture along at least part of a length of the pipe;

at least one guideway tube comprising discrete first tube portions;

at least one second tube having a sacrificial wall element;

at least one guideway tube comprising a pipe of sacrificial wall material;

a series of brackets for a pipe of sacrificial material;

a water impeding element joint comprising a supplementary tube of sacrificial material; or a water impeding element.

* * * * *